US011230845B2

(12) United States Patent
Gwak

(10) Patent No.: US 11,230,845 B2
(45) Date of Patent: Jan. 25, 2022

(54) BUILDING EXTERIOR PANEL AND ASSEMBLY STRUCTURE THEREOF

(71) Applicant: KWANG STEEL CO., LTD., Cheongju-si (KR)

(72) Inventor: In-Hak Gwak, Sejong (KR)

( * ) Notice: Subject to any disclaimer, the term of this patent is extended or adjusted under 35 U.S.C. 154(b) by 0 days.

(21) Appl. No.: 16/964,972

(22) PCT Filed: Sep. 17, 2018

(86) PCT No.: PCT/KR2018/010902
§ 371 (c)(1),
(2) Date: Jul. 24, 2020

(87) PCT Pub. No.: WO2019/156303
PCT Pub. Date: Aug. 15, 2019

(65) Prior Publication Data

US 2021/0047837 A1 Feb. 18, 2021

(30) Foreign Application Priority Data

Feb. 7, 2018 (KR) ..... 10-2018-0014937
Aug. 9, 2018 (KR) ..... 10-2018-0093059

(51) Int. Cl.
*E04B 1/70* (2006.01)
*E04F 13/08* (2006.01)
(Continued)

(52) U.S. Cl.
CPC ..... *E04F 13/0875* (2013.01); *E04C 2/292* (2013.01); *E04C 2/34* (2013.01);
(Continued)

(58) Field of Classification Search
None
See application file for complete search history.

(56) References Cited

U.S. PATENT DOCUMENTS 2,912,725 A * 11/1959 Ries ..... E04C 2/292 52/592.1
3,998,024 A * 12/1976 Frandsen ..... E04C 2/365 52/592.1
(Continued)

FOREIGN PATENT DOCUMENTS

CN 1089006 7/1994
DE 202004007330 U1 7/2004
(Continued)

*Primary Examiner* — Basil S Katcheves
(74) *Attorney, Agent, or Firm* — Antonio Ha & U.S. Patent, LLC

(57) ABSTRACT

The present invention relates to a building exterior panel and an assembly structure thereof. A building exterior panel according to an embodiment of the present invention comprises: a front steel plate; a rear steel plate spaced apart from the front steel plate in the rear direction thereof; an upper frame disposed between the upper ends of the front steel plate and the rear steel plate and having a width in the thickness direction; a first side frame disposed at an end of a first side surface located at one end among horizontal opposite ends of the front steel plate and the rear steel plate; a second side frame disposed at an end of a second side surface located at the other end among the horizontal opposite ends of the front steel plate and the rear steel plate; and a lower frame disposed between the lower ends of the front steel plate and the rear steel plate. In addition, an assembly structure of a building exterior panel according to an embodiment of the present invention comprises: a plurality of building exterior panels as described above; and a base steel member having one side fixed to an outer wall and the other side coupled to the plurality of building exterior panels to support the plurality of building exterior panels.

5 Claims, 47 Drawing Sheets

(51) Int. Cl.

| | |
|---|---|
| ***E04C 2/292*** | (2006.01) |
| ***E04C 2/34*** | (2006.01) |
| ***E04B 2/00*** | (2006.01) |
| ***E04F 13/12*** | (2006.01) |
| *E04C 2/38* | (2006.01) |
| *E04C 2/00* | (2006.01) |

(52) U.S. Cl.

CPC ..... *E04C 2/44* (2013.01); *E04F 13/0866* (2013.01); *E04F 13/0894* (2013.01); *E04F 13/0898* (2013.01); *E04F 13/12* (2013.01); *E04C 2/384* (2013.01); *E04C 2/388* (2013.01); *E04C 2002/004* (2013.01); *E04C 2002/3488* (2013.01)

(56) References Cited

U.S. PATENT DOCUMENTS 4,107,892 A * 8/1978 Bellem ..... E04B 1/54 52/396.04
4,123,885 A * 11/1978 Scott ..... E04F 13/0841 52/489.1
4,161,567 A * 7/1979 Sturgeon ..... E04C 2/08 428/594
4,741,139 A * 5/1988 Campbell ..... E04B 7/20 52/408
4,914,883 A * 4/1990 Wencley ..... E04C 2/384 156/79
4,937,993 A * 7/1990 Hitchins ..... E04C 2/288 52/309.14
5,394,672 A * 3/1995 Seem ..... B32B 15/04 52/794.1
5,577,363 A * 11/1996 Tate ..... B29C 44/1233 52/309.11
6,253,511 B1 * 7/2001 Boyer ..... E04C 2/292 52/235
6,905,332 B1 * 6/2005 Neal ..... A21B 1/24 110/336
8,776,472 B1 * 7/2014 Kinser, Jr. ..... E04B 1/80 52/582.2
8,938,927 B1 * 1/2015 Bragg ..... E04B 2/02 52/483.1
2011/0209429 A1 * 9/2011 Gingras ..... E04C 2/292 52/588.1
2011/0252737 A1 * 10/2011 Boyer ..... E04C 2/292 52/588.1
2016/0017606 A1 * 1/2016 Bottin ..... E04B 1/3483 52/79.1

FOREIGN PATENT DOCUMENTS

| | | | |
|---|---|---|---|
| JP | S47-35218 | U | 12/1972 |
| JP | S55-24447 | U | 2/1980 |
| JP | H02-61253 | | 3/1990 |
| JP | H06-85806 | U | 12/1994 |
| JP | H10-237996 | A | 9/1998 |
| JP | 2000-230284 | | 8/2000 |
| KR | 20-0200301 | | 10/2000 |
| KR | 10-2010-0056084 | | 5/2010 |
| KR | 10-2010-0116924 | | 11/2010 |
| KR | 10-1052478 | | 11/2010 |
| KR | 20-2011-0004758 | | 5/2011 |
| KR | 20-2011-0004759 | | 5/2011 |
| KR | 10-1072607 | | 10/2011 |
| KR | 10-2012-0059083 | | 6/2012 |
| KR | 10-1297749 | | 5/2013 |
| KR | 10-2017-0010513 | | 2/2017 |
| KR | 10-1818754 | | 2/2018 |
| RU | 80481 | U1 | 2/2009 |

* cited by examiner

【FIG. 1】
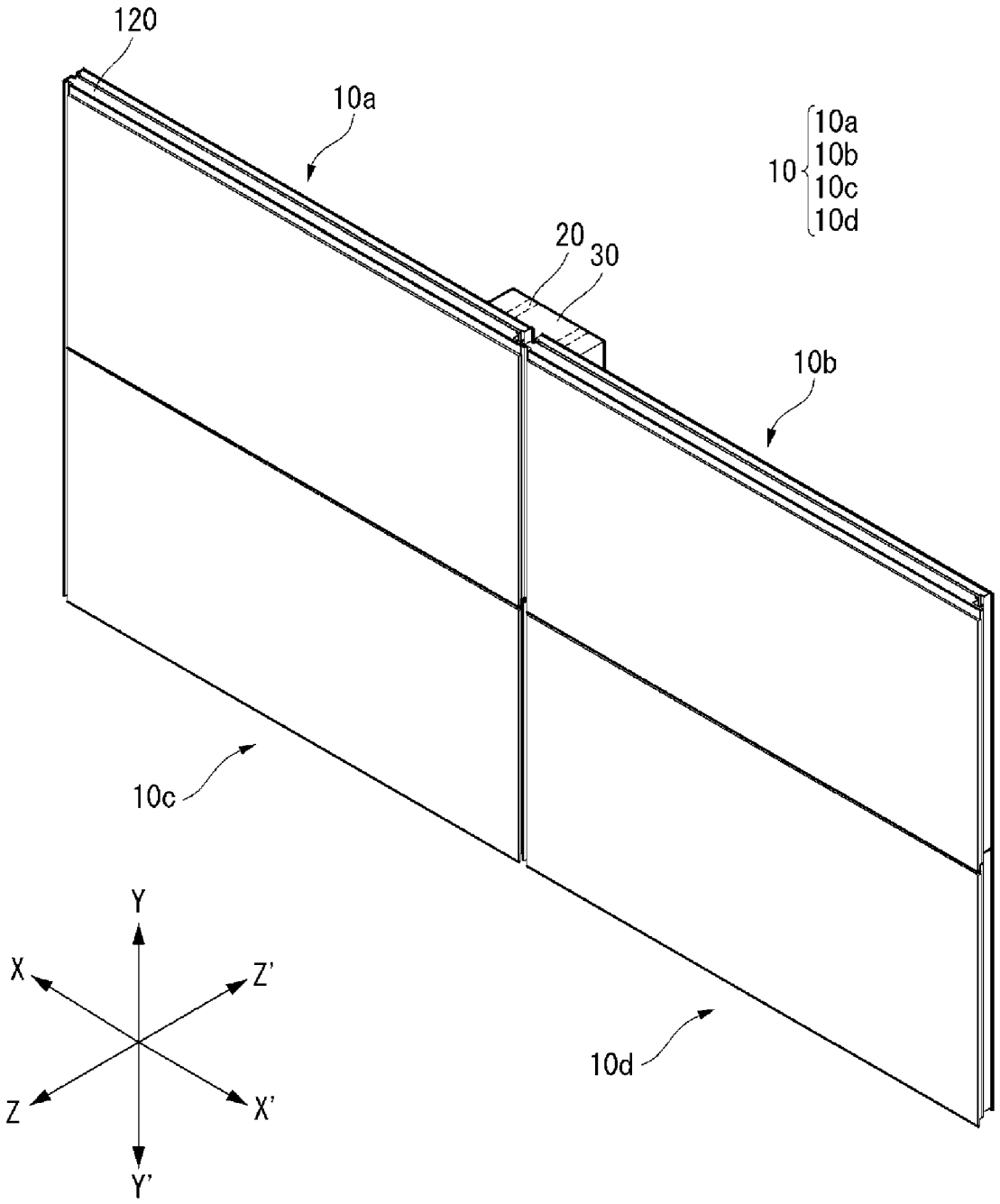

【FIG. 2】
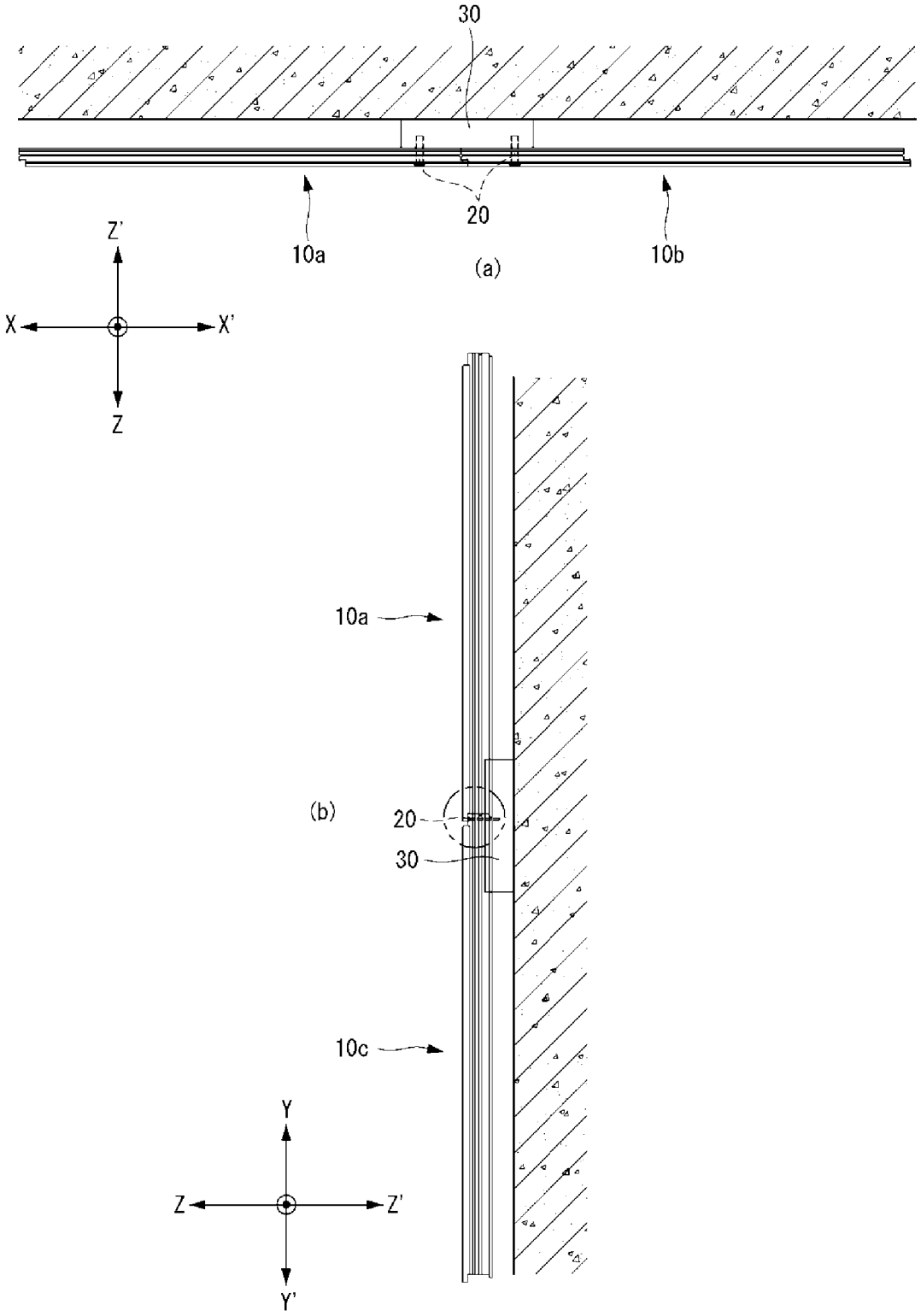

【FIG. 3】
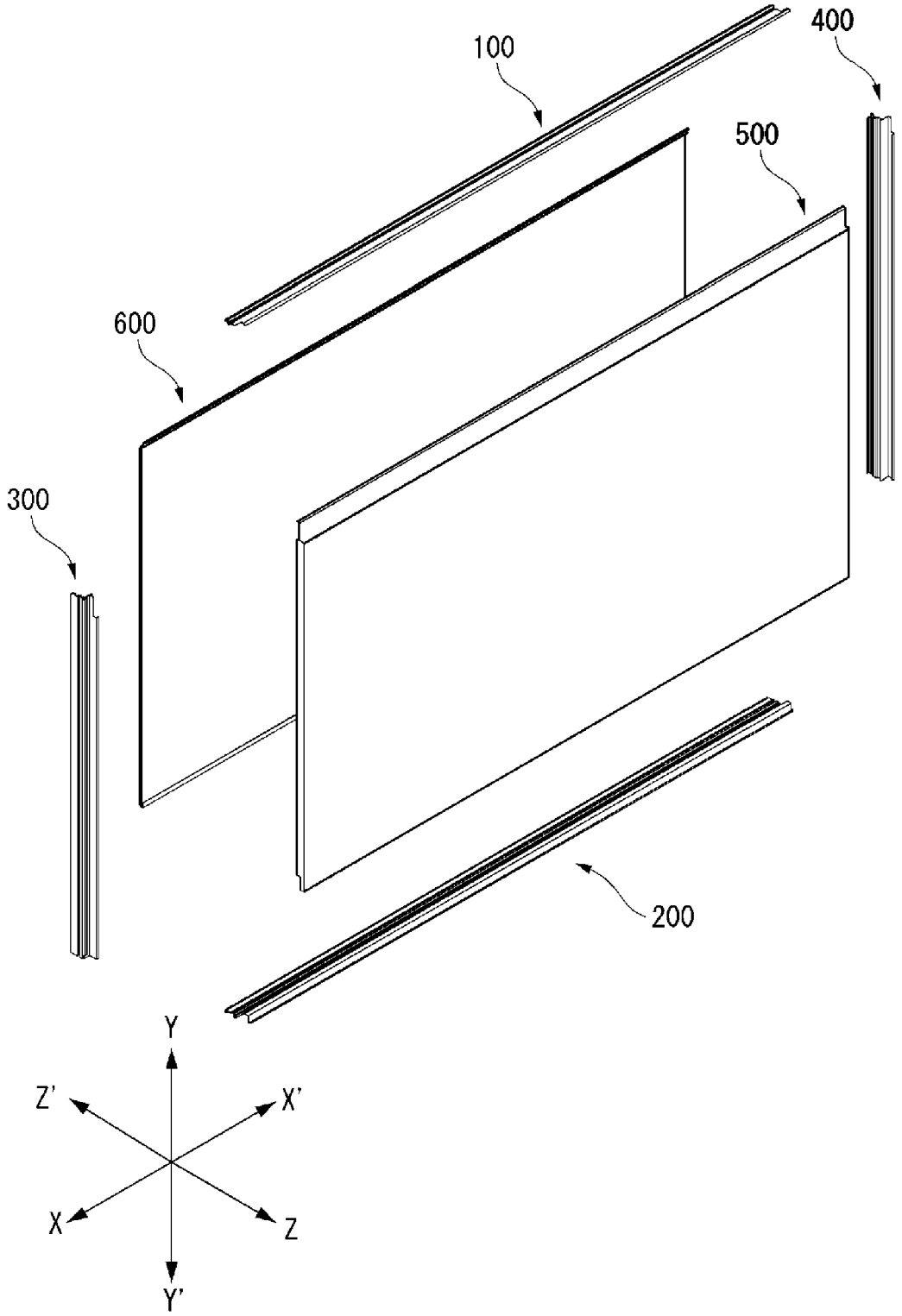

【FIG. 4】
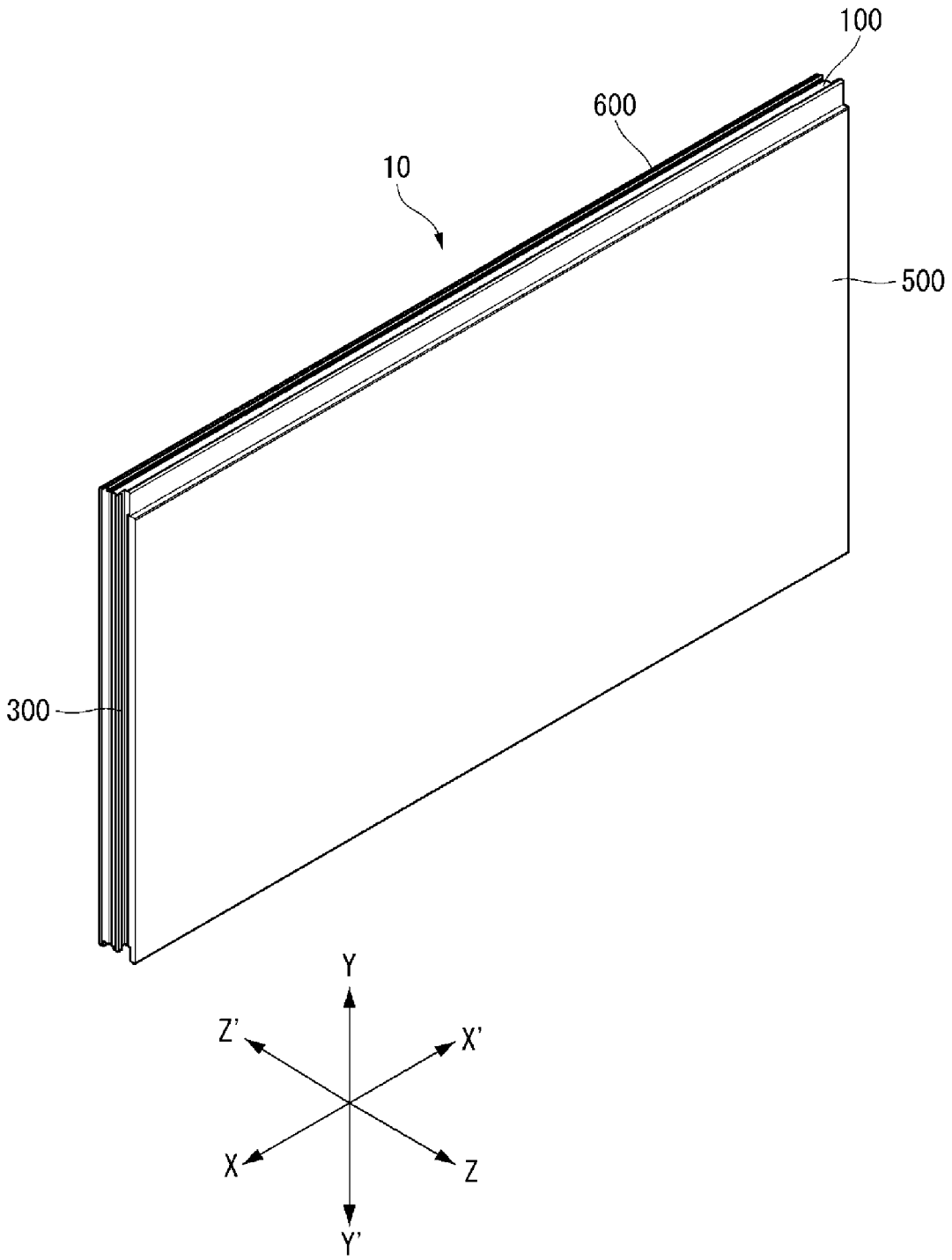

【FIG. 5】
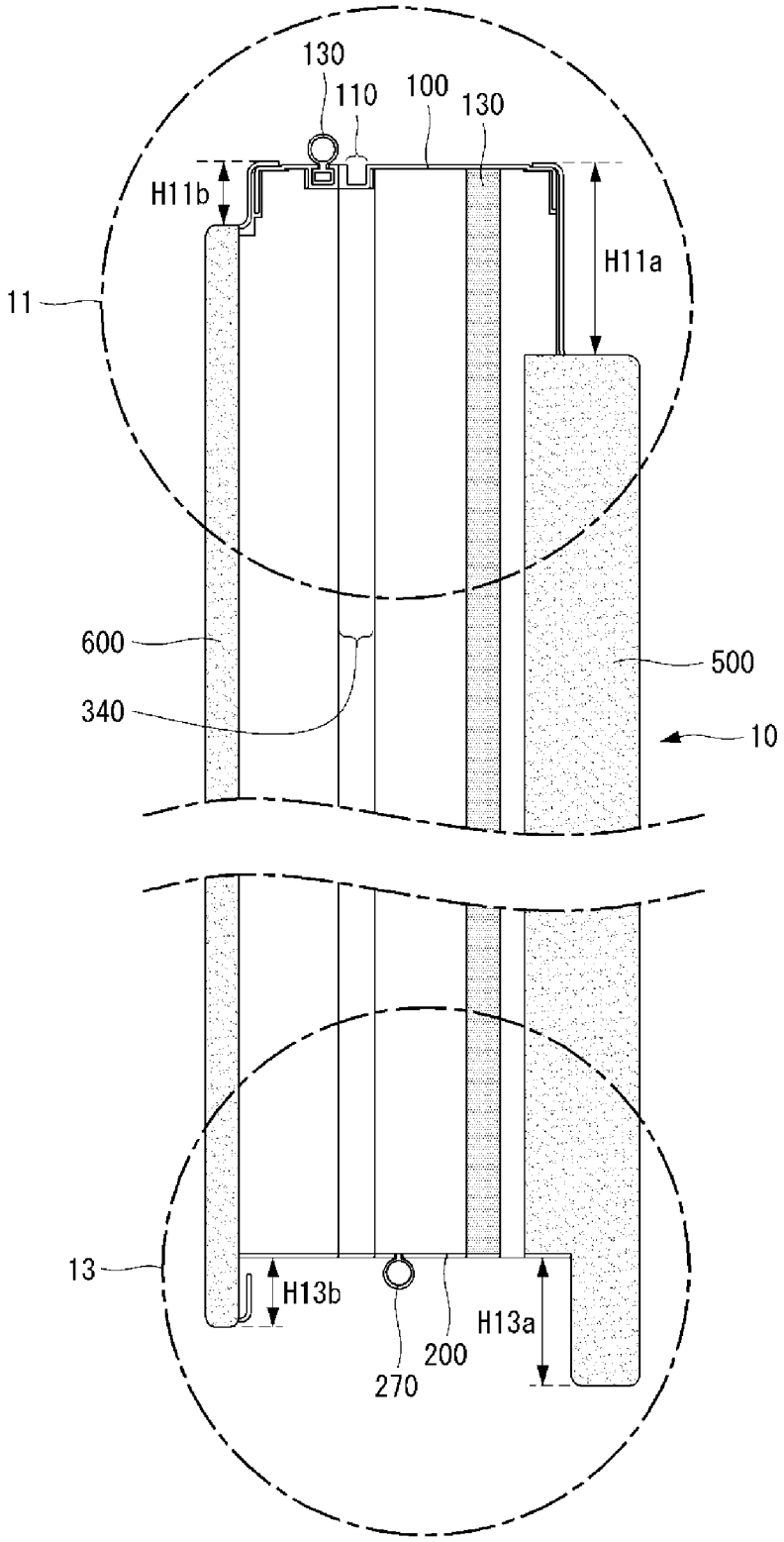

【FIG. 6】
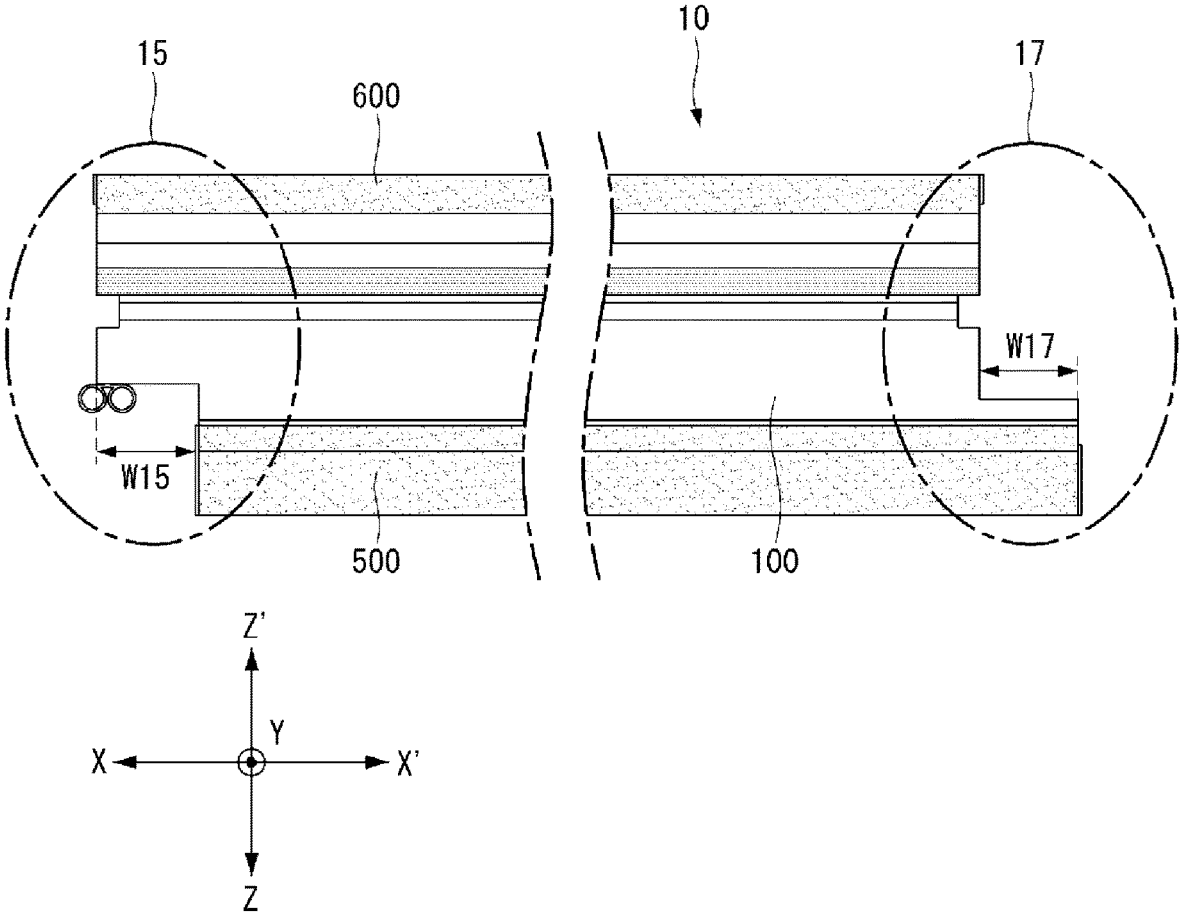

【FIG. 7】
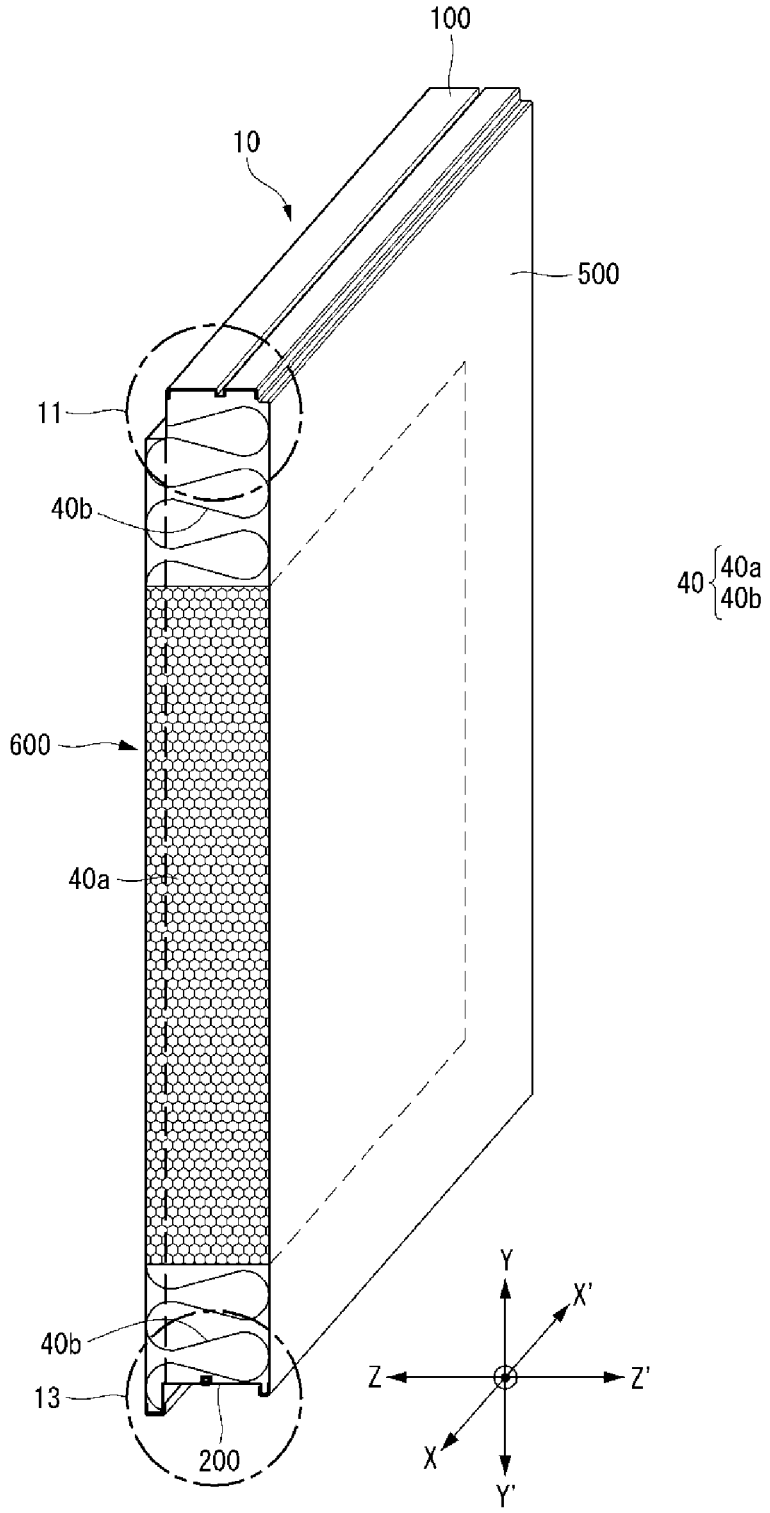

【FIG. 8】
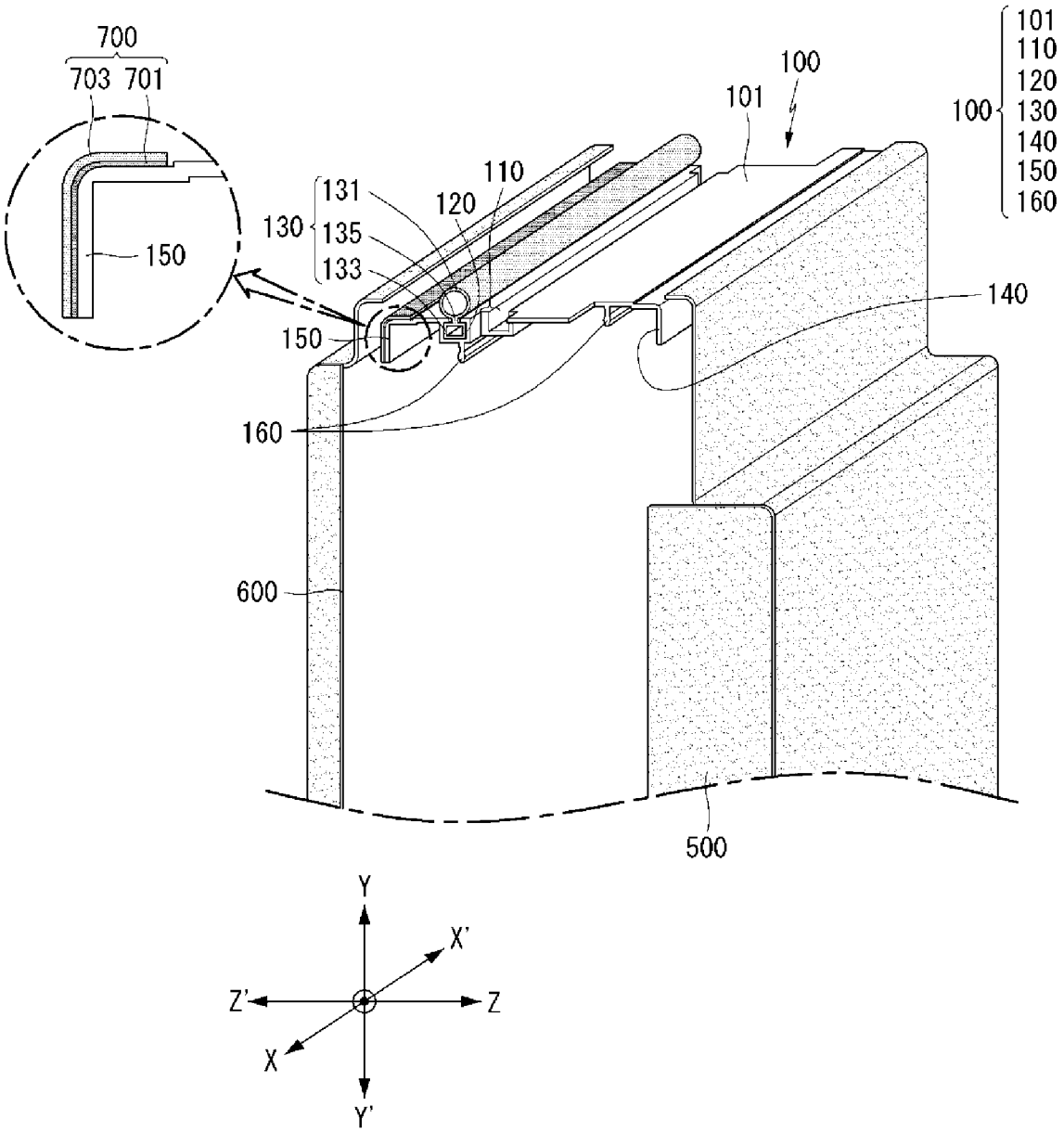

【FIG. 9】
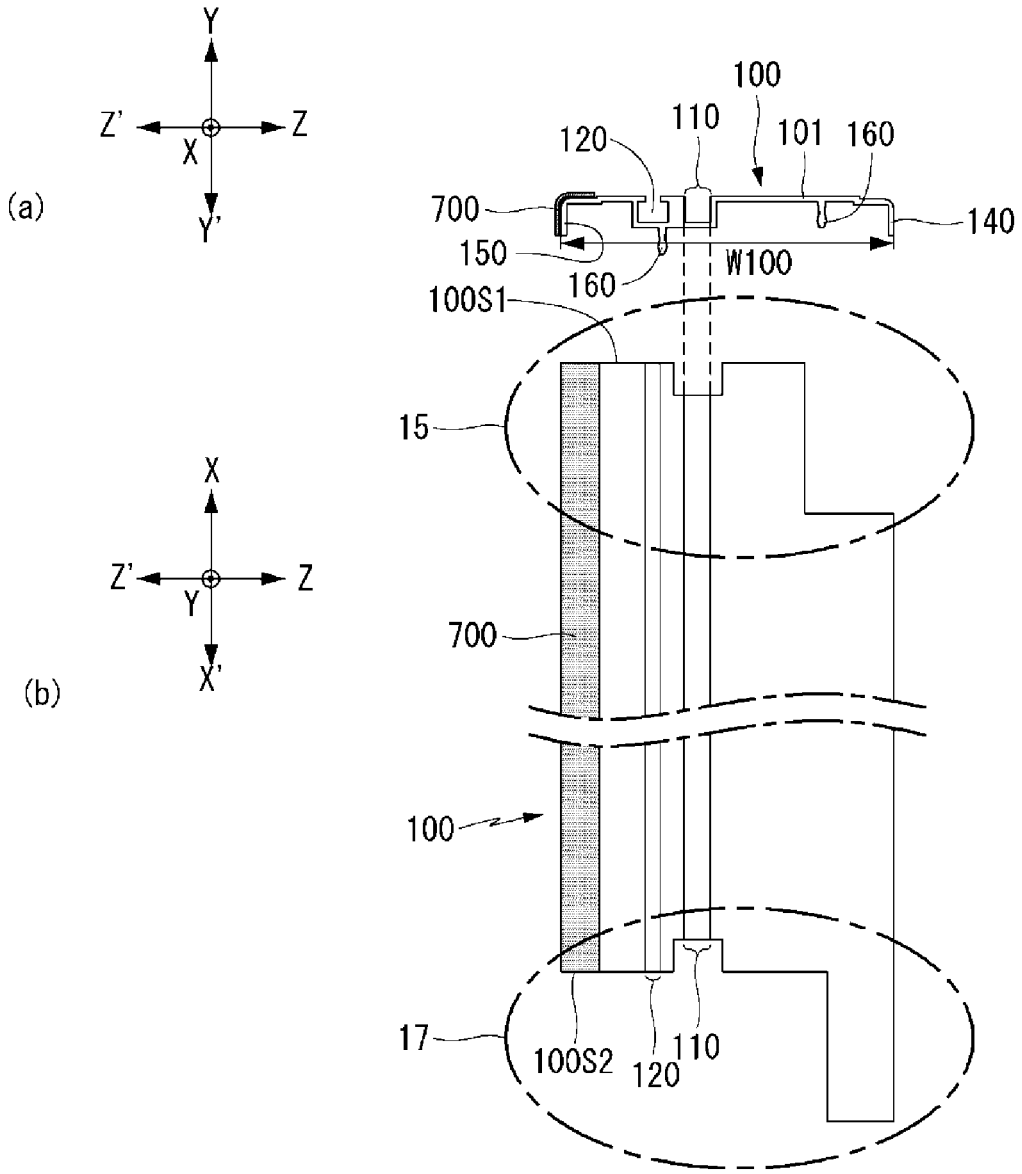

【FIG. 10】
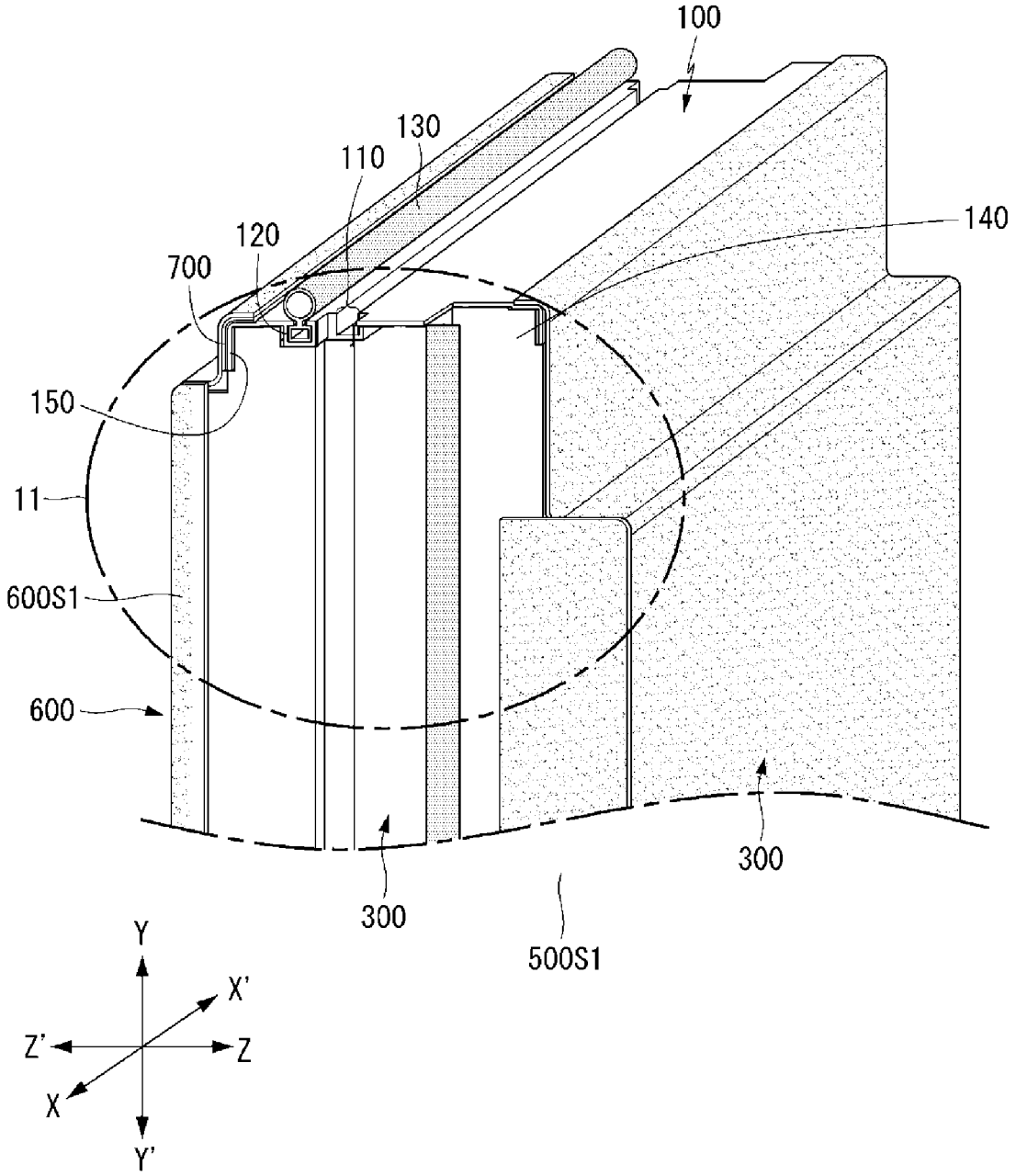

【FIG. 11】
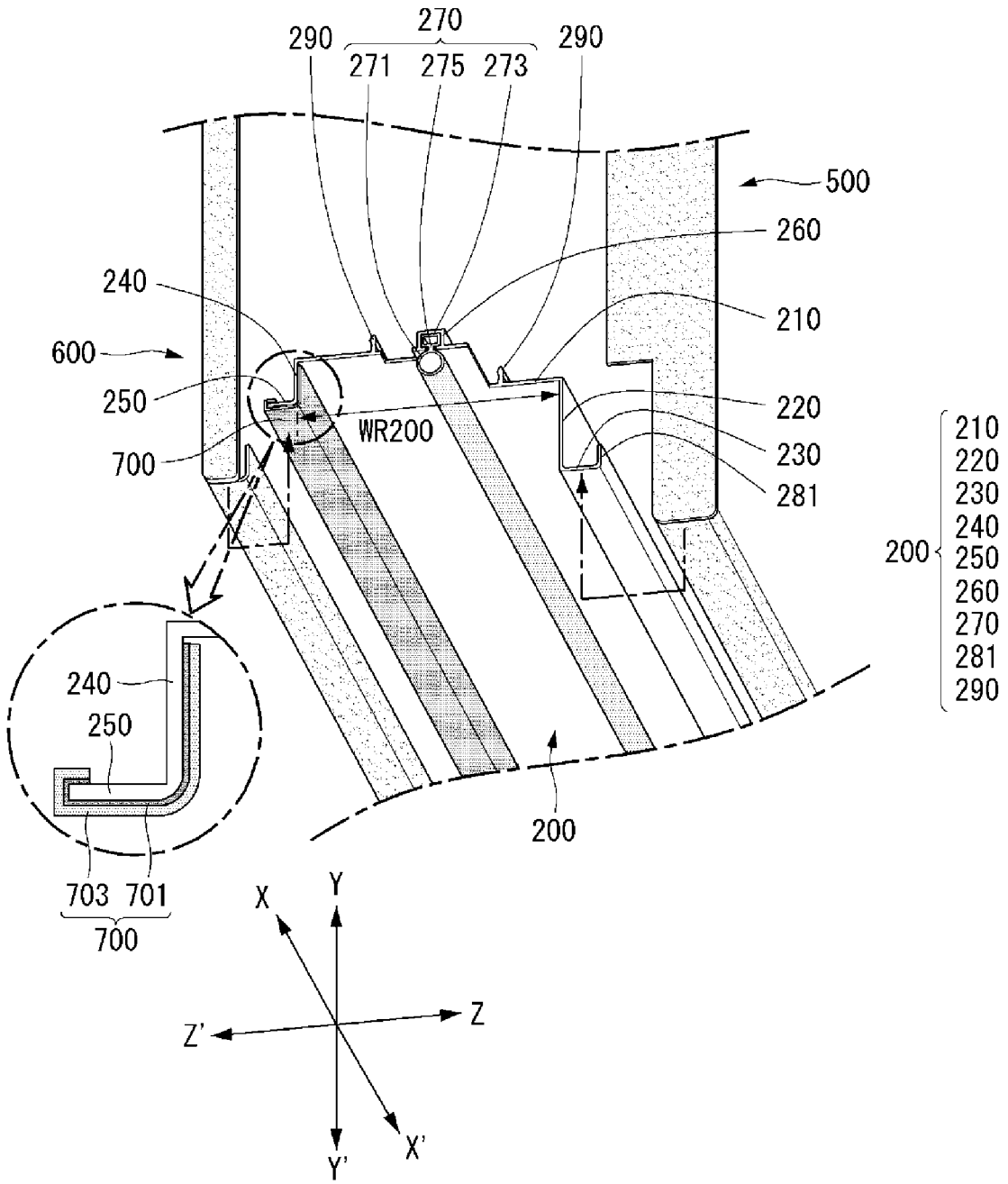

【FIG. 12】
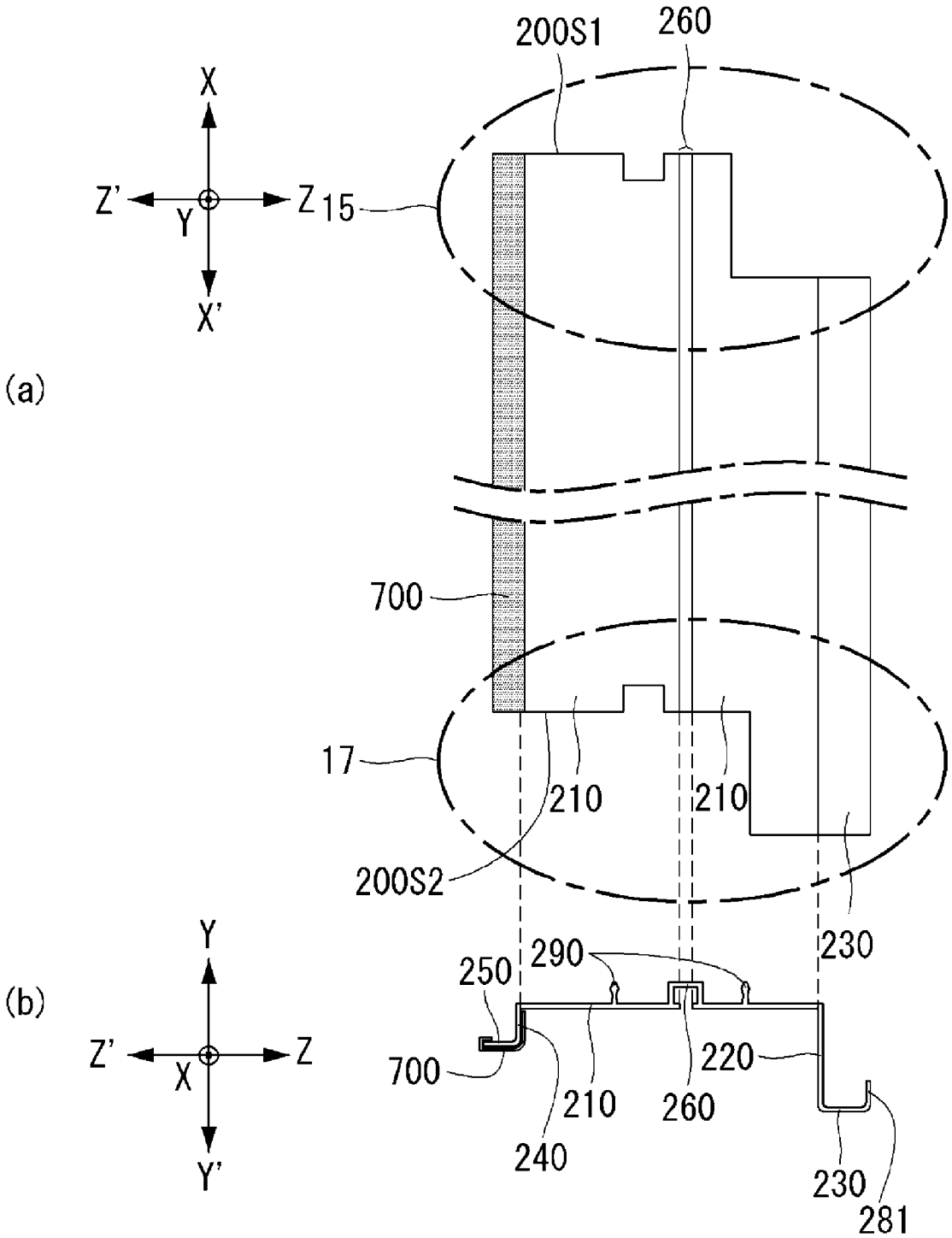

【FIG. 13】
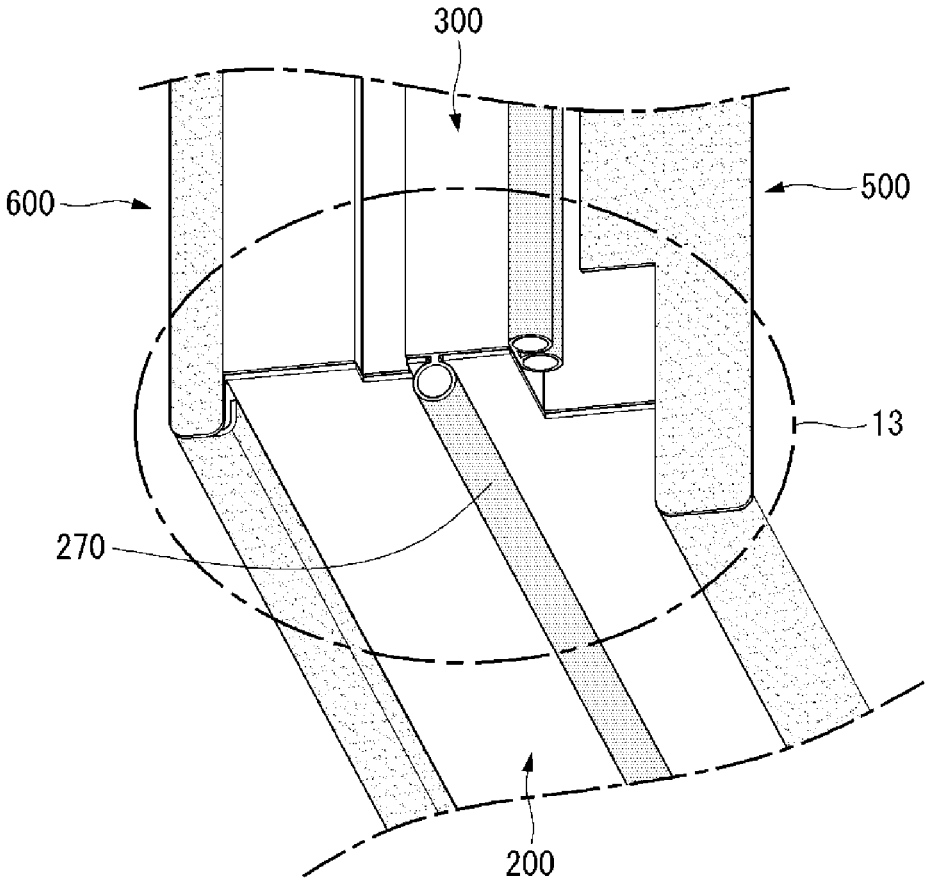

【FIG. 14】
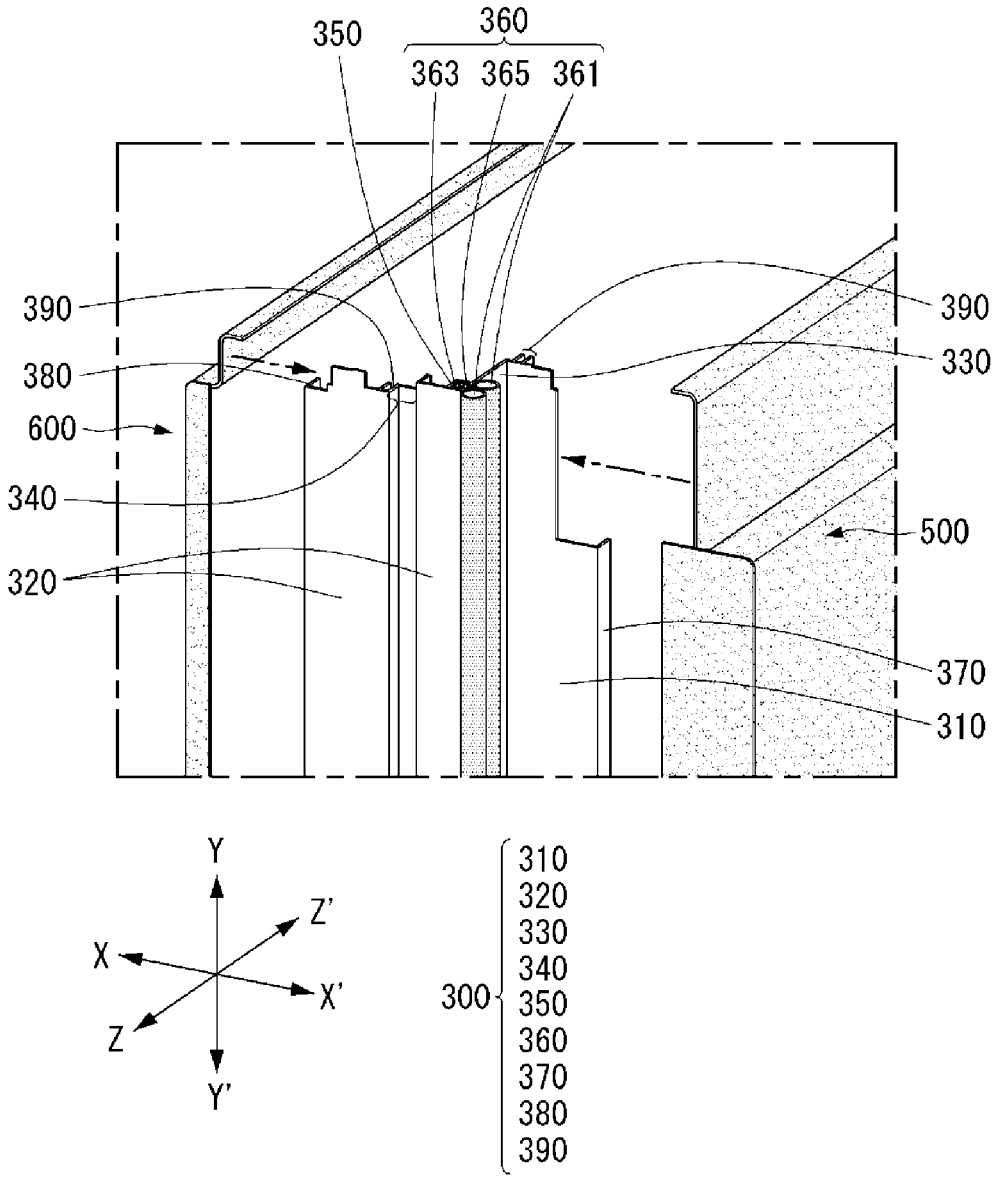

【FIG. 15】
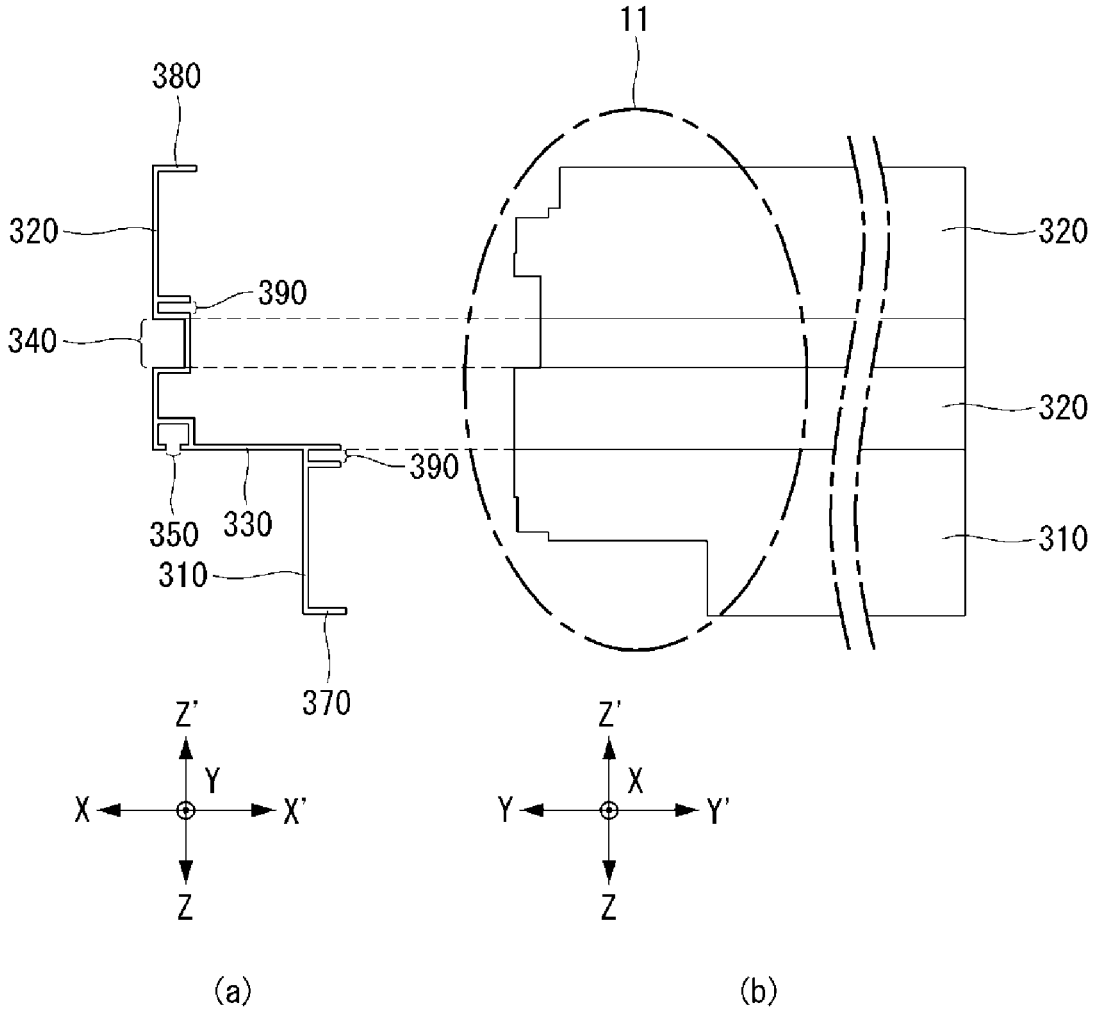

【FIG. 16】
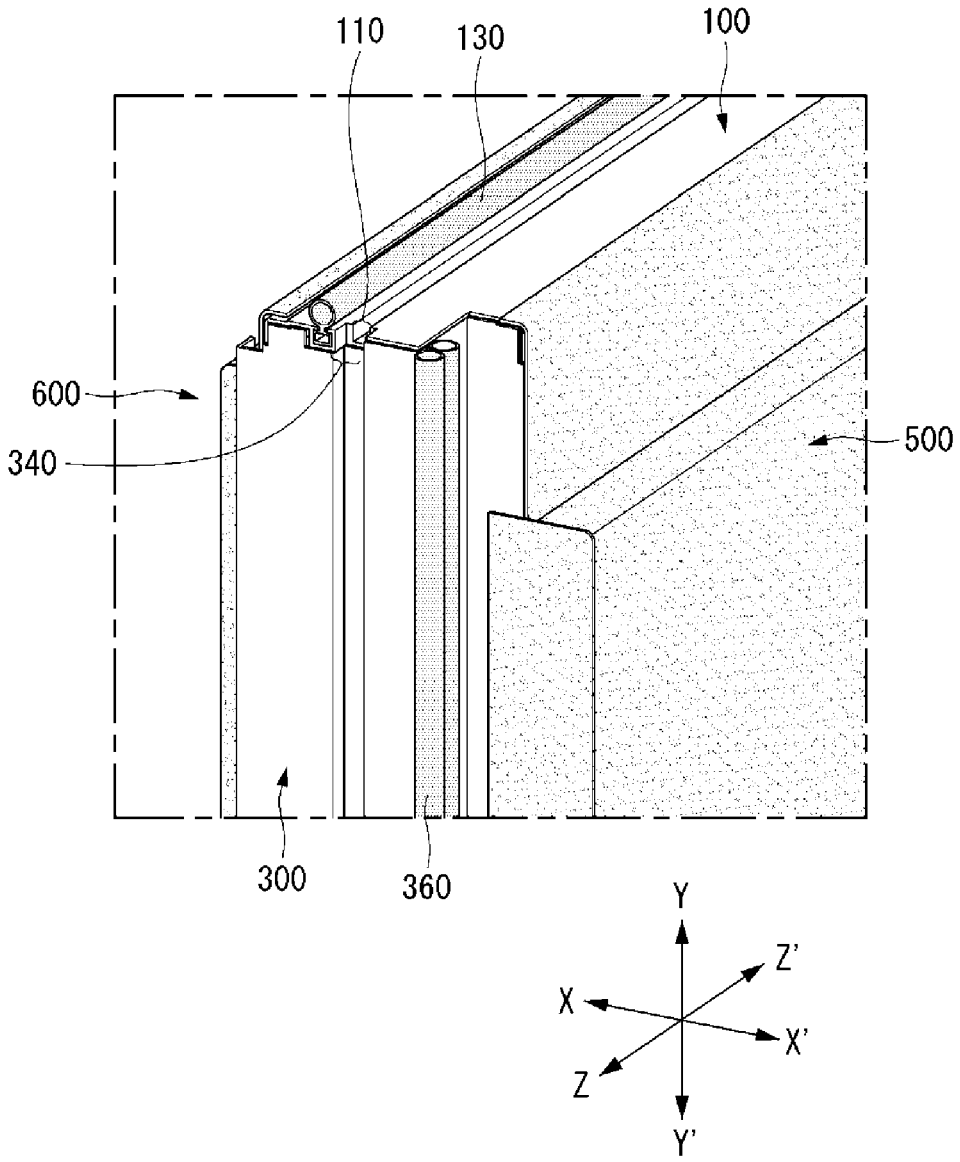

【FIG. 17】
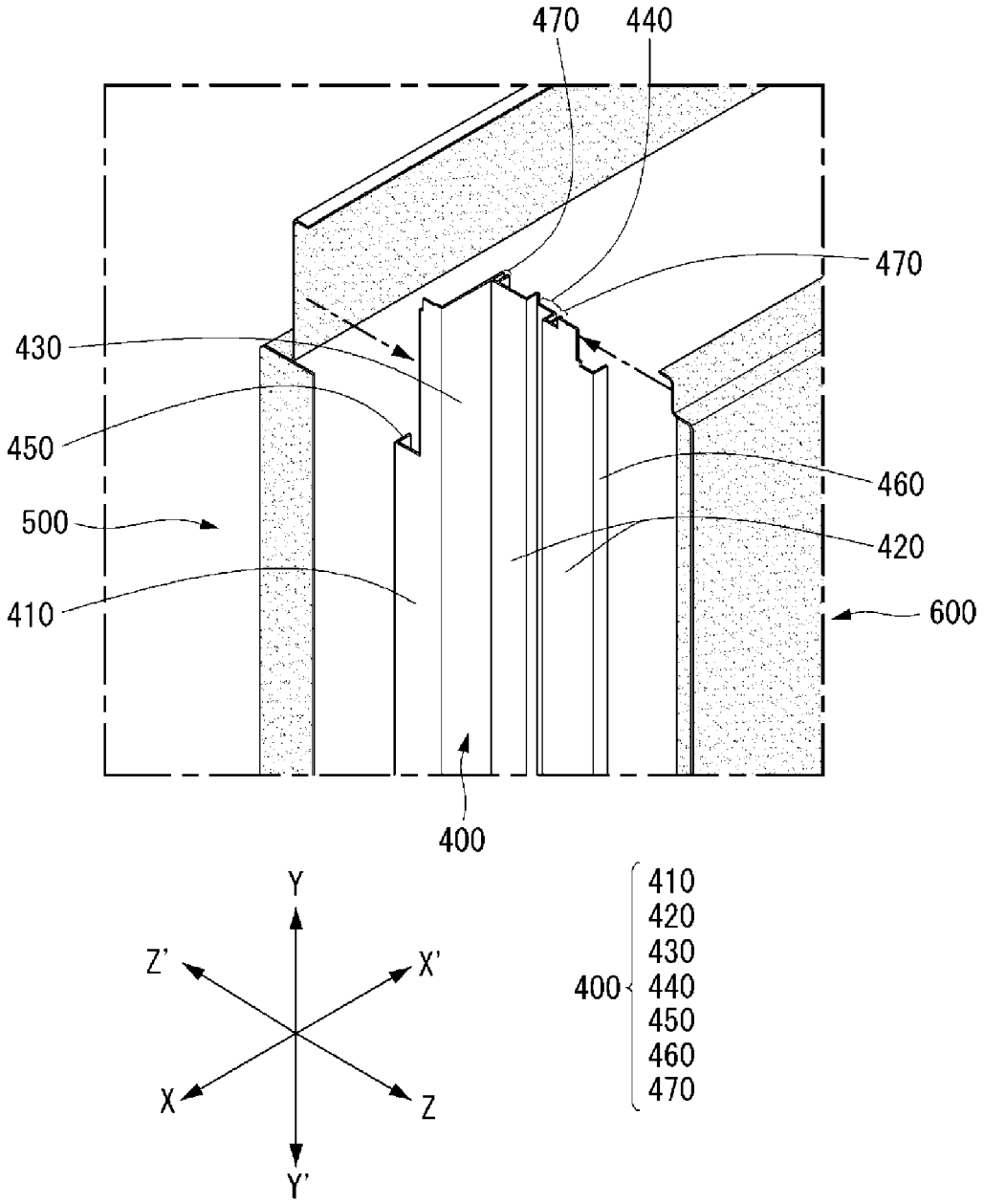

【FIG. 18】
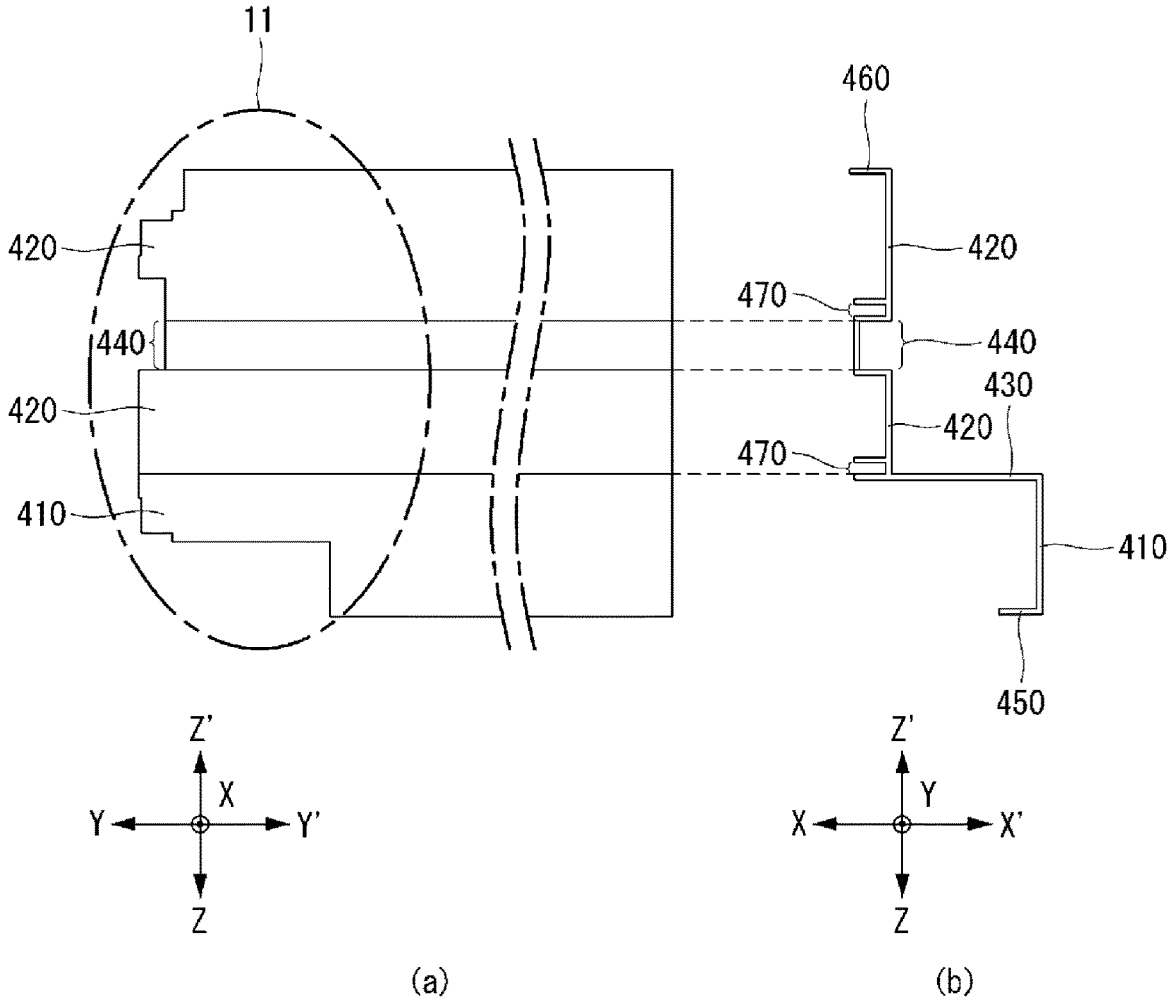

【FIG. 19】
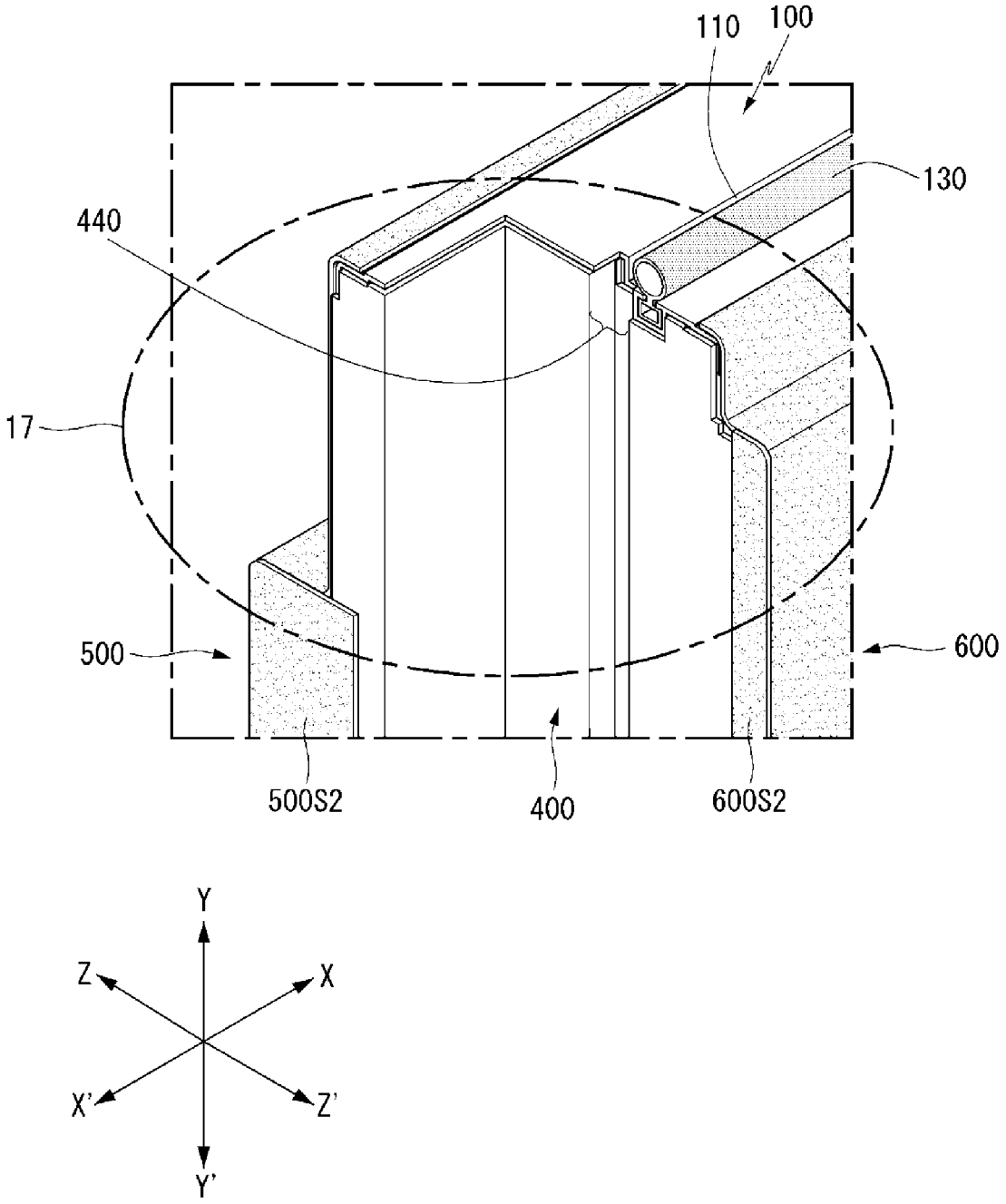

【FIG. 20】
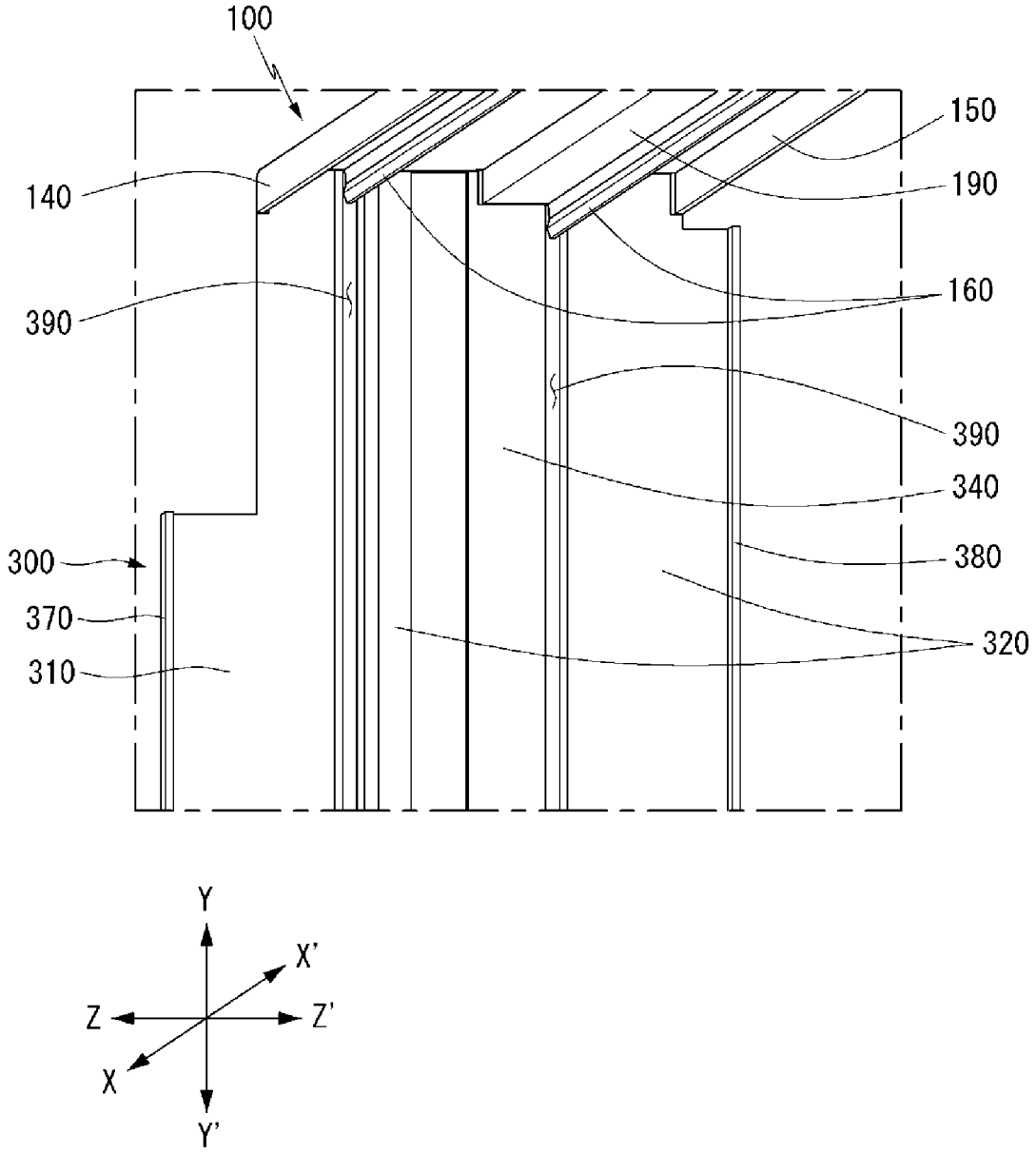

【FIG. 21】
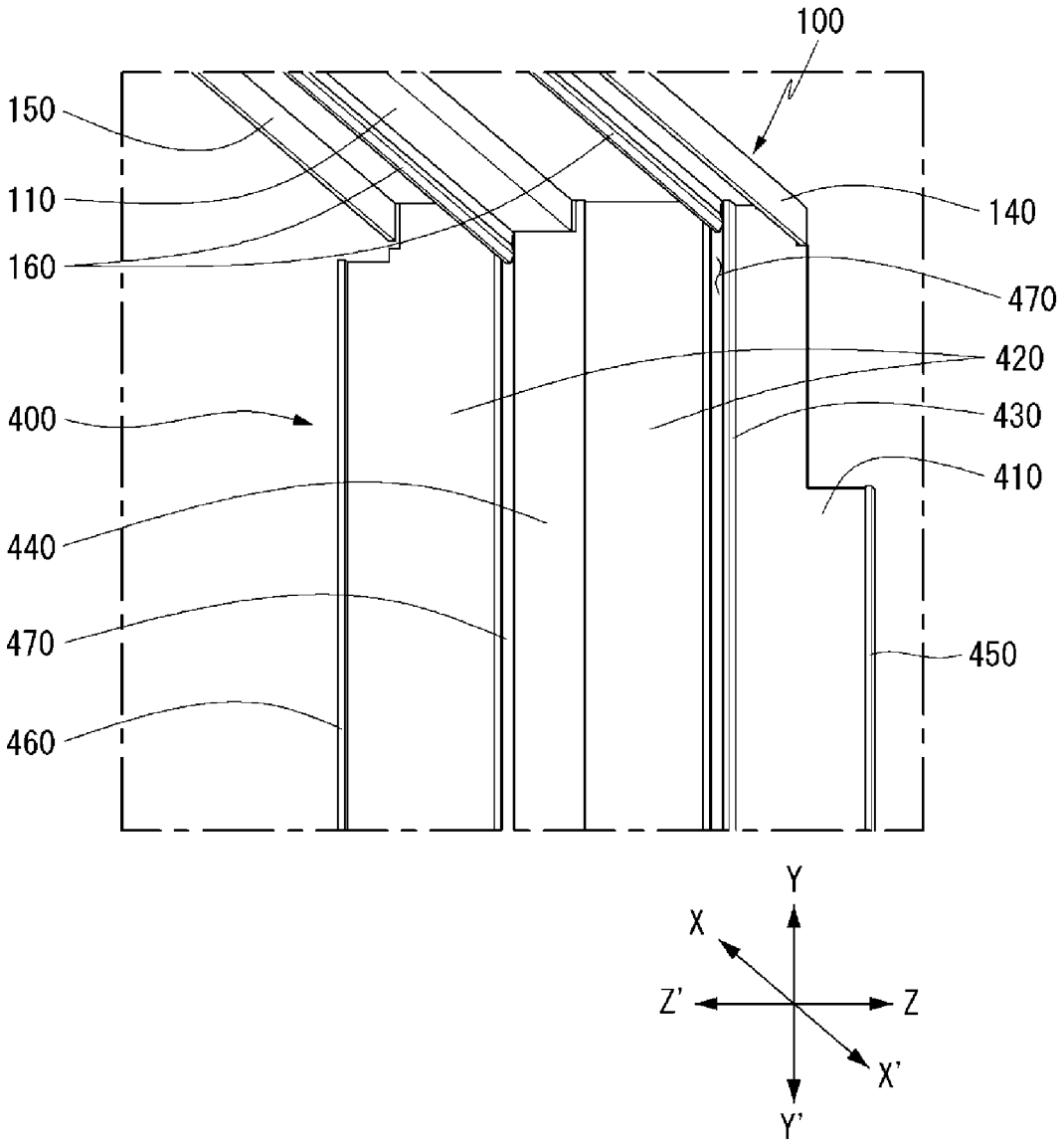

【FIG. 22】
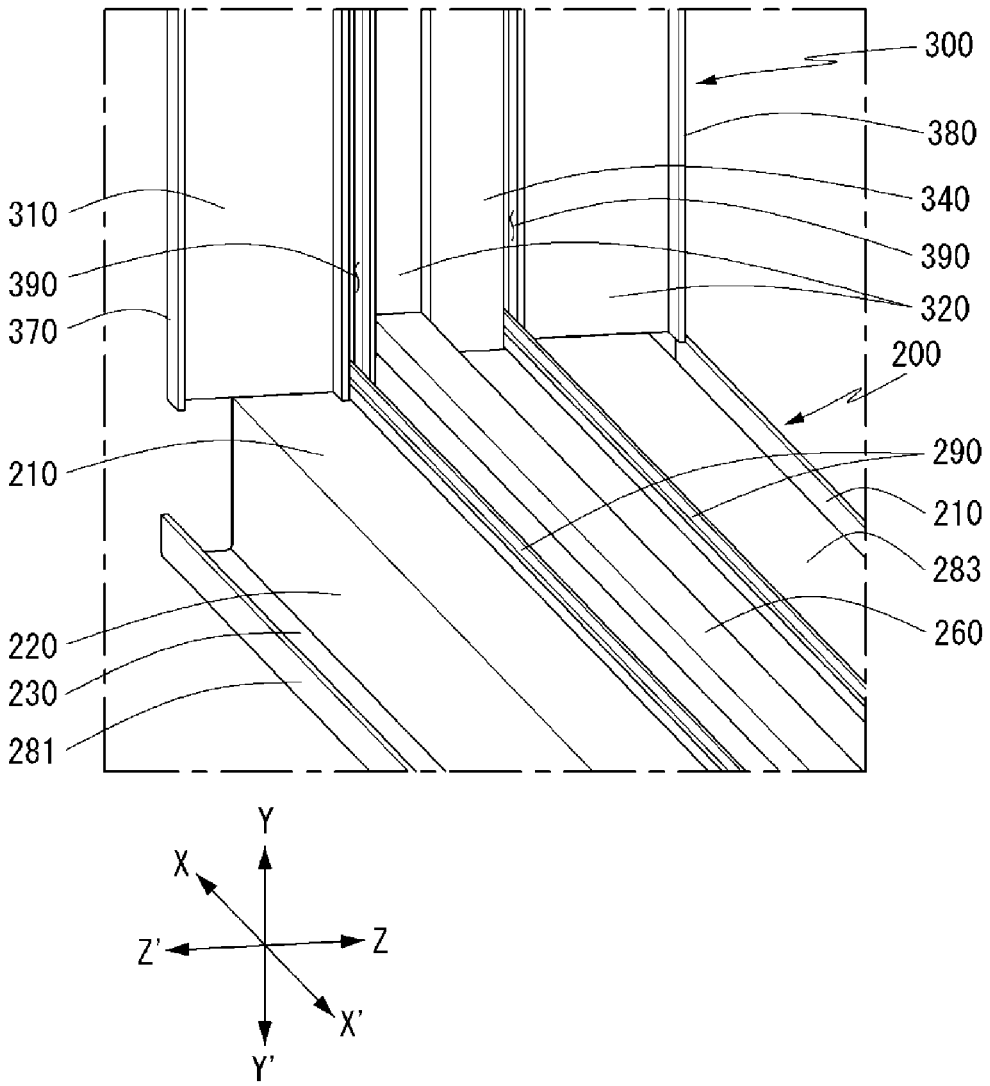

【FIG. 23】
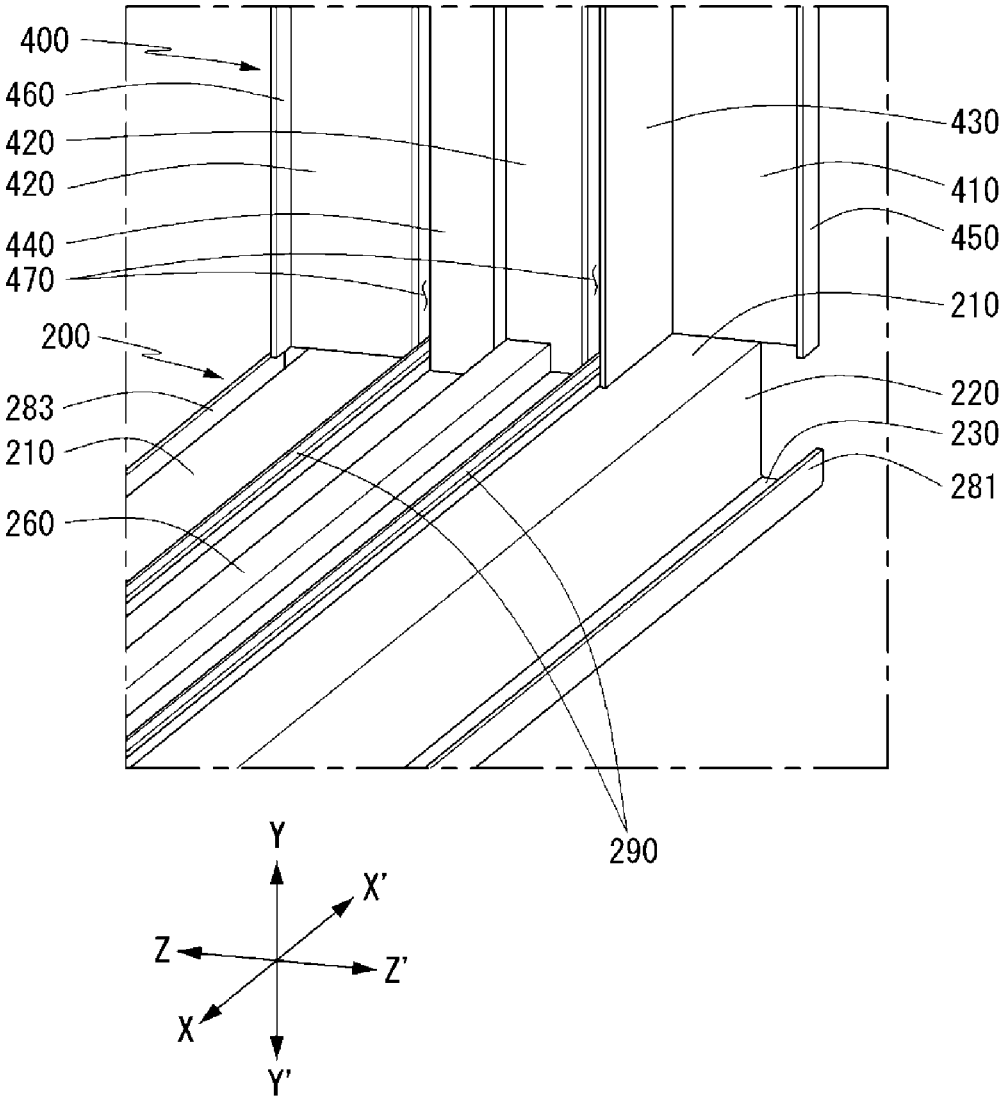

【FIG. 24】
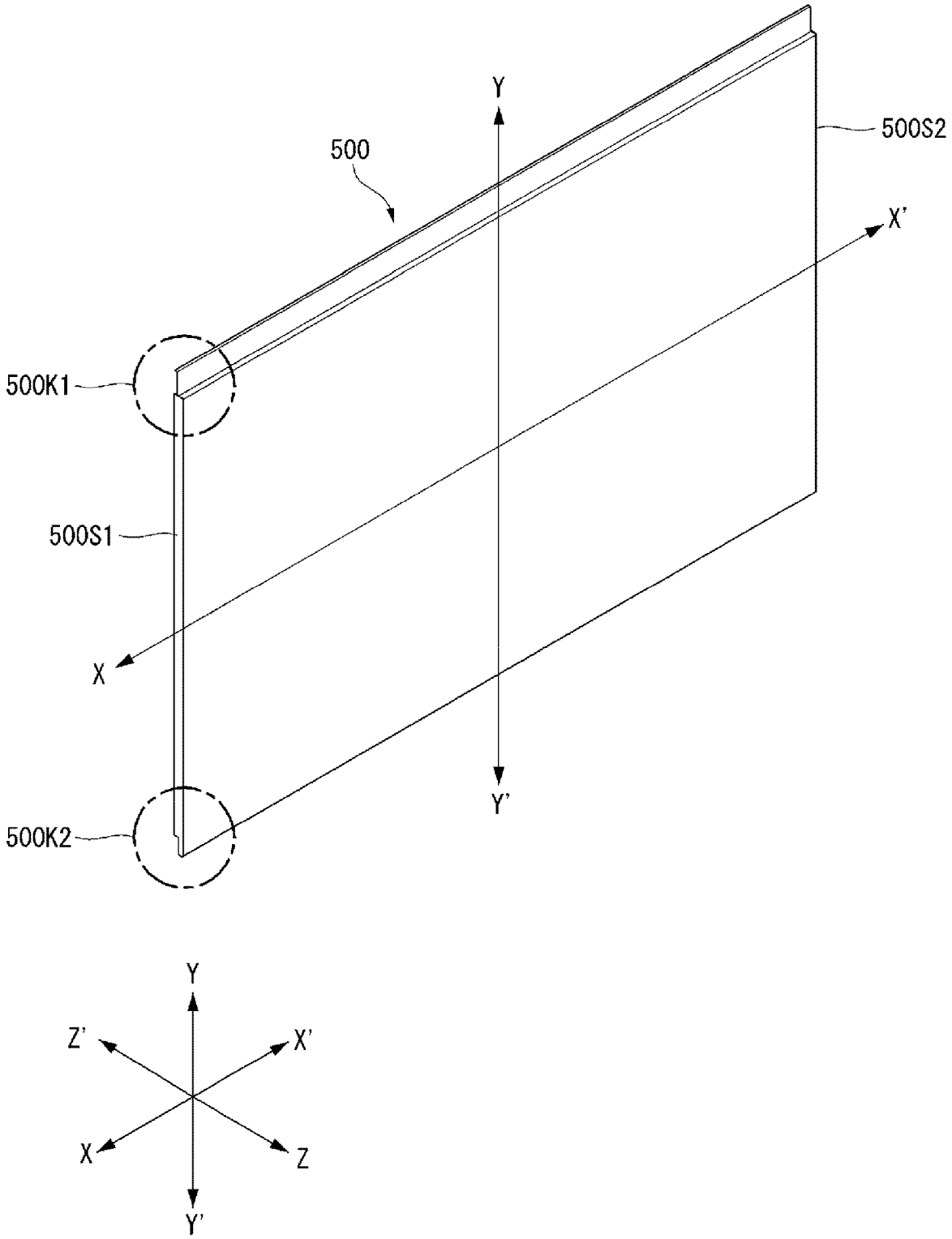

【FIG. 25】
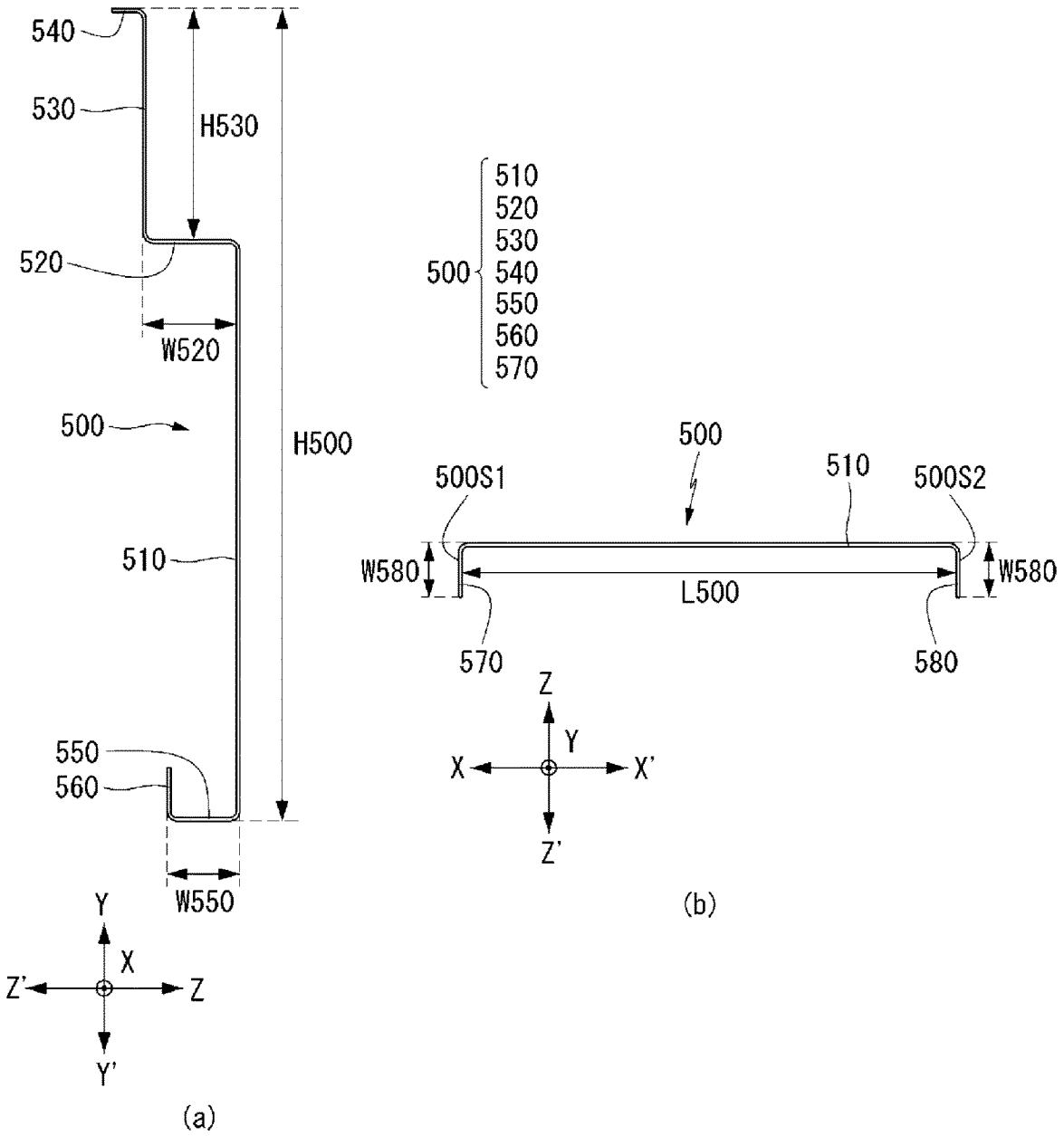

【FIG. 26】
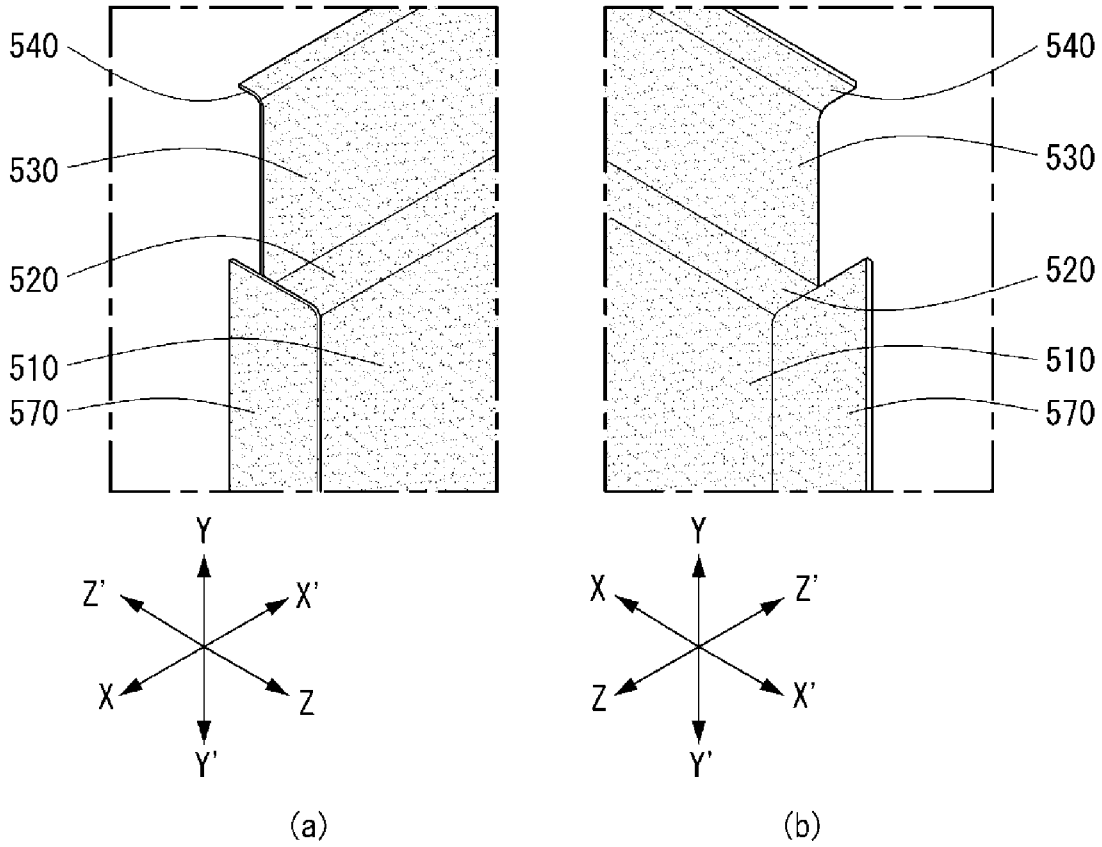

【FIG. 27】
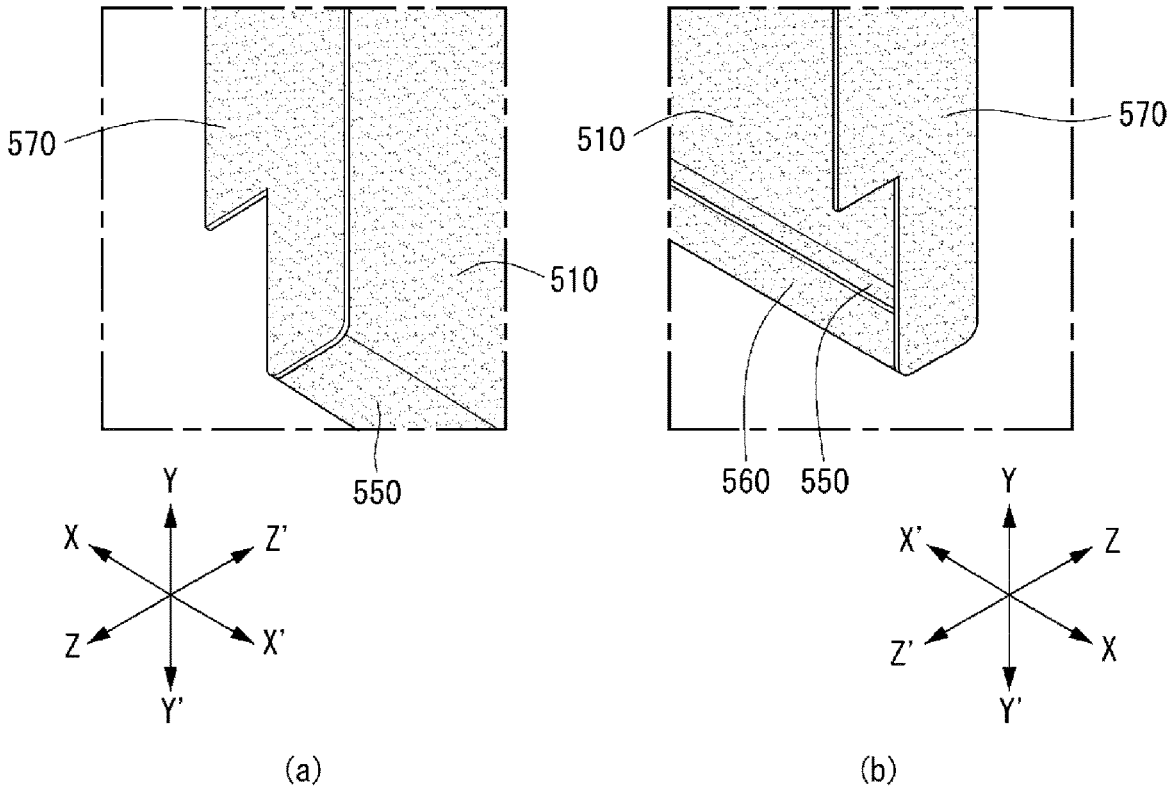

【FIG. 28】
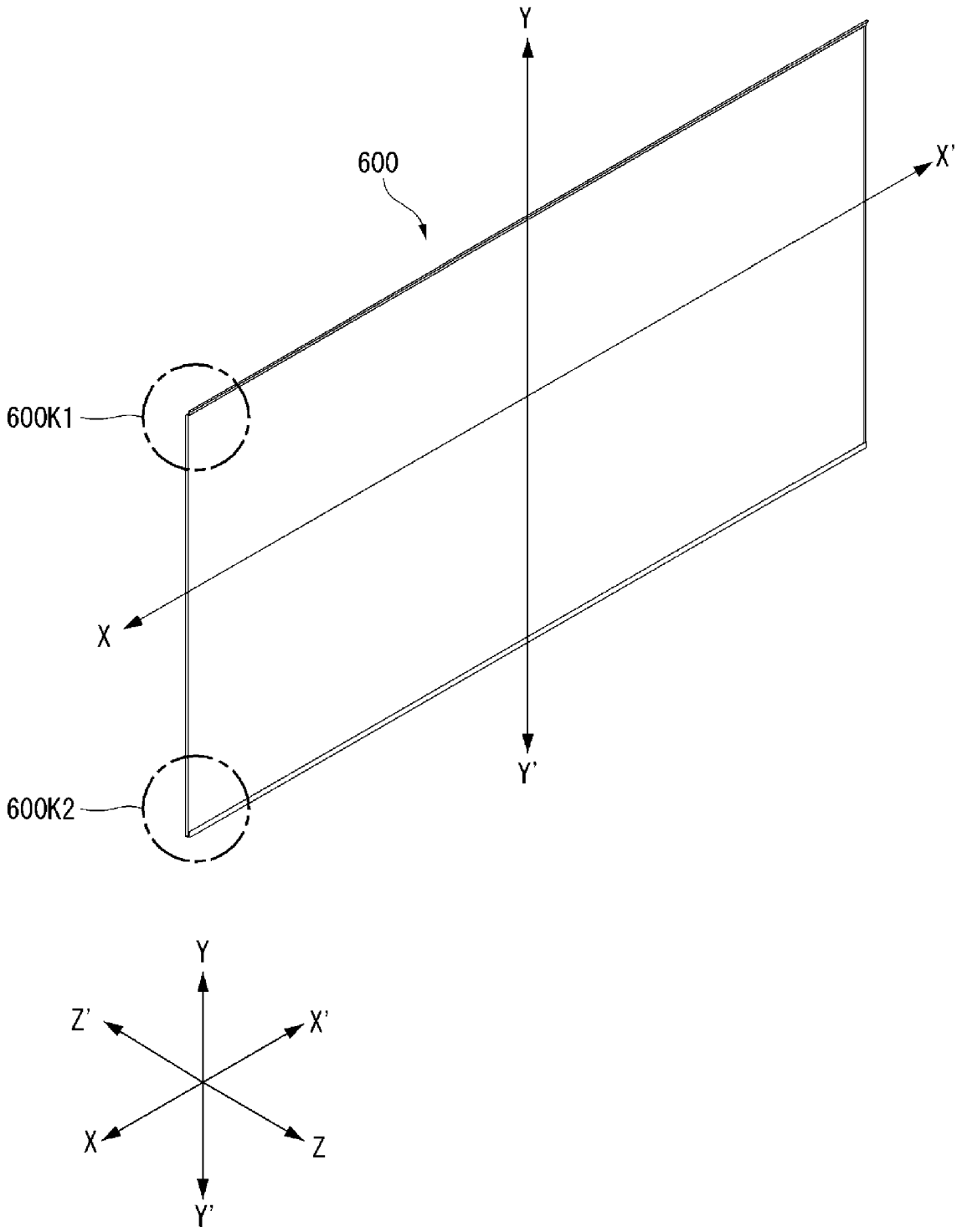

【FIG. 29】
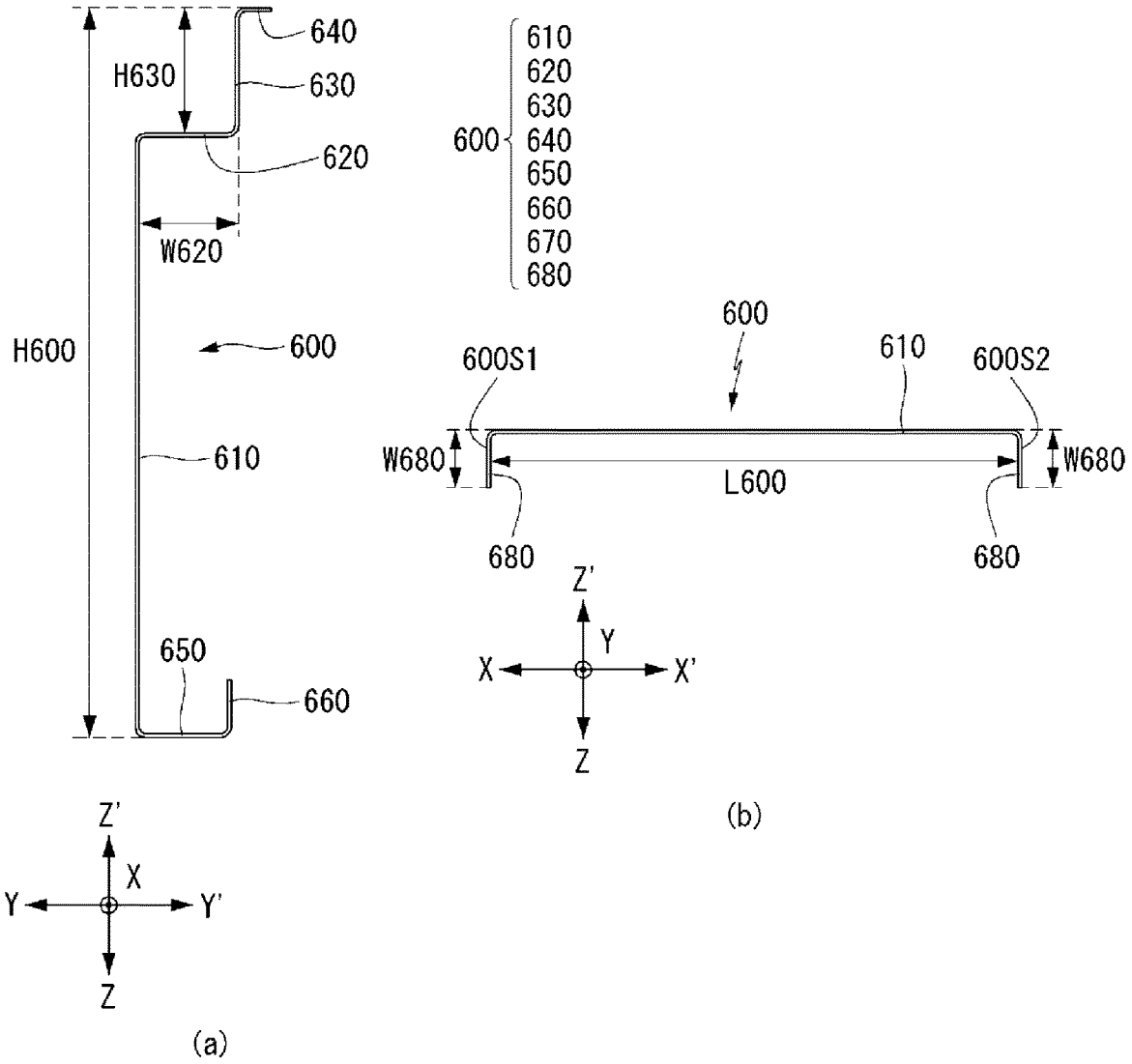

【FIG. 30】
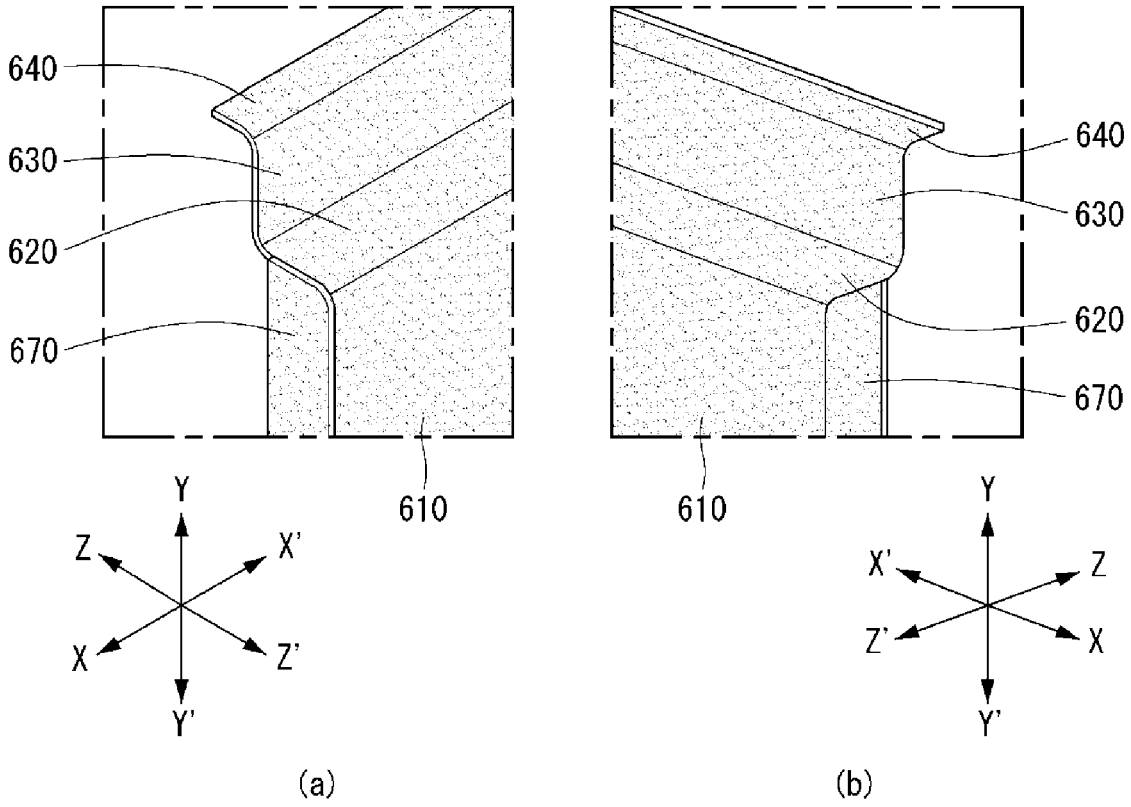

【FIG. 31】
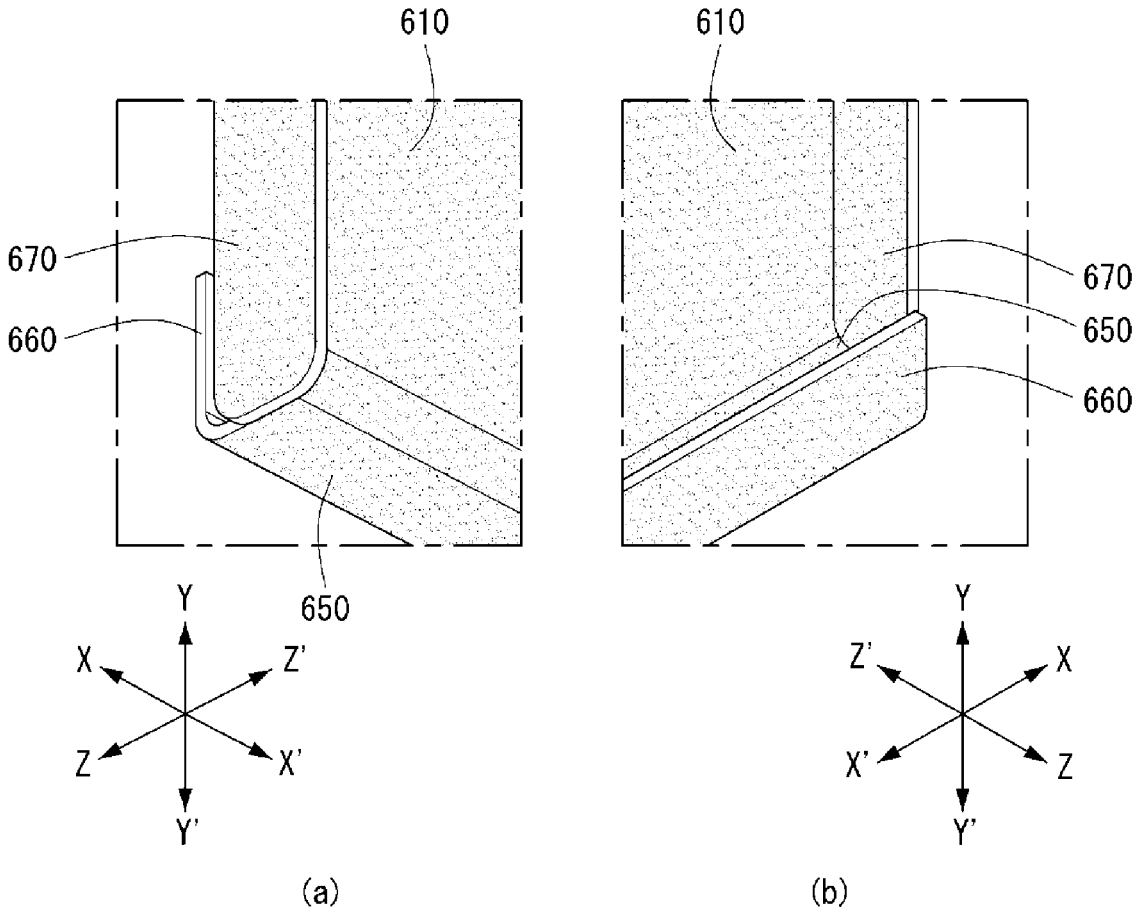

【FIG. 32】
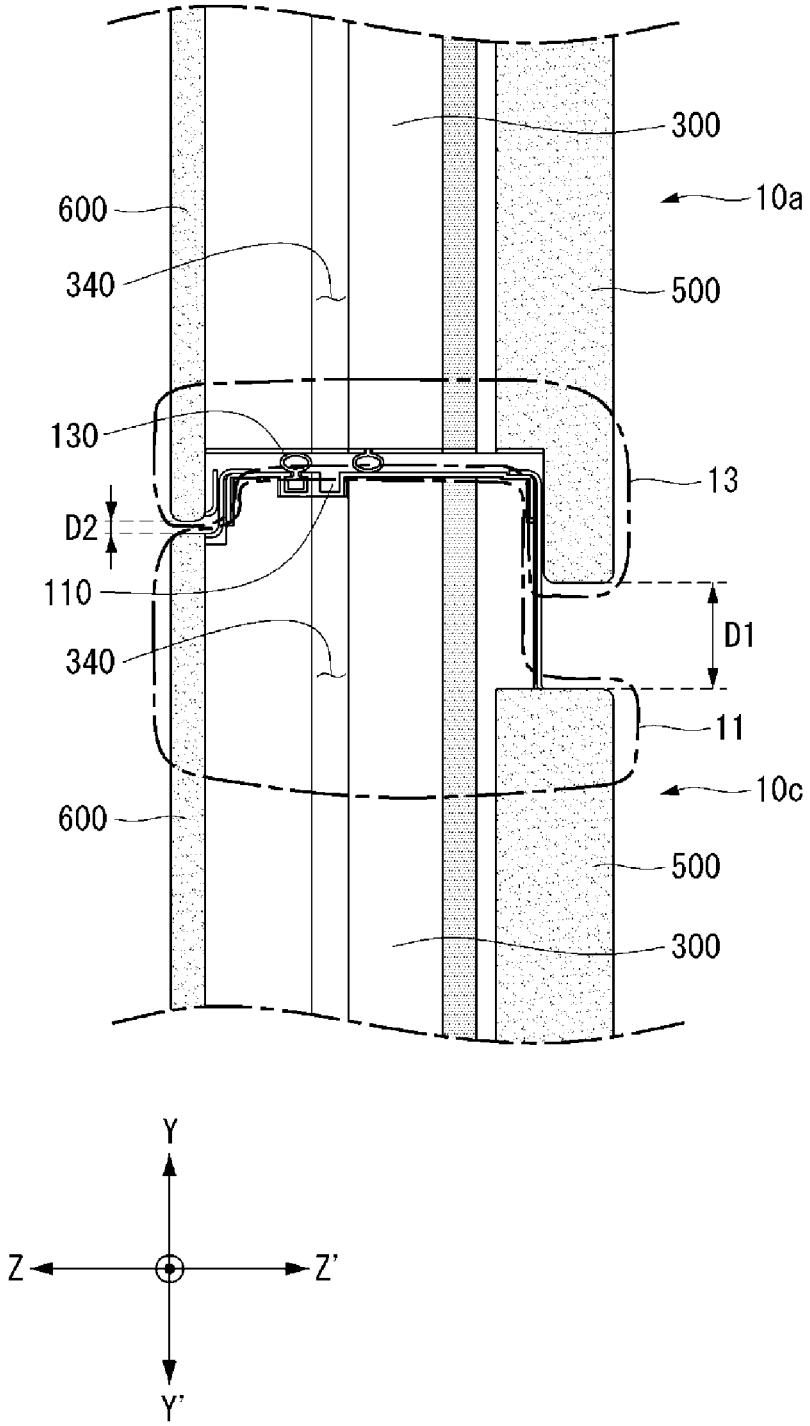

【FIG. 33】
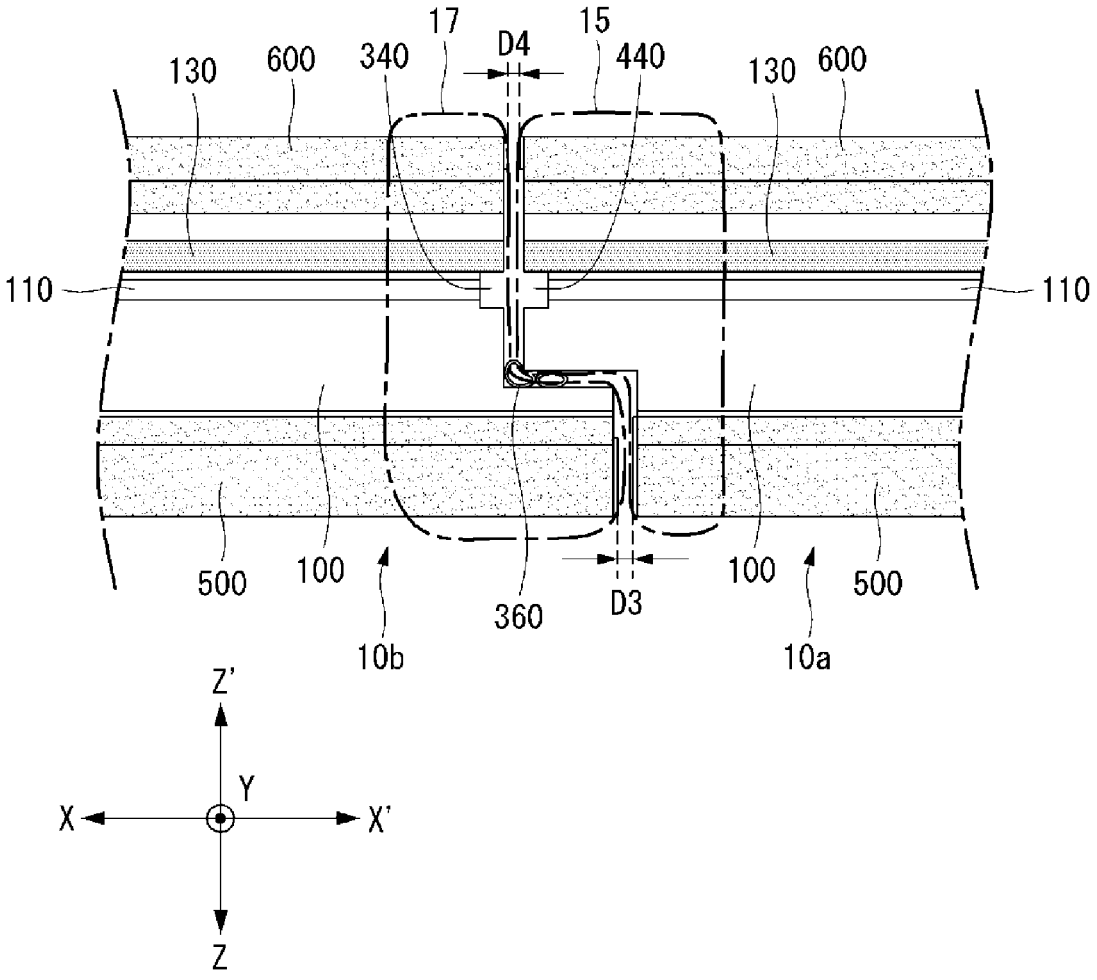

【FIG. 34】
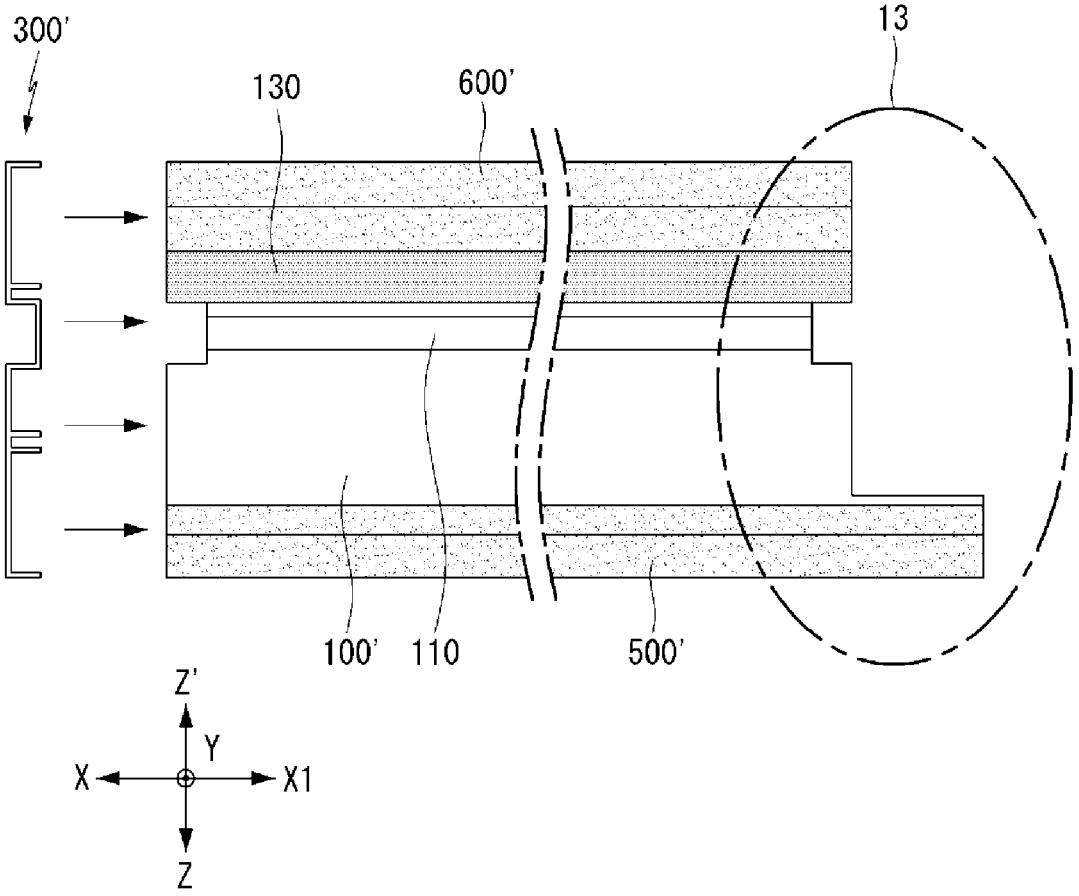

【FIG. 35】
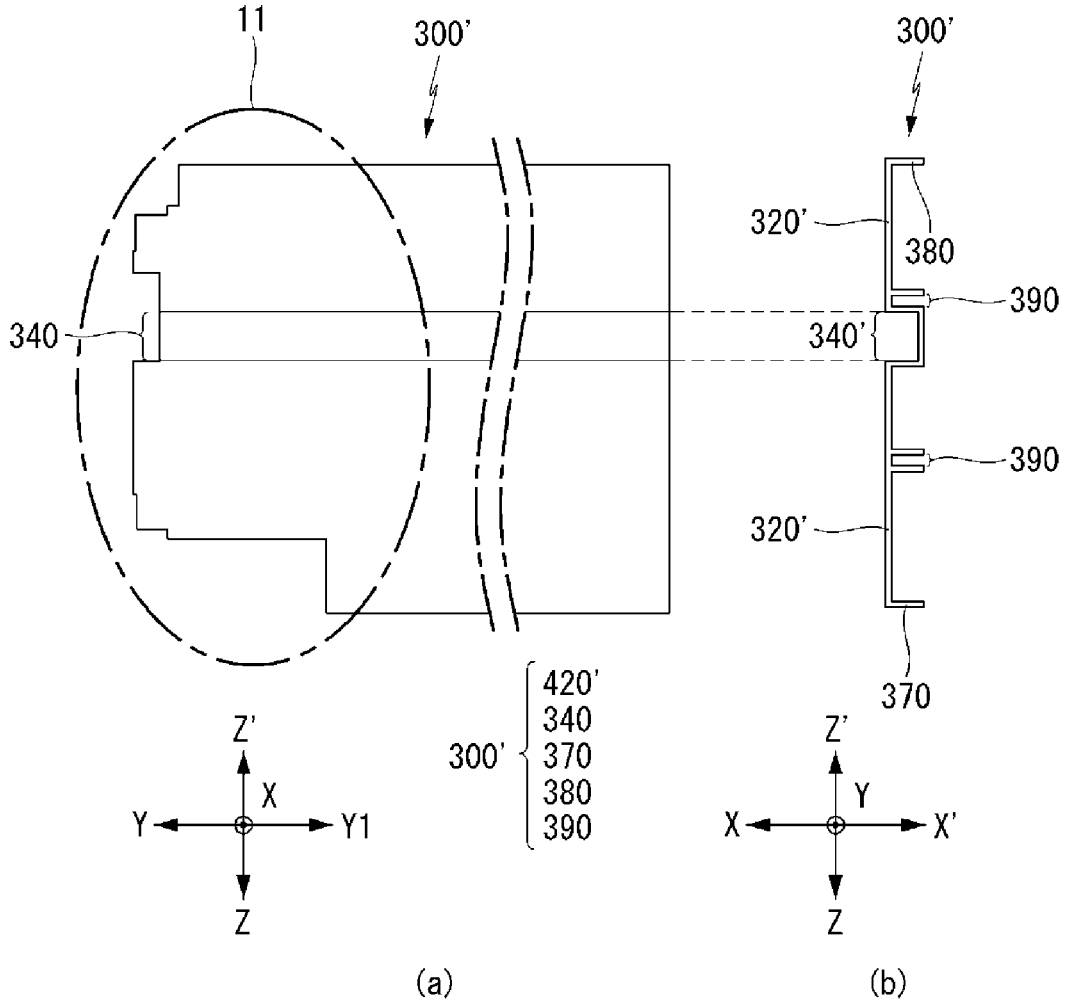

【FIG. 36】
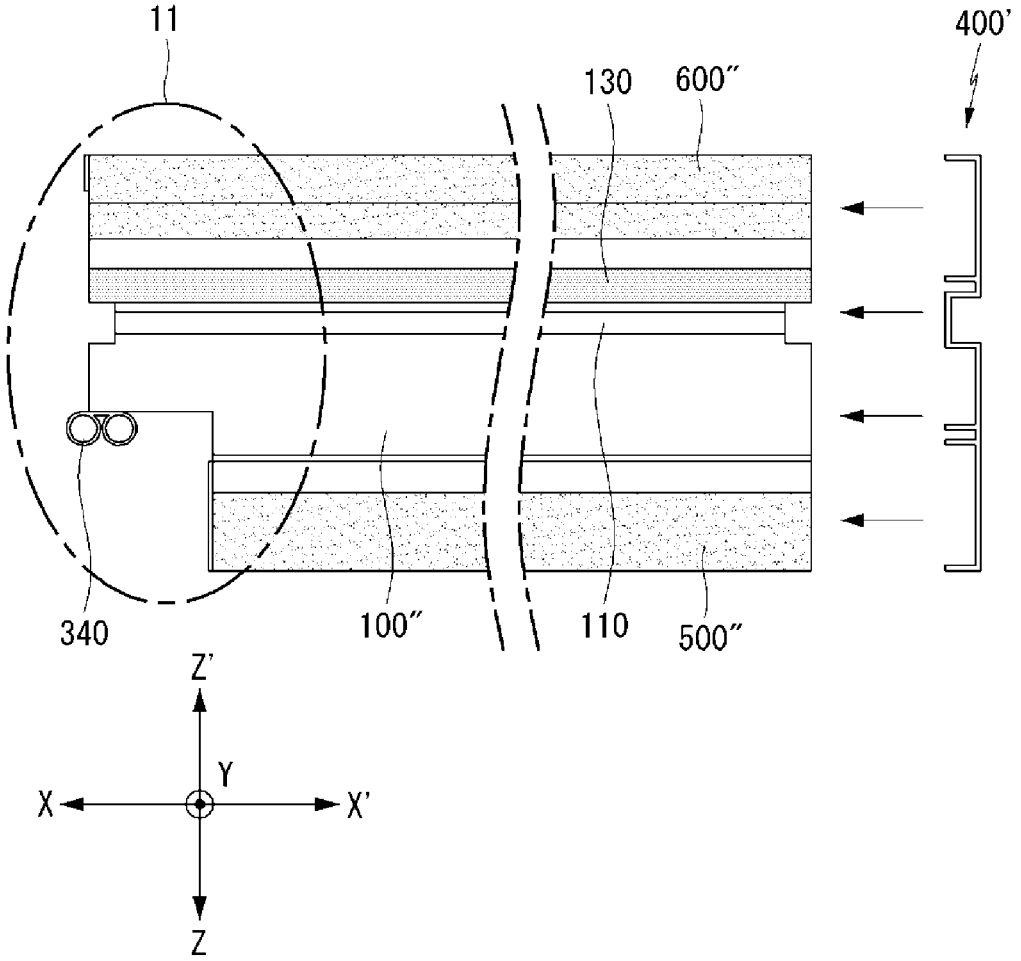

【FIG. 37】
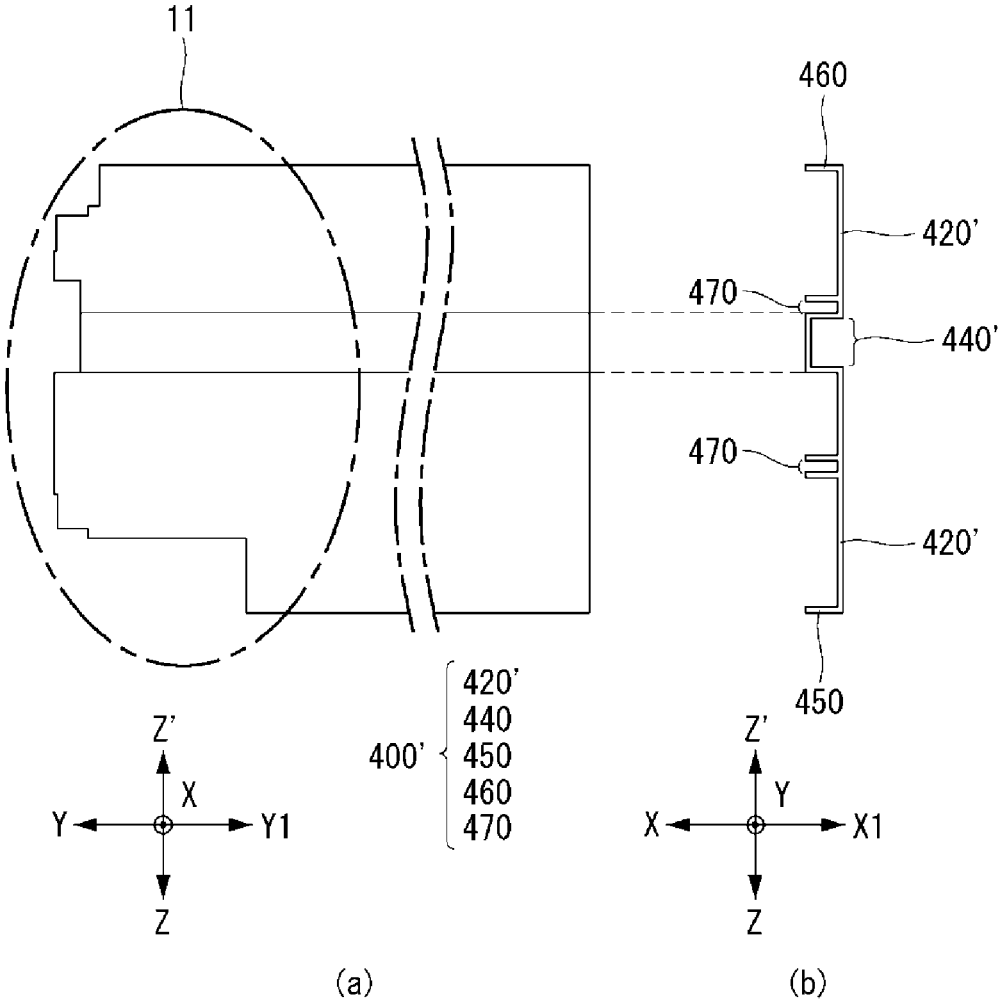

【FIG. 38】
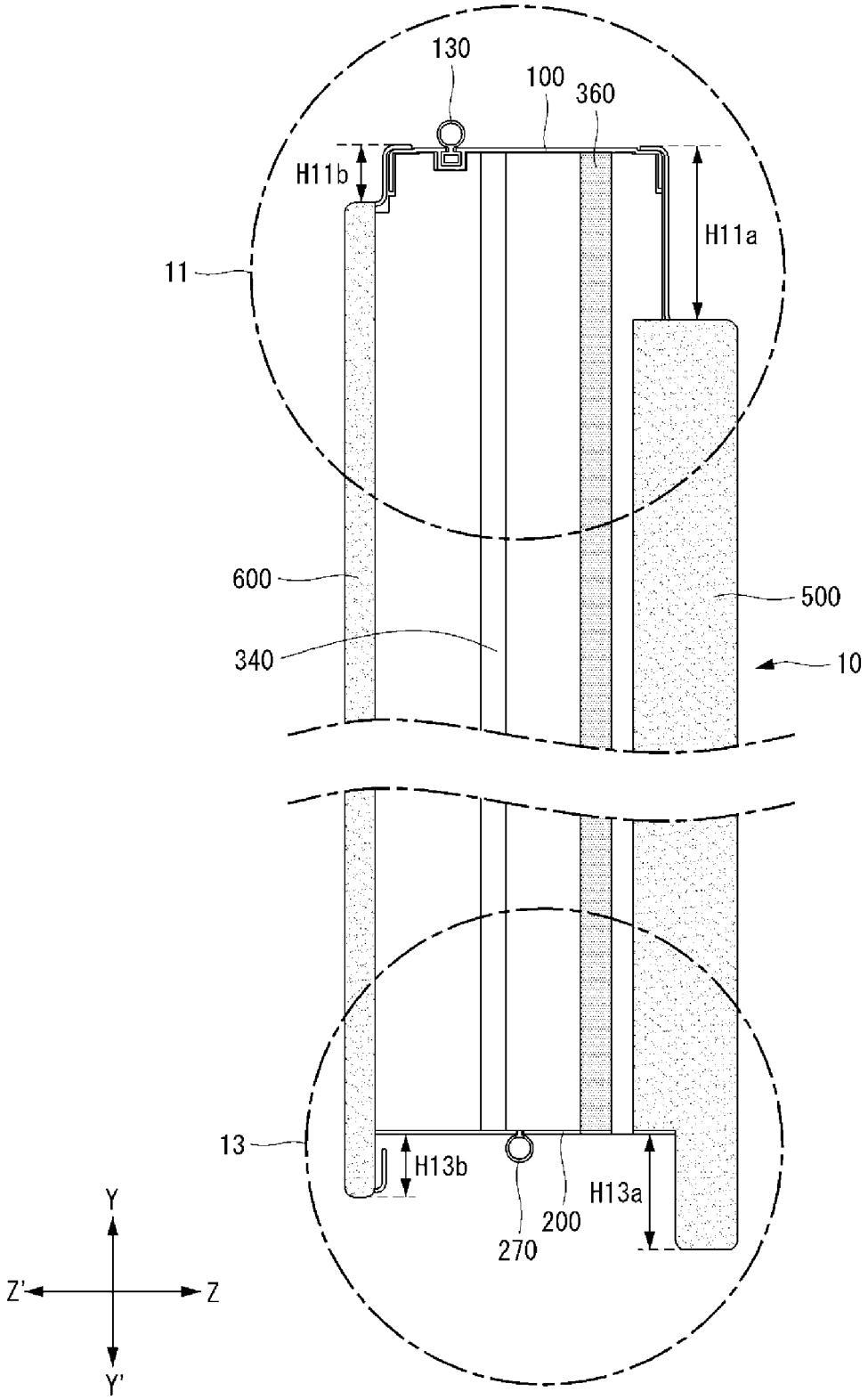

【FIG. 39】
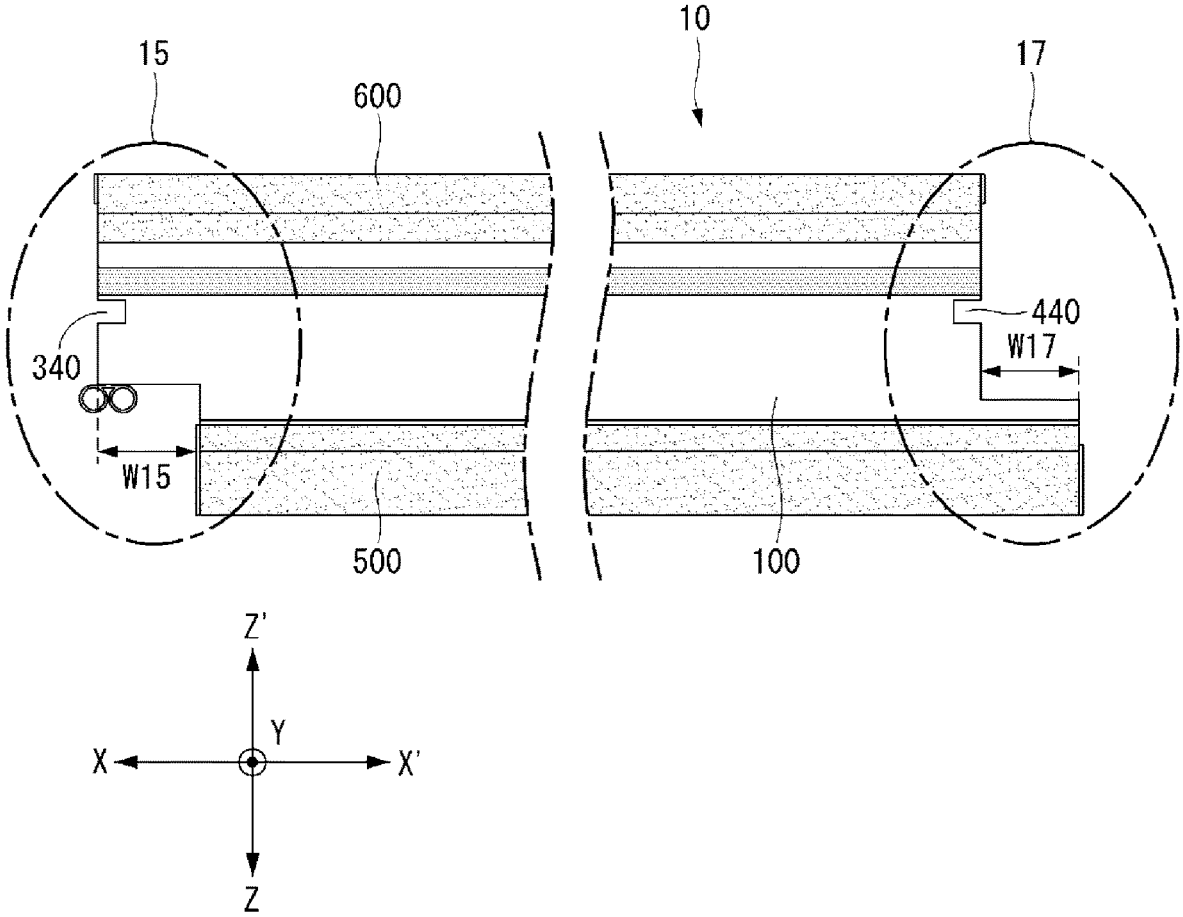

【FIG. 40】
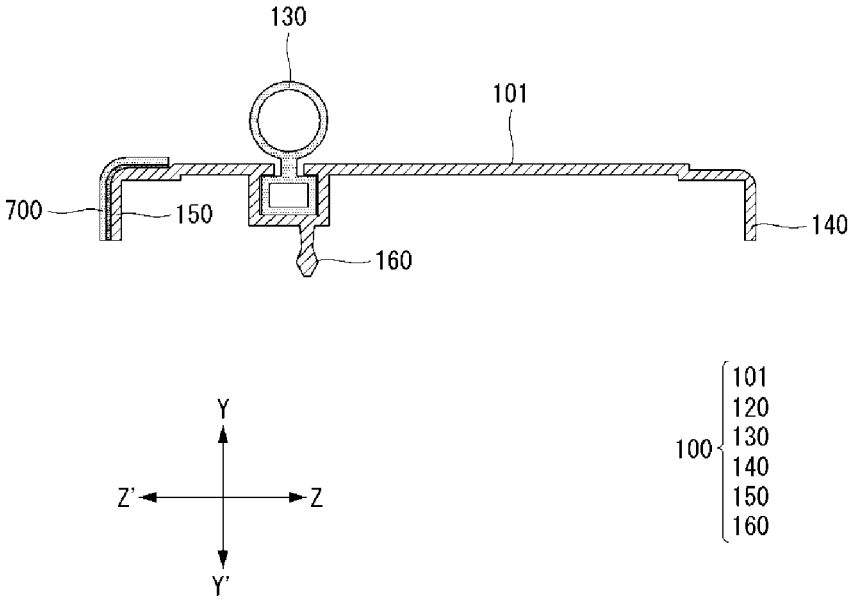

【FIG. 41】
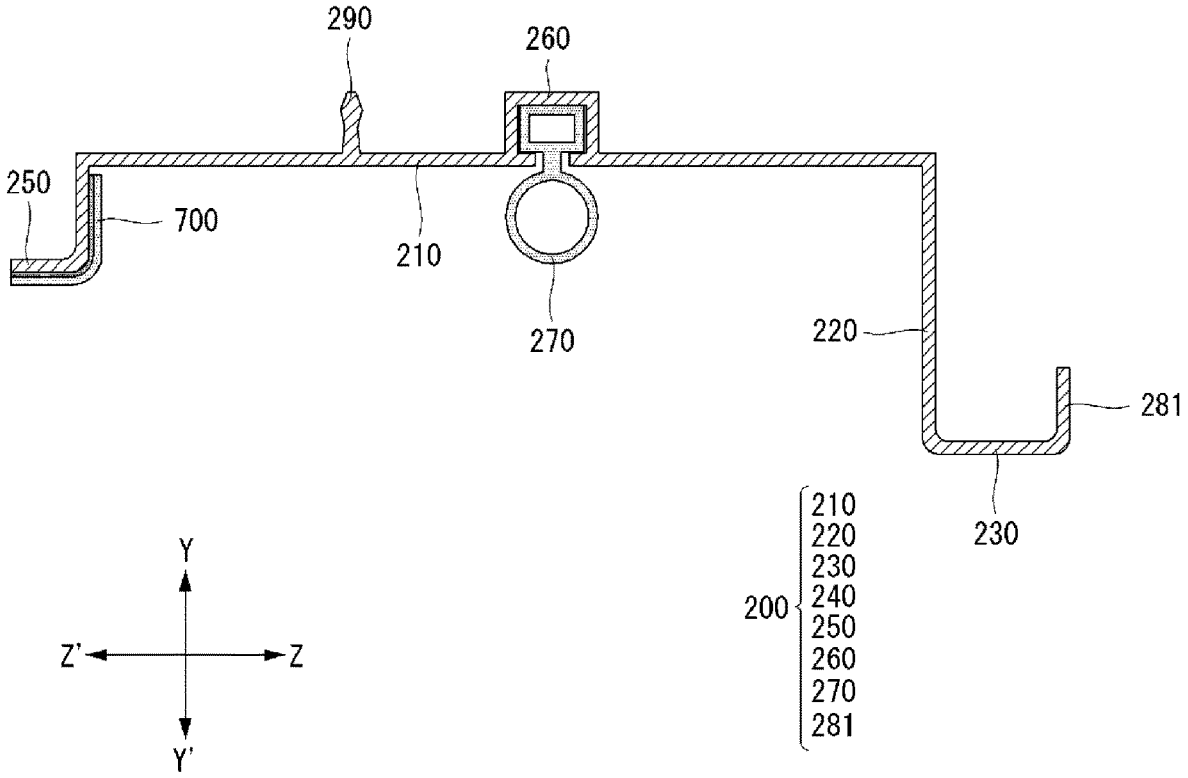

【FIG. 42】
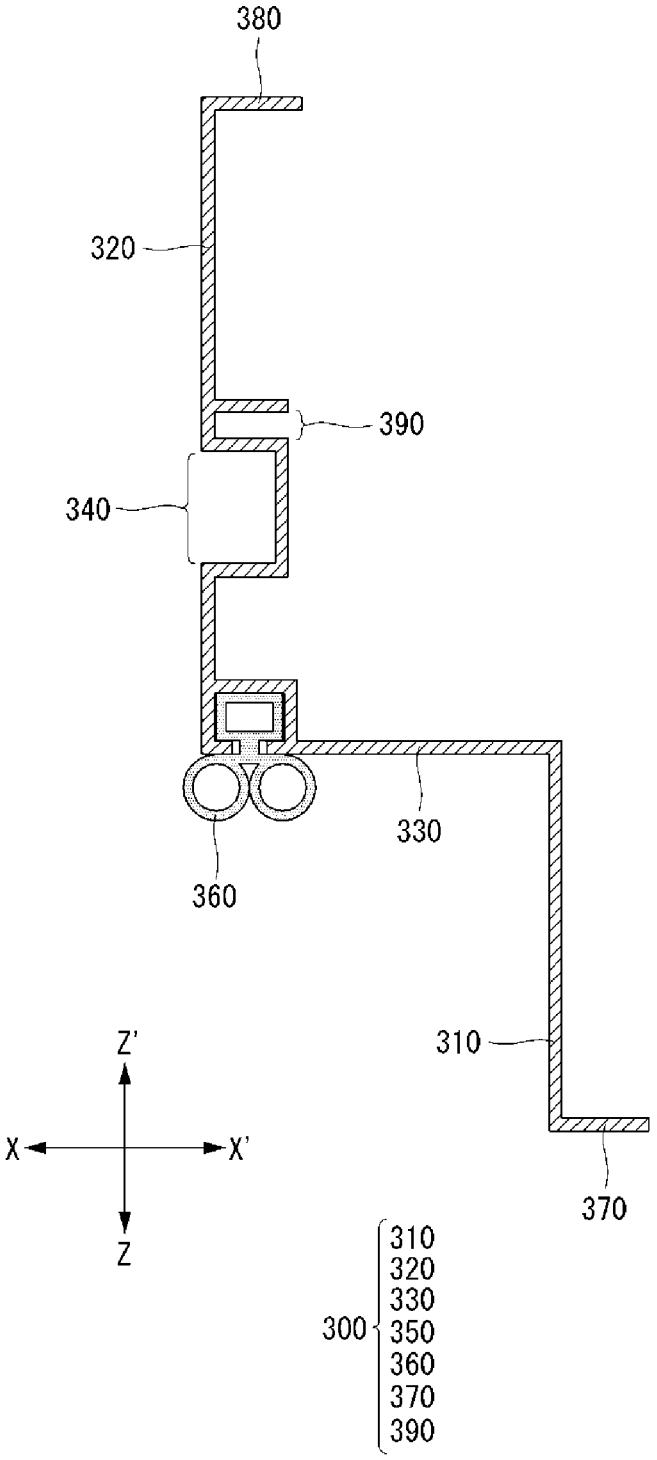

【FIG. 43】
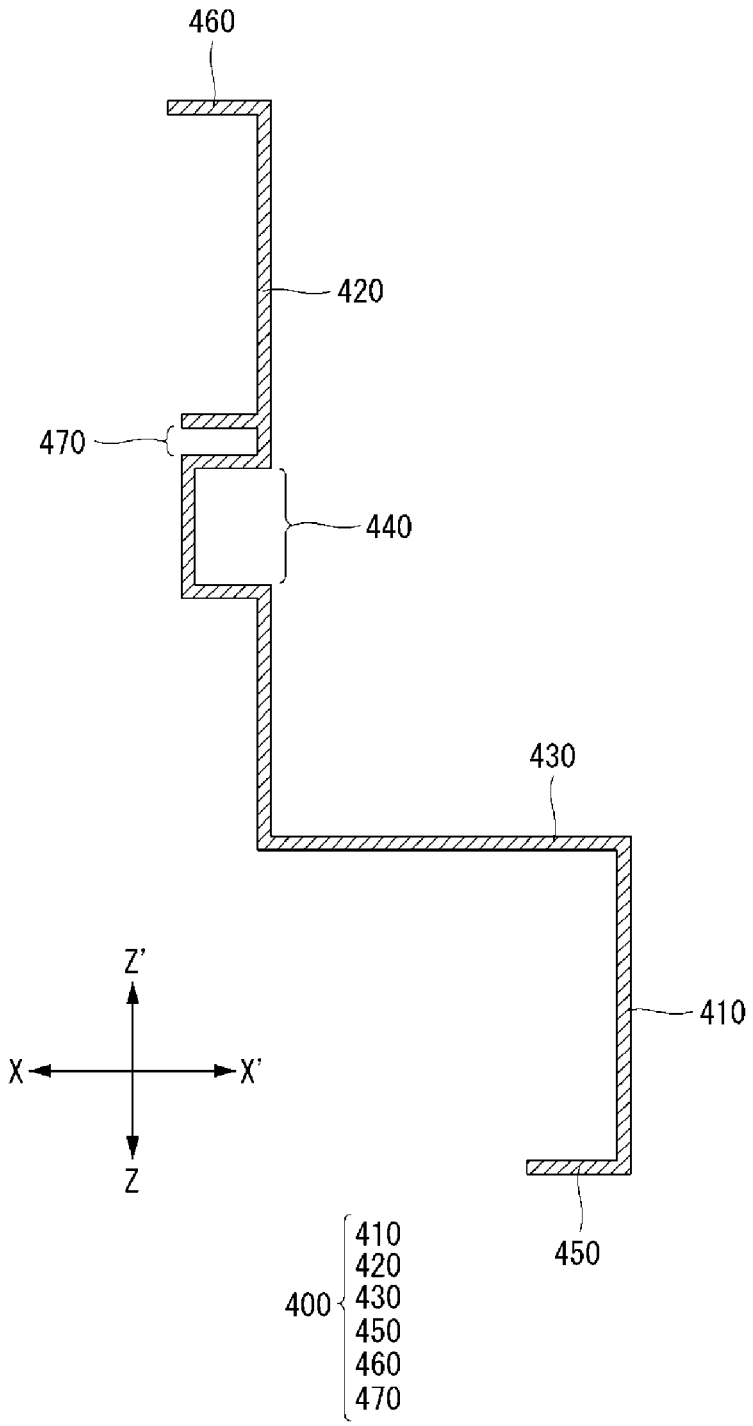

【FIG. 44】
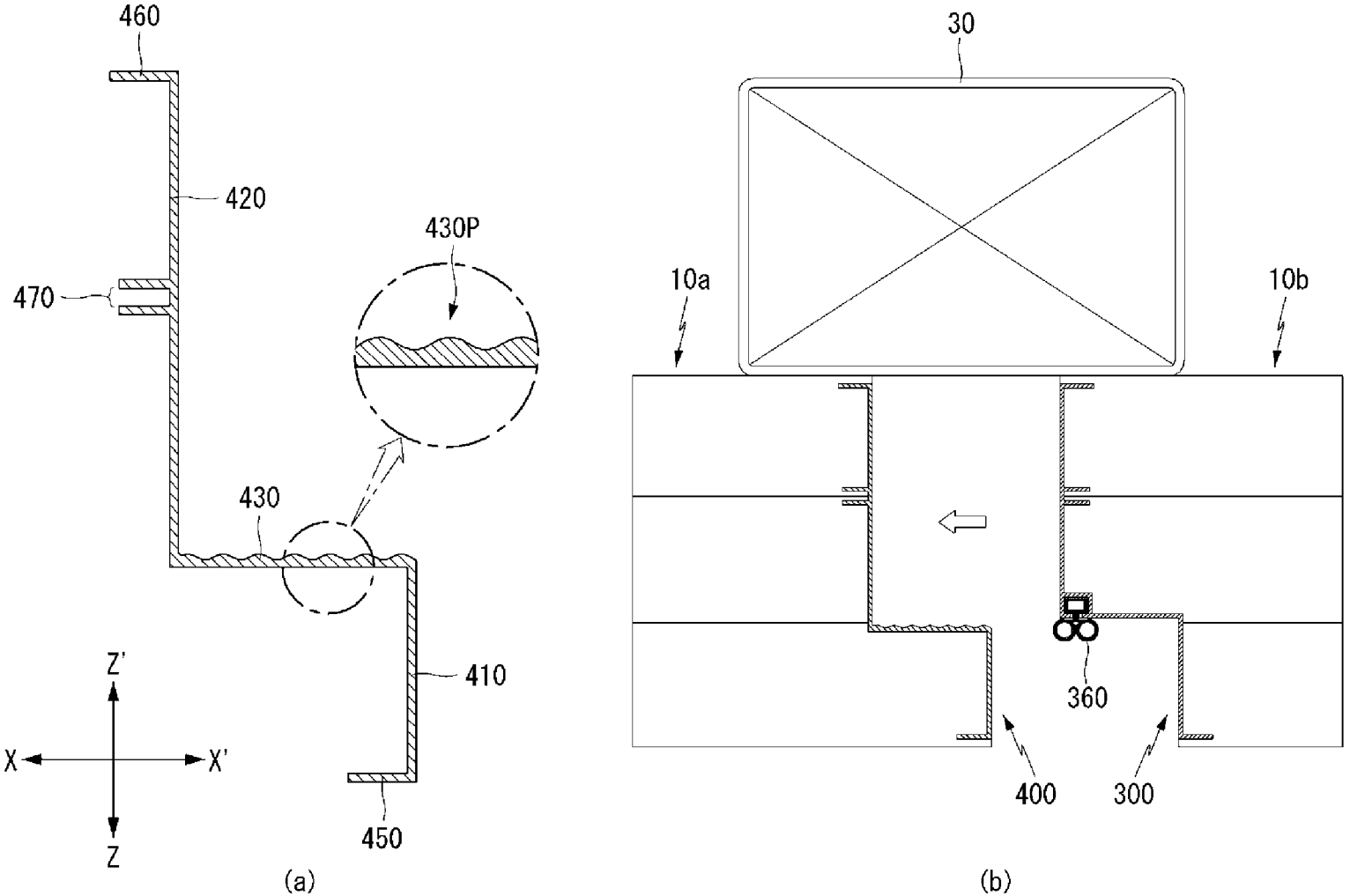

【FIG. 45】
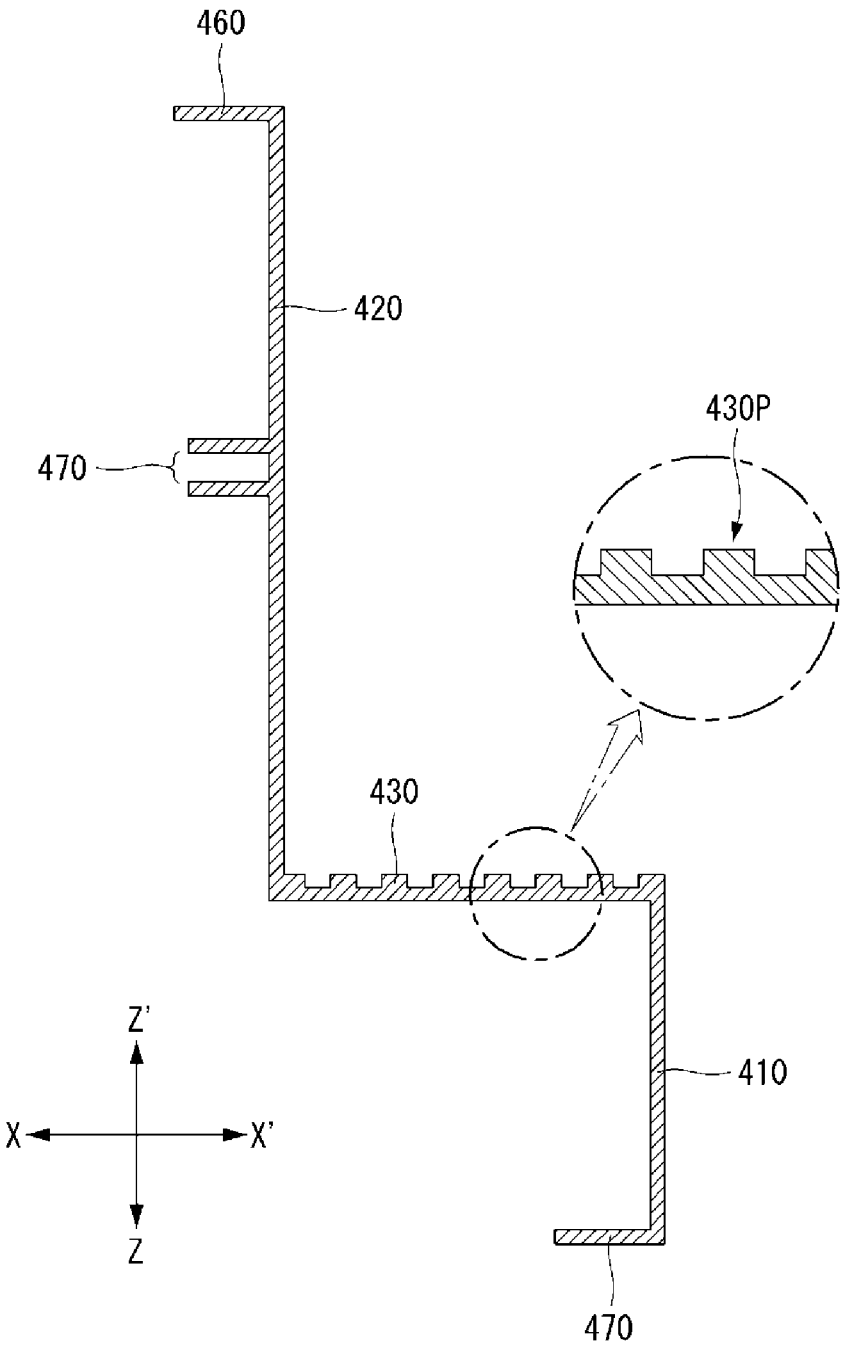

【FIG. 46】
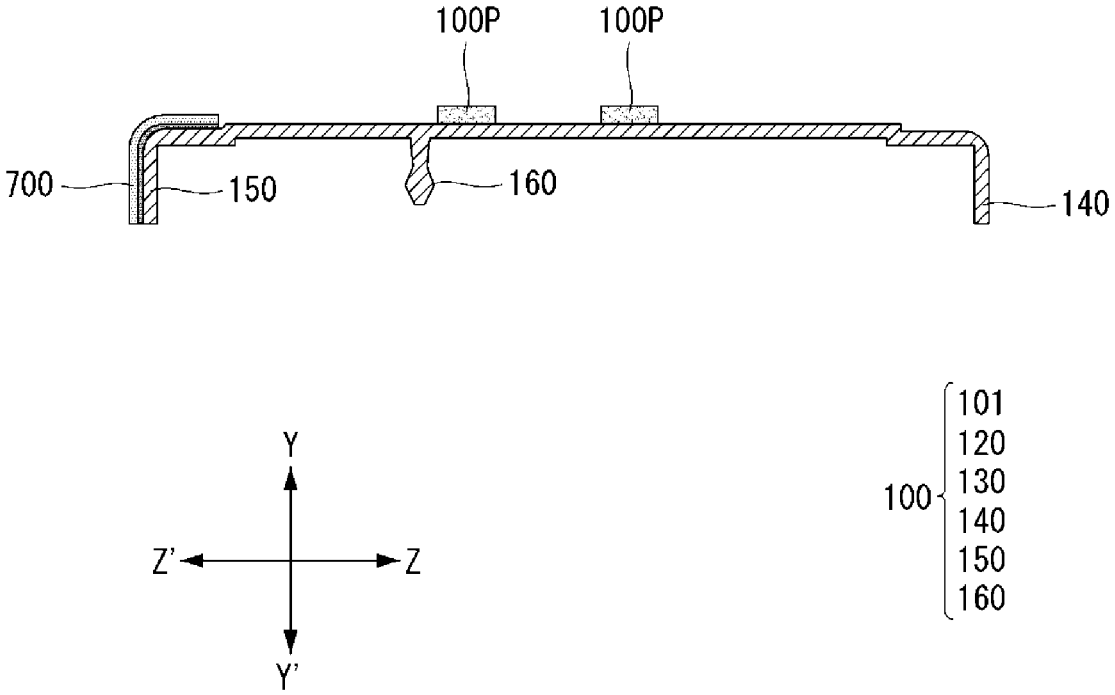

【FIG. 47】
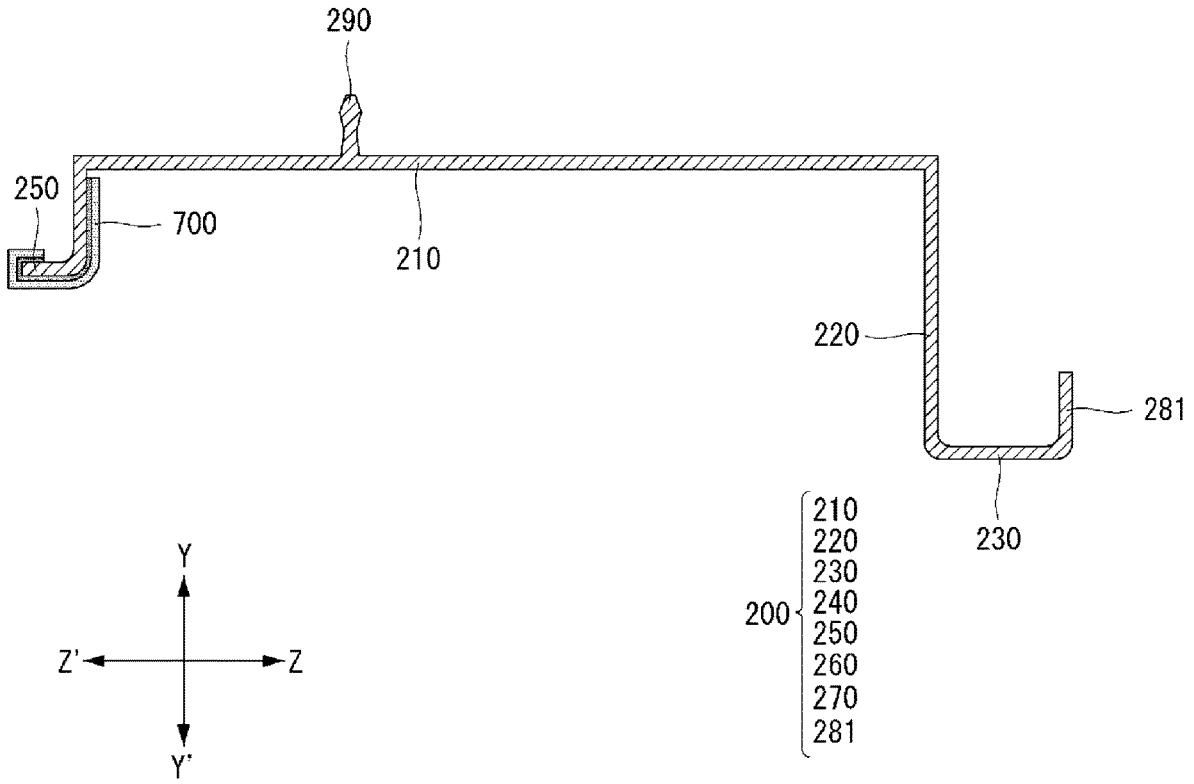

BUILDING EXTERIOR PANEL AND ASSEMBLY STRUCTURE THEREOF

TECHNICAL FIELD

The present disclosure relates to an building exterior panel and an assembly structure thereof.

BACKGROUND ART

Exterior insulation materials of buildings have been used in varied buildings such as power plants, factories, shopping malls, and houses. Sandwich panels, metal panels, and aluminum sheet panels used as typical exterior insulation materials for buildings are lightweight materials, and since such exterior insulation materials are constructed by a dry method, they are currently widely used even with a change in trend of large-scale and high-rise buildings. In addition, the exterior insulation materials have economical efficiency, heat insulation, and shortening of construction period.

Meanwhile, the sandwich panels, metal panels, aluminum sheet panels, and the like have a joint in which panels are connected during construction in terms of material characteristics, and such a joint is a weak point that frequently causes dew condensation and water leak, which is to be technically supplemented urgently.

DISCLOSURE

Technical Problem

An aspect of the present disclosure provides an building exterior panel and an assembly structure thereof.

Technical Solution

In an aspect of the present disclosure, an building exterior panel includes: a front steel plate; a rear steel plate spaced apart from the front steel plate in a rear direction of the front steel plate; an upper frame having a width in a thickness direction from the front steel plate toward the rear steel plate and disposed between upper ends of the front steel plate and the rear steel plate so as to be coupled; a first side frame having a width in the thickness direction and disposed at an end of a first side among both ends of each of the front steel plate and the rear steel plate in a horizontal direction so as to be coupled; a second side frame having a width in the thickness direction and disposed at an end of a second side among the both ends of each of the front steel plate and the rear steel plate in the horizontal direction so as to be coupled; and a lower frame having a width in the thickness direction and disposed between lower ends of each of the front steel plate and the rear steel plate so as to be coupled.

Here, an insulation member may be located on at least a portion between the upper end of the rear steel plate and the upper frame or between the lower end of the rear steel plate and the lower frame.

Here, the insulation member may include an adhesive portion adhered to an outer surface of the upper frame or the lower frame and an insulation portion having one side adhered to the adhesive portion and the other side allowing the rear steel plate to be in close contact therewith.

In addition, the insulation portion may include a polyvinyl chloride (PVC) foam material.

In addition, the upper frame may have an upper gasket inserted into and fastened to an upper gasket groove formed in the horizontal direction, and the lower frame may have a lower gasket inserted into and fastened to a lower gasket groove formed in the horizontal direction.

Here, the upper gasket and the lower gasket may be alternately located when the building exterior panel is viewed in a vertical direction from the upper frame.

In addition, an upper drain depressed inward from an outer surface of the upper frame in a lower direction is provided between the upper gasket and a projection region of the lower gasket, or the upper drain is not provided between the upper gasket and the projection region of the lower gasket in the upper frame and the upper frame is flat.

In addition, the upper frame may include the upper drain, the first side frame may include a first side drain depressed inward at a portion in contact with a first side end of the upper drain and elongated in the lower direction, and the second side frame may include a second side drain depressed inward at a portion in contact with a second side end of the upper drain and elongated in the lower direction.

The rear steel plate may include: a rear body formed to be large in the vertical direction and the horizontal direction; a rear upper step bent and extending in a front direction in which the front steel plate is located from an upper end of the rear body; a rear protrusion bent and extending in the upper direction from the rear upper step; a rear upper frame cover bent and extending in the front direction from an end of the rear protrusion and covering a portion of an upper outer surface adjacent to the rear side of the upper frame; and a rear lower frame cover bent and extending in the front direction from a lower end of the rear body and covering a portion of a lower outer surface adjacent to the rear side of the lower frame, wherein the insulation member is located between the rear upper frame cover and the upper frame and between the rear lower frame cover and the lower frame.

The front steel plate may include: a front body formed to be large in the vertical direction and the horizontal direction; a front upper step bent and extending in the thickness direction in which the rear steel plate is located from an upper end of the front body; a front protrusion bent and extending in the upper direction from an end of the front upper step; a front upper frame cover bent and extending in the rear direction from an end of the front protrusion and covering a portion of an upper outer surface of the front side of the upper frame; and a front lower frame cover bent and extending in the rear direction from a lower end of the front body and covering a portion of a lower outer surface of the front side of the lower frame, wherein an extension width of the front protrusion in the upper direction is larger than an extension width of the rear protrusion in the upper direction.

In addition, the first side frame may have a first side extending portion extending to protrude in the horizontal direction from a first side end of the front steel plate, the first side extending portion being located closer to the rear side with respect to the front protrusion, and the second side frame may have a second side extending portion extending to be depressed in the horizontal direction from a second side end of the front steel plate the second side extending portion being located closer to the rear side with respect to the front protrusion.

In addition, one of the first side extending portion of the first side frame and the second side extending portion of the second side frame may include a gasket groove and may further include a side gasket inserted into and fixed to the gasket groove.

In addition, the other of the first side extending portion of the first side frame and the second side extending portion of the second side frame may further include a plurality of irregularities with grooves elongated in the vertical direction or may be flat without a plurality of irregularities.

In addition, at least one protrusion may be provided on an inner surface of each of one pair of upper and lower frames facing each other in the vertical direction and a pair of first and second side frames facing each other in the horizontal direction, at least one depression may be provided on an inner surface of each of the other pair of frames, and the at least one inner protrusion provided on the inner surface of each of one pair of frames may be inserted into the at least one inner depression provided on the inner surface of each of the other pair of frames.

Here, the upper ends of the first and second frames may be coupled to inner surfaces of opposing ends of the upper frame, and the lower ends of the first and second frames may be coupled to the inner surfaces of opposing ends of the lower frame. In addition, an assembly structure of a building exterior panel according to an example of the present disclosure may include: a plurality of building exterior panels described above; and a building truss allowing an outer wall to be fixed to one side thereof and the plurality of building exterior panels to be coupled to the other side thereof to support the plurality of building exterior panels.

Advantageous Effects

The building exterior panel and the assembly structure thereof according to an example of the present disclosure provide a structure in which the front steel plate and the rear steel plate are coupled by a plurality of frames, simplifying an assembly method and reducing a manufacturing cost.

DESCRIPTION OF DRAWINGS

FIG. 1 is a view illustrating an example of a structure in which an building exterior panel according to the present disclosure is assembled.

FIG. 2 illustrates a horizontal configuration (x-x') and a vertical configuration of a structure in which a plurality of building exterior panels are assembled in FIG. 1.

FIG. 3 is an exploded perspective view of an building exterior panel according to the present disclosure.

FIG. 4 is a perspective view illustrating an example in which parts of an building exterior panel shown in FIG. 3 are coupled.

FIGS. 5 to 33 are views illustrating a first embodiment of an building exterior panel according to the present disclosure.

FIGS. 34 to 37 are views illustrating various modifications of the first embodiment of an building exterior panel according to the present disclosure.

FIGS. 38 to 43 are views illustrating a second embodiment of an building exterior panel according to the present disclosure.

FIGS. 44 to 45 are views illustrating a modification of a second side frame 400 in an building exterior panel according to the present disclosure.

FIGS. 46 to 47 are views illustrating a modification of an upper frame and a lower frame in an building exterior panel according to the present disclosure.

BEST MODES

Hereinafter, embodiments will be described in detail with reference to the accompanying drawings such that they can be easily practiced by those skilled in the art to which the present disclosure pertains. As those skilled in the art would realize, the described embodiments may be modified in various different ways, all without departing from the spirit or scope of the present disclosure. In the accompanying drawings, a portion irrelevant to description of the present disclosure will be omitted for clarity. Like reference numerals refer to like elements throughout.

In the drawings, the thickness of layers and regions are exaggerated for clarity.

A front side refers to a front side of a panel, a rear side refers to a refer side of the panel, a front direction refers to a direction toward the front side of the panel, a rear direction refers to a direction toward the rear side of the panel, and a thickness direction refers to a direction parallel to a thickness of the panel and includes both the front direction and the rear direction.

An upper direction refers to an upward direction with respect to the center of the panel, a lower direction refers to a downward direction with respect to the center, and a vertical direction includes both the upper direction and the lower direction.

A first side refers to any one of both sides of the panel in a horizontal direction x-x', and a second side refers to the other of both sides of the panel in the horizontal direction x-x'.

A first side direction refers to a direction toward the first side with respect to the center of the panel, a second side direction refers to a direction toward the second side with respect to the center, and the horizontal direction x-x' includes a direction in which panels are horizontally coupled, that is, both the first and second side directions.

In addition, an inner side or an inner surface of a part refers to an inner side of the panel, that is, a side or surface on which a core material of the panel is located, and an outer side or an outer surface of a part refers to an outer side or outer surface of the panel.

When it is mentioned that a width or a length of a part is the same, it refers to that the width or length of the part is the same within an error range of 10% or less.

FIG. 1 is a view illustrating an example of a structure in which an building exterior panel according to the present disclosure is assembled, and FIG. 2-(*a*) shows a horizontal configuration (x-x') of a structure in which a plurality of building exterior panels are assembled in FIG. 1, and FIG. 2-(*b*) shows a vertical configuration of the structure in which a plurality of building exterior panels are assembled in FIG. 1.

In addition, FIG. 3 is an exploded perspective view of an building exterior panel according to the present disclosure, and FIG. 4 is a perspective view illustrating an example in which parts of an building exterior panel shown in FIG. 3 are coupled.

FIG. 5 is a view illustrating a vertical side of an building exterior panel according to a first embodiment of the present disclosure, and FIG. 6 is a view illustrating a horizontal side of the building exterior panel according to the first embodiment of the present disclosure.

As illustrated in FIGS. 1 and 2, a structure in which a plurality of building exterior panels 10*a*, 10*b*, 10*c*, and 10*d* according to an example of the present disclosure are assembled may include a plurality of building exterior panels 10*a*, 10*b*, 10*c*, and 10*d* and a building truss 30.

Here, the plurality of building exterior panels 10*a*, 10*b*, 10*c*, and 10*d* may be formed by coupling the exterior panels 10*a*, 10*b*, 10*c*, and 10*d* in the vertical direction y-y' and the horizontal direction x-x'.

For example, the plurality of building exterior panels 10*a*, 10*b*, 10*c*, and 10*d* may be coupled as upper sides and lower sides of the building exterior panels adjoin each other as shown in FIG. 2-(*a*) or may be coupled as one first side among both sides in the horizontal direction x-x' and a second side on the opposite side adjoin each other as shown in FIG. 2-(*b*).

The plurality of building exterior panels 10*a*, 10*b*, 10*c*, and 10*d* may be fixed to the building truss 30.

Here, in a state where one side of the building truss 30 is previously fixed to an outer wall of a building and elongated in the vertical direction y-y', the plurality of exterior panels may be coupled to the other side of the building truss 30 by a separate fastening unit 20.

As an example, as shown in FIGS. 2-(*a*) and 2-(*b*), as the fastening unit 20 such as a screw penetrates through each of the exterior panels and is fixed to the building truss 30, the exterior panels may be fixed to and supported by the building truss 30.

Here, each of the plurality of building exterior panels 10*a*, 10*b*, 10*c*, and 10*d* may be integrally formed by assembling and coupling a front steel plate 500, a rear steel plate 600, and a plurality of frames 100, 200, 300, and 400 and as shown in FIG. 4.

The front steel plate 500 and the rear steel plate 600 may be disposed spaced apart from each other in the thickness direction z-z'. That is, the rear steel plate 600 may be disposed spaced apart in the rear direction z' of the front steel plate 500, and a plurality of frames 100, 200, 300, and 400 having a width in the thickness direction z-z' may be coupled with vertical and horizontal ends between the front steel plate 500 and the rear steel plate 600.

The ends of the front steel plate 500 and the rear steel plate 600 including steel may be bent, and an overall planar shape may be a quadrangular shape when viewed at the front of the exterior panel.

Here, a thickness of each of the front steel plate 500 and the rear steel plate 600 may be formed between 0.25 mm to 2.0 mm, for example, about 0.35 mm.

In addition, in FIGS. 3 and 4, a case where the surface of the front steel plate 500 is flat without irregularities is illustrated as an example. However, a plurality of irregularities or wrinkles may be formed on the surfaces of the front steel plate 500 and the rear steel plate 600.

For example, wrinkles having about 500 to 1000 valleys may be formed and elongated in the vertical direction y-y' or the horizontal direction x-x' on the surfaces of the front steel plate 500 and the rear steel plate 600 in the vertical direction y-y'.

A specific structure of the front steel plate 500 and the rear steel plate 600 will be described in detail with reference to FIGS. 24 to 27.

In addition, as shown in FIG. 3, a plurality of frames 100, 200, 300, and 400 provided between the front steel plate 500 and the rear steel plate 600 may include an upper frame 100, a lower frame 200, a first side frame 300, and a second side frame 400.

Each of the plurality of frames 100, 200, 300, and 400 may be formed of a metal containing aluminum. However, the present disclosure is not limited thereto and each of the plurality of frames 100, 200, 300, and 400 may be formed of a non-combustible material containing a metal having low thermal conductivity or an insulating material.

For example, the plurality of frames 100, 200, 300, and 400 may be formed of a thermosetting plastic material or a carbon material.

Here, as shown in FIGS. 3 and 4, the upper frame 100 is disposed and coupled between the upper ends of each of the front steel plate 500 and the rear steel plate 600, have the thickness direction z-z', and be elongated in the horizontal direction x-x'. A specific structure of the upper frame 100 will be described in detail with reference to FIGS. 8 to 10.

As shown in FIGS. 3 and 4, the lower frame 200 may be disposed and coupled between lower ends of each of the front steel plate 500 and the rear steel plate 600, have a width in the thickness direction z-z', and be elongated in the horizontal direction x-x'. A specific structure of the upper frame 100 will be described in detail with reference to FIGS. 11 to 13.

As shown in FIGS. 3 and 4, the first side frame 300 may be disposed and coupled with an end of a first side among opposing ends of each of the front steel plate 500 and the rear steel plate 600 in the horizontal direction x-x', have a width in the thickness direction z-z', and be elongated in the vertical direction y-y'.

Here, the first side of each of the front steel plate 500 and the rear steel plate 600 may be the left side of each of the front steel plate 500 and the rear steel plate 600, but is not limited thereto. A specific structure of the upper frame 100 will be described in detail with reference to FIGS. 14 to 16.

As shown in FIGS. 3 and 4, the second side frame 300 may be disposed and coupled with an end of a second side among opposing ends of each of the front steel plate 500 and the rear steel plate 600 in the horizontal direction x-x', have a width in the thickness direction z-z', and be elongated in the vertical direction y-y'.

The plurality of frames 100, 200, 300, and 400 may be formed as respective ends thereof are coupled with each other in the vertical direction.

In one example, an upper end of the first side frame 300 may be coupled to an inner side of a first side end of the upper frame 100, and an upper end of the second side frame 400 may be coupled to an inner side of a second side end of the upper frame 100.

In addition, the lower end of the first side frame 300 may be coupled to an inner side of a first side end of the lower frame 200, and a lower end of the second side frame 400 may be coupled to an inner side of a second side end of the lower frame 200.

Accordingly, as shown in FIG. 2-(*b*), the panels may be prevented from being deformed due to a weight thereof when the plurality of panels 10*a* and 10*c* are stacked and constructed in the vertical direction.

That is, when the plurality of panels 10*a* and 10*c* are stacked and constructed in the vertical direction y, the upper frame 100 and the lower frame 200 may receive a force in the vertical direction due to the weight of the panels, and here, since opposing ends of the upper frame 100 and the lower frame 200 support portion opposing ends of the first and second side frames 300 and 400 in the vertical direction, the panels may be prevented from being deformed.

Here, the second side of each of the front steel plate 500 and the rear steel plate 600 may be the right side of each of the front steel plate 500 and the rear steel plate 600, but is not limited thereto. A specific structure of the upper frame 100 will be described in detail with reference to FIGS. 17 to 19.

As described above, as illustrated in FIG. 5, an upper portion of each of the building exterior panels may have an upper protrusion 11 formed as the front steel plate 500, the rear steel plate 600, and the upper frame 100 are coupled with each other, and a lower portion of each of the building exterior panels may have a lower depression 13 formed as the front steel plate 500, the rear steel plate 600, and the upper frame 100 are coupled with each other.

Accordingly, as shown in FIG. 1 and FIG. 2-(*a*), in each of the plurality of building exterior panels 10*a*, 10*b*, 10*c*, and 10*d*, the upper protrusion 11 formed at the upper side may be inserted into and coupled to the lower depression 13 formed at the lower side.

Here, in the upper protrusion 11 of the exterior panel, a first protrusion length H11*a* from a front upper step of the upper side of the front steel plate 500 of the exterior to the upper side may be longer than a second protrusion length H11*b* from a rear upper step of the upper side of the rear steel plate 600 to the upper side as shown in FIG. 5.

In addition, in the lower depression 13 of the exterior panel, a first depressed depth H13*a* from a lower side end of the front steel plate 500 to a depressed surface may be greater than a second depressed depth 13*b* from a lower side end of the rear steel plate 600 to the depressed surface and smaller than the first protrusion length H11*a* of the upper protrusion 11.

Accordingly, when the upper side and the lower side of the exterior panel are coupled with each other, the upper protrusion 11 of the exterior panel may be inserted into and coupled with the inside of the lower depression 13, and due to the relatively large first protrusion length H11*a* in the front side of the exterior panel, the plurality of exterior panels are shown as if they are spaced apart from each other in the horizontal direction x-x' when coupled in the vertical direction y-y', whereby the exterior panels may stand out in appearance.

Here, the front upper step of the upper protrusion 11 may be formed on the front steel plate 500, the rear upper step may be formed on the rear steel plate 600, and the first and second side frames 300 and 400 may cover the first and second sides of the upper protrusion 11. In addition, the lower depression 13 may be formed by a cross-sectional shape of the lower frame 200 itself.

In addition, as shown in FIG. 6, the front steel plate 500, the rear steel plate 600, and the first side frame 300 are coupled with the first side of each of the building exterior panels, so that a first side protrusion 15 in which a first side end of the rear steel plate 600 protrudes in the horizontal direction x-x' with respect to a first side end of the front steel plate 500 may be formed.

In addition, the front steel plate 500, the rear steel plate 600, and the second side frame 400 are coupled with the second side of each of the building exterior panels, so that a second side depression 17 in which a second side end of the rear steel plate 600 protrudes in the first side direction x with respect to the first side end of the front steel plate 500 may be formed.

Here, a shape of the first side protrusion 15 may be formed by a cross-sectional shape of the first side frame 300 itself, and a shape of the second side depression 17 may be formed by a cross-sectional shape of the second side frame 400 itself.

In addition, here, planar shapes of the upper frame 100 and the lower frame 200 may be formed in a structure that covers the upper and lower sides of the first side protrusion 15 and the upper and lower sides of the second side depression 17.

A first side protrusion length W15 protruding from the first side end of the front steel plate 500 in the first side protrusion 15 may be equal to a second side depressed length W17 depressed in the second side depression 17.

In addition, as shown in FIGS. 5 and 6, the upper side of the upper protrusion 11 may have an upper drain 110 depressed to an inner side of the exterior panel and elongated in the horizontal direction x-x' to the first and second sides of the exterior panel.

In addition, a protruding first side of the first side protrusion 15 may have a first side drain 340 connected to the upper drain 110 and elongated to a lower side of the exterior panel in the vertical direction y-y', and a depressed second side of the second side depression 17 may have a second side drain 440 connected to the upper drain 110 and elongated to a lower side of the exterior panel in the vertical direction y-y'.

A connection structure between the upper drain 110 and the first and second side drains may block water introduced from the front side of the exterior panel in the rear direction z' and induces water in a downward direction of the exterior panel, thereby blocking or preventing water leakage of the exterior panel.

In addition, as shown in FIGS. 5 and 6, the upper side of the upper protrusion 11 may be provided with an upper gasket 130 elongated to the first and second sides of the exterior panel in the horizontal direction x-x' at a position spaced apart from the upper drain 110.

The upper gasket 130 is spaced from the upper drain 110 toward the rear of the panel and may be inserted into an upper gasket 130 groove provided in the upper frame 100.

In addition, a lower gasket 270 may be elongated to the first and second sides of the exterior panel in the horizontal direction x-x' at a position staggering from the upper drain 110 and the upper gasket 130 on a lower side of the lower depression 13.

The lower gasket 270 may be located on a front side of the panel compared to the upper drain 110 and inserted into a lower gasket 270 groove provided in the lower frame 200 so that the lower gasket 270 does not overlap the upper gasket 130 or the upper drain 110 when the exterior panel is vertically coupled.

In addition, at the end of the protruding surface protruding in the horizontal direction x-x' from the first side protrusion 15, the first side gasket 360 may be elongated from the upper side to the lower side of the exterior panel in the vertical direction y-y'.

However, unlike the upper protrusion 11, the lower depression 13, and the first side protrusion 15, the gasket may not be provided in the second side depression 17.

This is because, when the plurality of exterior panels are coupled with each other, each exterior panel may be pushed in the horizontal direction x-x' so that first and second sides thereof are coupled with each other, and here, provision of gaskets on both the first side protrusion 15 and the second side protrusion 17 of the exterior panel may be a hinderance to construction.

Accordingly, in FIGS. 5 and 6, it is illustrated that the first side protrusion 15 is provided with the gasket and the second side depression 17 is not provided with the gasket, but alternatively, the second side depression 17 may be provided with the gasket and the first side protrusion 15 may not be provided with the gasket.

In addition, it is illustrated that the upper protrusion 11 may be provided with an upper gasket 130 on the rear side of the upper drain 110 and a lower depression 13 is provided with a lower gasket 270 on the front side of the upper drain 110, but alternatively, the upper gasket 130 may be provided on the front side of the upper drain 110 in the upper protrusion 11 and the lower gasket 270 may be provided on the rear side of the upper drain 110 in the lower depression 13.

Each part of the exterior panel as shown in FIGS. 5 and 6 for the convenience of explanation will be described in detail with reference to FIG. 8 below.

In addition, the building exterior panel of the present disclosure having such an external appearance may have a core material for thermal insulation therein.

FIG. 7 is a view illustrating a core material 40 provided in the interior of the building exterior panel according to the present disclosure.

As described above, in the building exterior panel according to the present disclosure, the front steel plate 500, the rear steel plate 600, the upper frame 100, the lower frame 200, the first side frame 300, and the second side frame 400 may be coupled with each other so as to be integrally formed.

Accordingly, an inside of the exterior panel may be empty, and in order to further improve an insulation function of the exterior panel, the core material 40 for insulation may be embedded in the exterior panel.

The core 40 may be (1) glass wool formed by melting glass ore to artificially fiberize it and formed by an SiO2-based chemical composition, (2) mineral wool or urethane foam formed by melting igneous rock such as basalt at a high temperature of about 1,500° C. or higher to artificially fiberize it and formed as a $SiO_2$—$Al_2O_3$—CaO-based chemical composition, or (3) an expanded polystyrene (EPS).

However, such a core material 40 is not limited thereto and, regardless of material, any core material may be used as long as it has an insulation function, and only one type of core material 40 may be used in one exterior panel or several types of core materials 40 may be used in combination.

As an example, as shown in FIG. 7, when the exterior panel is viewed from the front steel plate 500 side, a urethane foam or bead insulation material 40*a* may be located at the center side of the exterior panel and glass wool 40*b* may be located at the edge of the exterior panel.

That is, a glass wool 40*b* may be located in the upper edge and the lower edge of opposing sides in the vertical direction y-y' in the exterior panel, and a urethane foam or the EPS 40*a* may be located at the center between the upper and lower edges.

In addition, the glass wool 40*b* may be located in the first and second sides of opposing sides in a horizontal direction x-x' in the exterior panel, and a urethane foam or EPS 40*a* may be located at the center between the first and second sides.

Alternatively, when the exterior panel is viewed in the thickness direction z-z', the glass wool 40*b* may be located at the front edge and the rear edge of the front steel plate 500 and the rear steel plate 600, and a urethane foam or the EPS 40*a* may be located at the center between the front and rear edges.

Accordingly, the insulation function of the exterior panel may be optimally maintained, while a manufacturing cost of the exterior panel is reduced.

Hereinafter, each component of an building exterior panel will be described in detail.

FIGS. 8 to 10 are views illustrating the upper frame 100 of the building exterior panel according to a first embodiment of the present disclosure.

FIG. 8 is an exploded side view of the first side frame 300 to illustrate the upper frame 100 of the building exterior panel, FIG. 9 is a cross-sectional view and a plan view of the upper frame 100, and FIG. 10 is a perspective view of an exterior panel in which the first side frame 300 is coupled with the upper frame 100.

As illustrated in FIGS. 8 and 9, the upper frame 100 of the building exterior panel according to the first embodiment of the present disclosure may include an upper body surface 101, an upper drain 110, an upper gasket groove 120, an upper gasket 130, a first upper support portion 140, and a second upper support portion 150 and may be integrally formed through a method such as extrusion molding.

The upper frame 100 may form an upper surface of a protruding end of the upper protrusion 11 provided in the exterior panel. That is, the upper frame 100 itself does not have a shape of the upper protrusion 11, and the front steel plate 500 and the rear steel plate 600 each has an upper step and a protrusion and the upper frame 100 may be located at the end of the upper protrusion 11 to form a protruding upper surface.

Accordingly, since the entire upper frame 100 is inserted into the lower depression 13 of the lower frame 200, a width W100 of the upper frame 100 in the thickness direction may be smaller than a width WR200 of the lower depression 13 of the lower frame 200.

In addition, according to the present disclosure, an insulation member 700 may be located on at least one portion between the upper end of the rear steel plate 600 and the upper frame 100 or between the lower end of the rear steel plate 600 and the lower frame 200.

Accordingly, the insulation member 700 may be located (1) between the upper end of the rear steel plate 600 and the upper frame 100, (2) between the lower end of the rear steel plate 600 and the lower frame 200, or (3) between the upper end of the rear steel plate 600 and the upper frame 100 and between the lower end of the rear steel plate 600 and the lower frame 200.

Hereinafter, a case where the insulation member 700 is provided both between the upper end of the rear steel plate 600 and the upper frame 100 and between the lower end of the rear steel plate 600 and the lower frame 200 is described as an example, but the present disclosure is not limited thereto and the insulation member 700 may also be provided as in the case of (1) and (2) descried above.

As such, in order for the insulation member 700 to be located between the upper end of the rear steel plate 600 and the upper frame 100, the insulation member 700 may be bonded or adhered to the end portion of the upper body surface 101 in the rear direction and the outer surface of the second upper support portion 150 in the upper frame 100. The insulation member 700 will be described in more detail after each component of the upper frame 100 is described.

In addition, at least one inner protrusion 160 may be integrally provided on the inner surface of the upper frame 100. The at least one inner protrusion 160 provided in the upper frame 100 will be described in detail with reference to FIGS. 20 to 24.

As illustrated in FIGS. 8 to 10, the upper frame 100 may have a surface having a width in the thickness direction z-z' at the upper end of each of the front steel plate 500 and the rear steel plate 600 and elongated in the horizontal direction x-x'.

The upper body surface 101 may be a surface having a width in the thickness direction z-z' and elongated in the horizontal direction x-x'.

The upper drain 110 may be depressed inward from an outer surface of the upper body surface 101 in the vertical direction y-y' and may be elongated in the horizontal direction x-x'.

The upper gasket groove 120 may be depressed in the lower direction y' from the outer surface of the upper frame 100, may be elongated in the horizontal direction x-x', and may be spaced apart from the upper drain 110 in the thickness direction z-z'.

For example, the upper gasket groove 120 may be located closer to the rear steel plate 600 than the upper drain 110.

Here, the width of an entrance of the upper gasket groove 120 may be narrower than the inner surface of the upper gasket groove 120.

The upper gasket 130 is inserted and fastened to the upper gasket groove 120, and the upper gasket 130 may protrude in the upper direction y from the upper frame 100 and may be elongated in the horizontal direction x-x'.

Accordingly, the upper drain 110 may be provided between the upper gasket 130 and a projection region of the lower gasket 270 to be described later in the upper frame 100.

Accordingly, the upper gasket 130 may block ambient air flowing from the outside of the front steel plate 500 of the exterior panel to the rear of the rear steel plate 600, thereby further improving a thermal bridge blocking function of the exterior panel and fundamentally preventing water introduced to a space between the exterior panels from the outside from flowing to the rear of the exterior panels.

Here, the upper gasket 130 may include an upper body portion 133, an upper head portion 131, and an upper connecting portion 135 which are integrally formed. The upper body portion 133 may have a quadrangular cross section and may be inserted into the upper gasket groove 120, the upper head portion 131 may have a circular cross section and protrude in the upper direction y of the upper frame 100, and the upper connecting portion 135 may connect the upper body portion 133 and the upper head portion 131.

Here, a width of the upper connecting portion 135 may be smaller than widths of the upper body portion 133 and the upper head portion 131. Accordingly, the upper gasket 130 may be inserted into and fixed to the upper gasket groove 120, and when the plurality of building exterior panels 10*a*, 10*b*, 10*c*, and 10*d* are coupled and constructed on an outer wall of a building, there is no need to separately construct the upper gasket 130, facilitating the construction.

The first upper support portion 140 may be bent and extend in the lower direction y' from the front end of the upper frame 100 and may be elongated in the horizontal direction x-x' from a first side 100S1 to a second side 100S2.

The upper end of the front steel plate 500 covers the first upper support portion 140 is disposed, so that the first upper support portion 140 may support portion an inner side of the upper end of the front steel plate 500.

The second upper support portion 150 may be bent and extend in the lower direction y' from the rear end of the upper frame 100 and may be elongated in the horizontal direction x-x' from the first side 100S1 to the second side 100S2.

The upper end of the rear steel plate 600 covers the second upper support portion 150, so that the second upper support portion 150 may support portion an inner side of the upper end of the rear steel plate 600.

Referring to a planar shape of the upper frame 100, as shown in FIG. 9-(*b*), in order to form the upper side of the first side protrusion 15 and the second side depression 17, a portion of the front side of the upper frame 100 may protrude or may be depressed in the horizontal direction x-x' and opposing ends of the first and second sides 100S1 and 100S2 in which the upper drain 110 is provided may be depressed in the horizontal direction x-x'.

Meanwhile, in the upper frame 100, the insulation member 700 may be bonded or adhered to an end of the upper body surface 101 in the rear direction and an outer surface of the second upper support portion 150 and may be elongated in the horizontal direction x-x'. With the insulation member 700 located, the rear sheet plate 600 may be coupled to cover the end of the upper frame 100 in the rear direction as shown in FIG. 8.

Here, the upper end of the rear steel plate 600 covering the end of the upper frame 100 in the rear direction may be an upper end of the rear protrusion 630 and a rear upper frame cover 640. A specific structure of the rear steel plate 600 will be described later.

Accordingly, the insulation member 700 may be located between the upper end of the rear steel plate 600 and the upper frame 100.

Since the insulation member 700 is located between the upper end of the rear steel plate 600 and the upper frame 100, dew condensation that may occur at the upper end of the rear side of the exterior panel may be prevented.

That is, the building exterior panel according to the present disclosure may be installed on an exterior wall of a building, and warm air inside the building and cold air introduced from the outside of the building may meet on the rear steel plate 600 side at the exterior panel, leading to a possibility of the occurrence of dew condensation on the rear steel plate 600 compared with the front steel plate 500 of the panel.

More specifically, in the rear steel plate 600, the rear body 610 formed wide in the vertical direction and the horizontal direction x-x' is in contact with the inner core material having a relatively low thermal conductivity, lowering a possibility of the occurrence of dew condensation.

However, dew condensation may easily occur at a portion of the rear steel plate 600 that is in contact with the upper and lower frames 100 and 200 having relatively high thermal conductivity due to cold air transmitted through the frame.

However, as in the present disclosure, when the insulation member 700 is located between the upper end of the rear steel plate 600 and the upper frame 100, dew condensation that may occur at the upper end of the rear steel plate 600 may be prevented.

The insulation member 700 may include an adhesive portion 701 and an insulation portion 703. The adhesive portion 701 is adhered to an outer surface of the upper frame 100, and one surface of the insulation portion 703 may be adhered to the adhesive portion 701 and an upper inner side of the rear steel plate 600 may be in close contact with the other surface of the insulation portion 703. Here, the insulation portion 703 may include polyvinyl chloride foam material.

More specifically, the adhesive portion 701 is extendedly adhered to the rear end of the upper body surface 101 of the upper frame 100 and the outer surface of the second upper support portion 150 in the horizontal direction x-x', and the upper end of the rear protrusion 630 of the rear steel plate 600 and the inner surface of the rear upper frame cover 640 may be in close contact with and coupled to the insulation portion 703.

FIGS. 11 to 13 are views illustrating the lower frame 200 of the building exterior panel according to the first embodiment of the present disclosure.

FIG. 11 is an exploded view illustrating the lower frame 200 of the building exterior panel, FIG. 12 is a cross-sectional view and a plan view of the lower frame 200, and FIG. 13 is a perspective view of an exterior panel in which the front steel plate 500, the rear steel plate 600, and the first side frame 300 are coupled to the lower frame 200.

The lower frame 200 includes first to fifth lower frame portions 210, 220, 230, 240, and 250, a lower gasket groove 260, a lower gasket 270, and a first lower support portion 281, which may be integrally formed through a method such as extrusion molding.

Here, the first, second, and fourth lower frame portions 210, 220, and 240 may form the lower depression 13 of the exterior panel. That is, the first lower frame portion 210 may form a bottom surface of the lower depression 13, and the second and fourth lower frame portions 220 and 240 may form a vertical side of the lower depression 13.

In addition, at least one inner protrusion 160 may be further integrally provided on the inner surface of the lower frame 200. The at least one inner protrusion 290 provided in the lower frame 200 will be described in detail with reference to FIGS. 20 to 24.

The first lower frame portion 210 may be depressed in the upper direction y from a lower end of each of the front steel plate 500 and the rear steel plate 600 to form a bottom surface of the lower depression 13, have a width in the direction z-z', and have a surface extending in the horizontal direction x-x'.

The second lower frame portion 220 may be bent and extend in the lower direction y' from an end of the first lower frame portion 210 in the front direction z to form a vertical side adjacent to a front side of the lower depression 13, and may extend in the horizontal direction x-x'.

The third lower frame portion 230 may be bent in the front direction z from the end of the second lower frame portion 220 and extend to the front steel plate 500 and extend in the horizontal direction x-x'.

When a portion of the second lower frame portion 220 and the entire third lower frame portion 230 are coupled with the front steel plate 500, an inner surface of the lower end of the front steel plate 500 may be covered.

The fourth lower frame portion 240 may be bent and extend in the lower direction y' from and end of the first lower frame portion 210 in the rear direction z', form a vertical side adjacent to a rear side of the lower depression 13, and extend in the horizontal direction x-x'.

The fifth lower frame portion 250 may be bent from an end of the fourth lower frame portion 240 in the rear direction z', extend to the rear steel plate 600, and extend in the horizontal direction x-x'.

When a portion of the fourth lower frame portion 240 and the entire fifth lower frame portion 250 are coupled with the rear steel plate 600, an inner surface of the lower end of the rear steel plate 600 may be covered.

The lower gasket groove 260 may be depressed from an outer surface of the first lower frame portion 210 in the upper direction y and may extend in the horizontal direction x-x'.

In addition, the lower gasket 270 may be inserted into and fastened to the lower gasket groove 260 and protrude in the lower direction y' of the lower frame 200. The lower gasket 270 may also extend in a horizontal direction x-x' from the first side 200S1 to the second side 200S2 of the lower frame 200.

Here, as shown in FIG. 13, the lower gasket groove 260 may be located to stagger from a position of the upper drain 110 and a position of the upper gasket groove 120.

In one example, the lower gasket groove 260 may be located closer to the front steel plate 500 than the upper drain 110, and the lower gasket 270 may also be located closer to the front steel plate 500 than the upper drain 110.

Accordingly, the upper drain 110 provided in the upper frame 100 may be located between projected regions of the lower gasket 270 and the upper gasket 130.

However, the position of the lower gasket groove 260 is not limited thereto, and if the upper gasket 130 is located closer to the front steel plate 500 than the upper drain 110, the lower gasket groove 260 may be located to be closer to the rear steel plate 600 than the upper drain 110.

The entrance of the lower gasket groove 260 may be formed to be narrower than the inner surface of the lower gasket groove 260. Accordingly, the lower gasket 270 may be fixed to the lower gasket groove 260, without escaping from the lower gasket groove 260.

The lower gasket 270 may include a lower body portion 273, a lower head portion 271, and a lower connecting portion 275 and may be integrally formed.

The lower body portion 273 may have a quadrangular cross section and may be inserted into and fixed to the lower gasket groove 260. The lower head portion 271 may have a circular cross section and protrude from the first lower frame portion 210 of the lower frame 200 in the lower direction y'. The lower connecting portion 275 may connect the lower body portion 273 and the lower head portion 271 to each other.

Here, a width of the lower connecting portion 275 may be narrower than widths of the lower body portion 273 and the lower head portion 271, and accordingly, the lower gasket 270 may be fixed to the lower gasket groove 260.

The first lower support portion 281 may be bent and extend in the upper direction y from the front end of the third lower frame portion 230 and extend from the first side 200S1 to the second side 200S2 of the lower frame 200 in the horizontal direction x-x'.

The lower end of the front steel plate 500 covers the first lower support portion 281, so that the first lower support portion 281 may support portion an inner side of the lower end of the front steel plate 500.

As shown in FIG. 12-(*a*), to form a lower side of the first side protrusion 15 and the second side depression 17, the planar shape of the lower frame 200 may be formed as a portion of the front side of the upper frame 100 protrudes or is depressed or protrudes in the horizontal direction x-x', and opposing ends of the first and side sides 200S1 and 200S2 overlapping the upper drain 110 in the vertical direction y-y' are depressed.

In addition, a width of the lower depression 13 of the lower frame 200 may be greater than a width of the upper frame 100 in the thickness direction so that the upper protrusion 11 may be inserted into the lower depression 13.

In addition, in order to prevent dew condensation that may occur between the rear steel plate 600 and the lower frame 200, the insulation member 700 may extend to be located in the horizontal direction x-x' between the lower end of the rear steel plate 600 and the lower frame 200.

As such, the insulation member 700 located between the lower end of the rear steel plate 600 and the lower frame 200 may include the adhesive portion 701 and the insulation portion 703, and a material thereof may be the same as a material of the insulation member 700 located at the end of the rear side of the upper frame 100.

As such, the adhesive portion 701 of the insulation member 700 located on the outer surface of the lower frame 200 may be adhered to outer surfaces of the fourth and fifth lower frames 240 and 250 located on the rear side of the lower frame, and the insulation portion 703 may be located on the adhesive portion 702 adhered to the outer surface of the fourth and fifth lower frames 240 and 250, and the rear steel plate 600 may be in close contact with and coupled to the insulation portion 703.

In addition, in the present disclosure, any one of a first side extending portion 330 of the first side frame 300 or a second side extending portion 430 of the second side frame 400 may further include a cushioning member adhered to an outer side of the first side extending portion 330 or the second side extending portion 430 and extending in the vertical direction or may further include a side gasket inserted into and fixed in a gasket groove provided at the first side extending portion 330 or the second side extending portion 430.

Hereinafter, a case where the side gasket inserted into and fixed in the gasket groove provided in the first side extending portion 330 of the first side frame 300 among the first side extending portion 330 of the first side frame 300 or the second side extending portion 430 of the second side frame 400 is provided is described as an example. However, the present disclosure is not limited thereto, and the cushioning member may be included in the first side extending portion 330 and a side gasket or a cushioning member may be provided at the second side extending portion 430 of the second side frame 400.

The first side frame 300 in which the side gasket is provided in the first side extending portion 330 will be described in detail as follows.

FIGS. 14 to 16 are views illustrating the first side frame 300 of an building exterior panel according to the first embodiment of the present disclosure.

FIG. 14 is an exploded view illustrating the first side frame 300 of the building exterior panel, FIG. 15 is a cross-sectional view and a plan view of the first side frame 300, and FIG. 16 is a perspective view of an exterior panel in which the front steel plate 500, the rear steel plate 600, and other frame are coupled to the first side frame 300.

The first side frame 300 includes a first portion 310, a second portion 320, a first side extending portion 330, a first side drain 340, a first side gasket groove 350, a first side gasket 360, a first side first support portion 370, and a first side second support portion 380 of the first side frame 300 and may be integrally formed through a method such as extrusion molding.

In addition, at least one inner depression 390 may be further integrally provided on the inner side of the first side frame 300. The at least one inner depression 390 provided in the first side frame 300 will be described in detail with reference to FIGS. 20 to 24.

The first portion 310 of the first side frame 300 may adjoin an end of the first side end of the front steel plate 500, have a width in the thickness direction z-z' of the exterior panel, and extend in the vertical direction from an upper side to a lower side.

The second portion 320 of the first side frame 300 may adjoin an end of the first side 100S1 of the rear steel plate 600, have a width in the thickness direction z-z' of the exterior panel, located at a portion protruding in the horizontal direction x-x' with respect to the first portion 310 of the first side frame 300, and extend in the vertical direction y-y' from an upper side to a lower side of the exterior panel.

The first side drain 340 extending in the vertical direction y-y' may be provided at a portion engaged with an end of the upper drain 110 on an outer side of the second portion 320 of the first side frame 300.

The first side extending portion 330 may be bent in the horizontal direction x-x' from the end of the first portion 310 of the first side frame 300 and extend and be connected to an end of the second portion 320 of the first side frame 300.

In addition, the first side frame 300 may form an end of the first side protrusion 15 protruding in the horizontal direction x-x' from the first side end of the front steel plate 500 by the first and second portions and the first side extending portion 330 of the first side frame 300.

In addition, the first side extending portion 330 may be located to be closer to the rear side with respect to the front protrusion 530 of the front steel plate 500 to be described later.

Vertical upper end faces of the first and second portions 310 and 320 and the first side extending portion 330 of the first side frame 300 are coupled with the upper frame 100 to adjoin the inner side of the first side end of the upper frame 100, and vertical lower end faces thereof may be coupled with the lower frame 200 to adjoin the inner side of the first side end of the lower frame 200.

In addition, the first side frame 300 and the front steel plate 500 may be coupled so that a portion of the end of the first side 500S1 of the front steel plate 500 bent in the rear direction z' may cover the first portion 310 of the first side frame 300, and the first side frame 300 and the rear steel plate 600 may be coupled so that a portion of the end of the first side 600S1 of the rear steel plate 600 bent in the front direction z may cover the second portion 320 of the first side frame 300.

The front steel plate 500, the rear steel plate 600, the upper frame 100, and the lower frame 200 may be coupled to the first side frame 300 to form the first side protrusion 15.

The first side drain 340 may be located at a portion engaged with the end of the upper drain 110 on the outer side of the second portion 320 of the first side frame 300 and may be depressed inward in the direction x' of the second side 100S2 and extend in the vertical direction y-y' from the upper side to the lower side of the exterior panel.

A width of the first side drain 340 is formed to be larger than a width of the upper drain 110, so that water guided to the upper drain 110 may smoothly flow in the lower direction y' of the exterior panel through the first side drain 340.

The first side gasket groove 350 may be located on the outer side of the first side extending portion 330, may be depressed in the rear direction z' of the exterior panel, and may extend in the vertical direction y-y' from the upper side to the lower side of the exterior panel.

The first side gasket groove 350 may be located closer to the second portion 320 than the first portion 310 of the first side frame 300 in the first side extending portion 330.

In addition, a width of an entrance of the first side gasket groove 350 may be formed to be narrower than the inner side of the first side gasket groove 350. Accordingly, the first side gasket 360 may be stably fixed to the first side gasket groove 350.

The first side gasket 360 protruding in the front direction z may be inserted into the first side gasket groove 350.

The first side gasket 360 may include a first side body portion 363, a first side head portion 361, and a first side connecting portion 365 which are formed integrally.

The first side body portion 363 may be inserted and fixed in the first side gasket groove 350, the first side head portion 361 may protrude in the front direction z of the exterior panel from the third portion of the first side frame 300, and the first side connecting portion 365 may connect the first side body portion 363 and the first side head portion 361 to each other.

Here, a width of the first side connecting portion 365 may be formed to be narrower than widths of the first side body portion 363 and the first side head portion 361.

In addition, the first side head portion 361 connected to the first side body portion 363 through the first side connecting portion 365 may be in plurality, and as illustrated, for example, two first side head portions 361 may be provided and spaced apart from each other in the horizontal direction x-x'.

The first side first support portion 370 may be bent and extend in the second side direction x' from the end where the first portion 310 of the first side frame 300 adjoins the front steel plate 500 in the thickness direction z-z'.

The front end adjacent to the first side 500S1 of the front steel plate 500 covers the first side first support portion 370, so that the first side first support portion 370 may support an inner side of the front end adjacent to the first side 500S1 of the front steel plate 500.

In addition, the first side second support portion 380 may be bent and extend in the second side direction x' from an end where the second portion 320 of the first side frame 300 adjoins the rear steel plate in the thickness direction z-z'.

The rear end adjacent to the first side 600S1 of the rear steel plate 600 covers the first side second support portion 380, so that the first side second support portion 380 may support the inner side of the rear end adjacent to the first side 600S1 of the rear steel plate 600.

The first and second support portions 370 and 380 of the first side frame 300 may prevent the first side shape of the front steel plate 500 and the rear steel plate 600 from being deformed or damaged by a weight of the exterior panels when the front steel plate 500 and the rear steel plate 600 of the exterior panels are arranged to adjoin each other in the process of preparing to construct the exterior panels on an outer wall of a building.

FIGS. 17 to 19 are views illustrating the second side frame 400 of a building exterior panel according to the first embodiment of the present disclosure.

FIG. 17 is an exploded view illustrating the second side frame 400 of the building exterior panel, FIG. 18 is a cross-sectional view and a plan view of the second side frame 400, and FIG. 19 is a perspective view of an exterior panel in which the front steel plate 500, the rear steel plate 600, and another frame are coupled to the second side frame 400.

The second side frame 400 includes a second portion 410, a second portion 420, a second side extending portion 430, a second side drain 440, a second side first support portion 450, and a second side second support portion 460 of the second side frame 400 and may be integrally formed through a method such as extrusion molding.

In addition, at least one inner depression 470 may be further integrally provided on the inner side of the second side frame 400. The at least one inner depression 470 provided in the second side frame 400 will be described in detail with reference to FIGS. 20 to 24.

The first portion 410 of the second side frame 400 may adjoin an end of the second side end of the front steel plate 500, have a width in the thickness direction z-z' of the exterior panel, and extend in the vertical direction from an upper side to a lower side.

The second portion 420 of the second side frame 400 may adjoin an end of the second side of the rear steel plate 600, have a width in the thickness direction z-z' of the exterior panel, depressed in the first side direction x of the exterior panel from the first portion 410 of the second side frame 400, and extend in the vertical direction y-y' from an upper side to a lower side of the exterior panel.

The second side drain 440 extending in the vertical direction y-y' may be provided at a portion engaged with an end of the upper drain 110 on an outer side of the second portion 420 of the second side frame 400.

The second side extending portion 430 may be bent in the horizontal direction x-x' in which the first side of the exterior panel is located from the end of the first portion 410 of the second side frame 400 and extend to the second portion 420 of the second side frame 400.

The second side extending portion 430 may be located to be adjacent to the rear side with respect to the front protrusion 530 provided on the front steel plate 500.

In the first embodiment of the present disclosure, a case where the outer side of the second side extending portion 430 is flat is illustrated as an example, but alternatively, a plurality of irregularities with grooves elongated in the vertical direction may be further provided on the outer side of the second side extending portion 430. This will be descried with reference to FIG. 44 below.

The first and second portions 410 and 420 of the second side frame 400 and the second side extending portion 430 may form ends of the second side depression 17 of the exterior panel.

The vertical upper end faces of the first and second portions 410 and 420 and the second side extending portion 430 of the second side frame 400 are coupled with the upper frame 100 to adjoin the inner side of the second side end of the upper frame 100, and vertical lower end faces thereof may be coupled with the lower frame 200 to adjoin the inner side of the second side end of the lower frame 200.

The second side frame 400 and the front steel plate 500 may be coupled so that a portion of the end of the second side of the front steel plate 500 bent in the rear direction z' may cover the first portion 410 of the second side frame 400, and the second side frame 400 and the rear steel plate 600 may be coupled so that a portion of the end of the second side of the rear steel plate 600 bent in the front direction z may cover the second portion 320 of the second side frame 400.

As such, the front side steel plate 500, the rear steel plate 600, the upper frame 100, and the lower frame 200 may be coupled to the second side frame 400 to form the second side depression 17.

The second side drain 440 may be located at a portion engaged with the end of the upper drain 110 on the outer side of the second portion 420 of the second side frame 400 and may be depressed inward in the direction x of the first side and extend in the vertical direction y-y' from the upper side to the lower side of the exterior panel.

A width of the second side drain 440 may be larger than a width of the upper drain 110 and may be equal to a width of the first side drain so that water guided to the upper drain 110 may flow smoothly in the lower direction of the exterior panel through the second side drain 440.

Unlike the first side frame 300, a gasket groove or a gasket may not be provided in the second side frame 400.

The second side first support portion 450 may be bent and extend in the first side direction x from the end where the first portion 410 of the second side frame 400 adjoins the front steel plate 500 in the thickness direction z-z'.

The front end adjacent to the second side of the front steel plate 500 covers the second side first support portion 450, so that the second side first support portion 450 supports an inner side of the front end adjacent to the second side of the front steel plate 500.

The second side second support portion 460 may be bent and extend in the first side direction x from an end where the second portion 420 of the second side frame 400 adjoins the rear steel plate in the thickness direction z-z'.

The rear end adjacent to the second side of the rear steel plate 600 covers the second side second support portion 460, so that the second side second support portion 460 may support the inner side of the rear end adjacent to the second side of the rear steel plate 600.

The first and second support portions 450 and 460 of the second side frame 400 may prevent the second side shape of the front steel plate 500 and the rear steel plate 600 from being deformed or damaged by a weight of the exterior panels when the front steel plate 500 and the rear steel plate 600 of the exterior panels are arranged to adjoin each other in the process of preparing to construct the exterior panels on an outer wall of a building.

In the building exterior panel according to the first embodiment of the present disclosure, at least one protrusion may be provided on an inner surface of each of one of a pair of upper and lower frames 100 and 200 facing each other in the vertical direction y-y' and a pair of first and second side frames 300 and 400 facing each other in the horizontal direction x-x' and at least one depression may be provided on an inner surface of each of the other of the pair of frames, and the at least one inner protrusion provided on the inner surface of each of one of the pair of frames is inserted into the at least one inner depression provided on the inner surface of each of one of the other pairs of frames.

As an example, as described above with reference to FIGS. 8 to 19, at least one inner protrusion 160 and 290 may be provided on inner surfaces of the upper frame 100 and the lower frame 200, respectively, and at least one depression 390 and 470 may be provided on inner surfaces of the first side frame 300 and the second side frame 400, respectively.

More specifically, the upper frame 100 has a plurality of inner protrusions 160 formed on the inner side thereof in the front direction z and the rear direction z' based on the upper drain 110.

In addition, the lower frame 200 may have a plurality of inner protrusions 290 formed on the inner side thereof in the front direction z and the rear direction z' based on a region where the upper drain 110 is projected in the vertical direction y-y'.

In addition, the first side frame 300 may have a plurality of inner depressions 390 formed on the inner side thereof in the front direction z and the rear direction z' based on the first side drain 340.

The second side frame 400 may have a plurality of inner depressions 470 formed on the inner side thereof in the front direction z side and the rear direction z' based on the second side drain 440.

As described above, at least one inner protrusion 160 and 290 provided in the upper frame 100 and the lower frame 200, respectively, may be inserted into and coupled to the at least one inner depression 390 and 470 provided in the first side frame 300 and the second side frame 400, respectively.

This will be described with reference to FIGS. 20 to 24 as follows.

FIG. 20 is a view illustrating an internal structure in which the upper frame 100 and the first side frame 300 are coupled in the building exterior panel according to the first embodiment of the present disclosure, and FIG. 21 is a view illustrating an internal structure in which the upper frame 100 and the second side frame 400 are coupled in the building exterior panel according to the first embodiment of the present disclosure.

FIG. 22 is a view illustrating an internal structure in which the lower frame 200 and the first side frame 300 are coupled in the building exterior panel according to the first embodiment of the present disclosure, and FIG. 23 is a view illustrating an internal structure in which the lower frame 200 and the second side frame 400 are coupled in the building exterior panel according to the first embodiment of the present disclosure.

As shown in FIG. 20, the first side end of the upper frame 100 extending in the horizontal direction x-x' and the upper end of the first side frame 300 extending in the vertical direction y-y' intersect to be coupled with each other.

Here, a plurality of inner protrusions 160 provided on the inner surface of the upper frame 100 may be inserted into the plurality of inner depressions 390 provided on the inner surface of the first side frame 300.

In addition, as illustrated in FIG. 21, the second side end of the upper frame 100 extending in the horizontal direction x-x' and the upper end of the second side frame 400 extending in the vertical direction y-y' may intersect to be coupled with each other.

Here, a plurality of inner protrusions 160 provided on the inner surface of the upper frame 100 may be inserted into the plurality of inner depressions 470 provided on the inner surface of the second side frame 400.

In addition, as illustrated in FIG. 22, the first side end of the lower frame 200 extending in the horizontal direction x-x' and the lower end of the first side frame 300 extending in the vertical direction y-y' may intersect to be coupled with each other.

Here, a plurality of inner protrusions 290 provided on the inner surface of the lower frame 200 may be inserted into the plurality of inner depressions 390 provided on the inner surface of the first side frame 300.

In addition, as shown in FIG. 23, the second side end of the lower frame 200 extending in the horizontal direction x-x' and the lower end of the second side frame 400 extending in the vertical direction y-y' may intersect to be coupled with each other.

Here, a plurality of inner protrusions 290 provided on the inner surface of the lower frame 200 may be inserted into the plurality of inner depressions 390 provided on the inner surface of the second side frame 400.

As described above, at least one inner protrusion 160 and 290 provided on the inner surfaces of one pair of frames (e.g., the upper frame 100 and the lower frame 200) facing each other may be inserted into the at least one inner depression 390 and 470 provided on the inner surfaces of the other pair of frames (e.g., the first side frame 300 and the second side frame 400) facing each other, thereby facilitating manufacturing the exterior panel.

More specifically, when the exterior panel is manufactured, in a state where the rear steel plate 600 is disposed with an outer side thereof facing the ground and an inner side thereof facing upper side of the ground, each of the plurality of frames may be disposed at an inner side of the upper and lower ends of the rear steel plate 600 and at the inner side of the ends of the first and second sides so as to be erected.

Here, at least one inner protrusion provided on an inner surface of each of the pair of frames may be inserted into the at least one inner depression provided on the inner surface of each of the other pair of frames, so that the one pair of frames and the other pair of frames may be supported with each other so that the frames may not fall over.

Accordingly, the inner protrusions and the inner depressions provided in each frame may facilitate manufacture of the exterior panel.

In addition, in the first embodiment of the present disclosure, the inner protrusions 160 and 290 are provided on the upper frame 100 and the lower frame 200 and the inner depressions are provided on the first and second side frames 300 and 400, for example, but alternatively, the inner depressions 390 and 470 are provided on the upper frame 100 and the lower frame 200, and the inner protrusions are provided on the first and second side frames 300 and 400.

Hereinafter, the structures of the front steel plate 500 and the rear steel plate 600 in a building exterior panel according to the first embodiment of the present disclosure will be described in detail.

FIGS. 24 to 27 are diagrams illustrating the structure of the front steel plate 500 in the building exterior panel according to the first embodiment of the present disclosure.

Here, FIG. 24 is an overall perspective view of the front steel plate 500, FIG. 25-(*a*) shows a vertical (y-y') cross section of the front steel plate 500 along the line y-y' in FIG. 24, FIG. 25-(*b*) shows a horizontal (x-x') cross section of the front steel plate 500 along the line x-x' in FIG. 24, FIG. 26-(*a*) is a front enlarged view of a portion 500K1 in FIG. 25, FIG. 26-(*b*) is a rear enlarged view of the portion 500K1 portion in FIG. 25, FIG. 27-(*a*) is a front enlarged view of a portion 500K2 in FIG. 25, and FIG. 27-(*b*) is a rear enlarged view of the portion 500K2 in FIG. 25.

The front steel plate 500 may be located on the front of the four frames described above and may form the front side of the exterior panel. The front steel plate 500 may include a front body 510, a front upper step 520, a front protrusion 530, a front upper frame 100 cover 540, a first front lower frame 200 cover 550, a second front lower frame 200 cover 560, a front steel plate 500 first side 570, and a front steel plate 500 second side 580 which are integrally provided.

That is, each part of the front steel plate 500 may be integrally formed by bending one steel plate.

Here, as shown in FIGS. 25-(*a*), 26, and 27, the front body 510 may be formed to be large in the vertical direction y-y' and the horizontal direction x-x' on the front side of the exterior panel, and the front upper step 520 may be bent and extend in the thickness direction z-z' where the rear steel plate 600 is located from an upper end of the front body 510.

The front protrusion 530 may be bent and extend in the upper direction y from the end of the front upper step 520, and the front upper frame 100 cover 540 may be bent and extend in the rear direction z' where the rear steel plate 600 is located from the upper end of the front protrusion 530.

The front upper frame 100 cover 540 may be coupled to the upper frame 100 by covering a part of the upper side of the upper frame 100 and prevent the front steel plate 500 from escaping from the upper frame 100 due to a strong external force such as strong wind or typhoon.

In addition, the first front lower frame 200 cover 550 may be bent and extend in the rear direction z' from the lower end of the front body 510, and the second front lower frame 200 cover 560 may be bent and extend in the upper direction y from the end of the first front lower frame 200 cover 550 in the rear direction z'.

The first and second front lower frame 200 cover may cover the lower side and depressed vertical surface of the lower frame 200 and be coupled to the lower frame 200, and prevent the front steel plate 500 from escaping from the lower frame 200 due to strong external force such as strong wind or typhoon.

In addition, as shown in FIGS. 25-(*b*), 26, and 27, the front steel plate 500 first side 570 may be bent and extend in the rear direction z' from the end adjacent to the first side of the front body 510 in the horizontal direction x-x', and the front steel plate 500 second side 580 may be bent and extend in the rear direction z' from the end adjacent to the second side of the front body 510 in the horizontal direction x-x'.

The front steel plate 500 first and second sides 570 and 580 may cover the first and second sides of the first and second side frames 300 and 400 so as to be coupled with the first and second side frames 300 and 400.

Here, an upper direction y extension width H530 of the front protrusion 530 may be larger than a thickness direction z-z' extension width W520 of the upper step, and the thickness direction z-z' extension width W520 of the upper step may be equal to or greater than the extension width W550 of the first front lower frame 200 cover 550.

An upper direction y extension width H530 of the front protrusion 530 may be greater than a lower direction y' extension width of the second lower frame portion 220 of the lower frame 200.

Accordingly, when a plurality of building exterior panels are coupled with each other in the vertical direction y-y', a line may be formed to extend in the horizontal direction x-x' as if the plurality of building exterior panels coupled in the vertical direction y-y' are shown to be spaced apart from each other when the plurality of exterior panels are viewed from the front. Accordingly, the appearance of the plurality of building exterior panels may become finer.

In addition, the thickness direction z-z' extension width W580 of the first and second sides 570 and 580 of the front steel plate 500 may be equal to or greater than the thickness direction z-z' extension width W520 of the front upper step 520.

FIGS. 28 to 31 are diagrams illustrating a structure of the rear steel plate 600 in a building exterior panel according to the first embodiment of the present disclosure.

Here, FIG. 28 is an overall perspective view of the rear steel plate 600, FIG. 29-(*a*) shows a vertical (y-y') cross section of the rear steel plate 600 along the line y-y' in FIG. 28, FIG. 29-(*b*) shows a horizontal (x-x') cross section of the rear steel plate 600 along the line x-x' in FIG. 28, FIG. 30-(*a*) is a front enlarged view of a portion 600K1 in FIG. 28, FIG. 30-(*b*) is a rear enlarged view of the portion 600K1 portion in FIG. 28, FIG. 31-(*a*) is a front enlarged view of a portion 600K2 in FIG. 28, and FIG. 31-(*b*) is a rear enlarged view of the portion 600K2 in FIG. 28.

The rear steel plate 600 may be located on the front of the four frames described above and may form the rear side of the exterior panel. The rear steel plate 600 may include a rear body 610, a rear upper step 620, a rear protrusion 630, a rear upper frame cover 640, a first rear lower frame 200 cover 650, a second rear lower frame 200 cover 660, a rear steel plate 600 first side 670, and a rear steel plate 600 second side 680 which are integrally provided.

That is, each part of the rear steel plate 600 may be integrally formed by bending one steel plate.

Here, FIGS. 29-(*a*), 30, and 31, the rear body 610 may be formed to be large in the vertical direction y-y' and the horizontal direction x-x' on the rear side of the exterior panel, and the rear upper step 620 may be bent and extend in the thickness direction z-z' where the front steel plate 500 is located from an upper end of the rear body 610.

The rear protrusion 630 may be bent and extend in the upper direction y from the end of the rear upper step 620, and the rear upper frame cover 640 may be bent and extend in the front direction z where the front steel plate 500 is located from the end of the rear protrusion 630.

Accordingly, the upper end of the rear protrusion 630 may cover the second upper support portion 150 of the upper frame 100 and the rear end of the upper body surface 101 and may be coupled with the upper frame 100.

Here, as described above, the insulation member 700 is located between the rear steel plate 600 and the upper frame 100 to prevent dew condensation that may occur between the rear steel plate 600 and the upper frame 100.

The rear upper frame cover 640 may be coupled to the upper frame 100 by covering a part of the upper side of the upper frame 100 and prevent the rear steel plate 600 from escaping from the upper frame 100 due to a strong external force such as strong wind or typhoon.

In addition, the first rear lower frame 200 cover 650 may be bent and extend in the front direction z from the lower end of the rear body 610, and the second rear lower frame 200 cover 660 may be bent and extend in the upper direction y from the end of the first rear lower frame 200 cover 650 in the rear direction z'.

Accordingly, the first rear lower frame 200 cover 650 may cover the fifth lower frame portion 250, and the second rear lower frame 200 cover 660 may cover the fourth lower frame portion 240 so as to be coupled with the lower frame 200.

Here, the insulation member 700 as described above may be located between the first rear lower frame 200 cover 650 and the fifth lower frame portion 250 and between the second rear lower frame 200 cover 660 and the fourth lower frame portion 240 to prevent the occurrence of dew condensation at a portion that is coupled between the rear steel plate 600 and the lower frame 200.

In addition, as shown in FIGS. 29-(*b*), 30, and 31, the rear steel plate 600 first side 670 may be bent and extend in the front direction z from the end adjacent to the first side of the rear body 610 in the horizontal direction x-x', and the rear steel plate 600 second side 680 may be bent and extend in the front direction z from the end adjacent to the second side of the rear body 610 in the horizontal direction x-x'.

The rear steel plate 600 first and second sides 670 and 680 may cover a part of the first and second side frames 300 and 400 and be coupled with the first and second side frames 300 and 400.

Here, a width W620 of the rear upper step 620 in the thickness direction may be the same as an extension width W650 of the first rear lower frame 200 cover 650.

In addition, a width W620 of the rear upper step 620 in the thickness direction may be smaller than the width W520 of the front upper step 520 in the thickness direction.

In addition, the rear upper step 620 may be located closer to the upper frame 100 than the front upper step 520. Therefore, the upper direction y extension width H630 of the rear protrusion 630 may be smaller than the upper direction y extension width H530 of the front protrusion 530.

In addition, the vertical (y-y') position of the first rear lower frame 200 cover 650 may be located in the vertical direction y-y' of the first front lower frame 200 cover 550.

Such building exterior panels according to the first embodiment of the present disclosure may be integrally formed by assembling and coupling a front steel plate 500, a rear steel plate 600, an upper frame 100, a lower frame 200, a first side frame 300, and a second side from 400.

In addition, the building exterior panel according to the first embodiment of the present disclosure may include the upper protrusion 11 at an upper portion of the exterior panel, the lower depression 13 at a lower portion, a first side protrusion 15 at the first side, and the second side depression 17 at the second side due to a unique shape of each of the rear steel plate 600, the upper frame 100, the lower frame 200, the first side frame 300, and the second side frame 400.

In addition, in the building exterior panel according to the first embodiment of the present disclosure, a gasket may be provided on each portion of a protruding upper surface of the upper protrusion 11 excluding the second side depression 17, the depressed lower surface of the lower depression 13, and the protruding side surface of the first side protrusion 15, and the gaskets may couple the exterior panels so that, when constructed at the outer wall of a building, the gaskets integrally fixed to the exterior panel in advance may facilitate the construction and a construction process may not be hindered by the gaskets.

Hereinafter, an example in which a plurality of building exterior panels according to the first embodiment are coupled in the vertical direction and the horizontal direction x-x' will be described.

FIG. 32 is an enlarged view of a plurality of building exterior panels coupled in the vertical direction y-y', and FIG. 33 is an enlarged view of a plurality of building exterior panels coupled in the horizontal direction x-x'.

As illustrated in FIG. 32, a plurality of building exterior panels may be assembled and coupled in the vertical direction y-y', and here, the lower depression 13 formed on the lower side of a first exterior panel 10*a* located above among a plurality of exterior panels may be inserted and coupled to the upper protrusion 11 formed on the upper side of a third exterior panel 10*c* located below.

Here, as shown in FIG. 32, the upper protrusion 11 of the third exterior panel 10*c* and the lower depression 13 of the first exterior panel 10*a* may be spaced apart from each other in the vertical direction y-y' due to the lower gasket 270 of the first exterior panel 10*a* and the upper gasket 130 of the third exterior panel 10*c*.

Here, the lower end of the front steel plate 500 provided at the first exterior panel 10*a* and the front upper step 520 of the third exterior panel 10*c* may be spaced apart from each other, and the lower end of the rear steel plate 600 provided at the first exterior panel 10*a* and the rear upper step 620 of the third exterior panel 10*c* may be spaced apart from each other.

Here, a first interval D1 between the lower end of the front steel plate 500 provided at the first exterior panel 10*a* and the front upper step 520 of the third exterior panel 10*c* may be greater than a second interval D2 between the lower end of the rear steel plate 600 provided at the first exterior panel 10*a* and the rear upper step 620 of the third exterior panel 10*c*.

Thus, in the assembly structure of the building exterior panel according to the present disclosure, although the first exterior panel 10*a* and the third exterior panel 10*c* are spaced apart from each other in the vertical direction y-y', an introduction of cold air in the rear direction z' where the building outer wall is located from the front outside of the plurality of exterior panels may be effectively blocked by the lower gasket 270 and the upper gasket 130 located at the front side and the rear side of the upper drain 110.

In addition, since the upper drain 110 is located between the upper gasket 130 and the lower gasket 270, even if water is introduced in a space between the exterior panels from the outside, a possibility of water leakage in a space between the building outer wall and the exterior panel may be prevented in advance.

In addition, as shown in FIGS. 32 and 33, water introduced into the upper drain 110 may flow in the lower direction y' of the exterior panel through the first and second side drains.

As shown in FIG. 33, a plurality of building exterior panels may be assembled and coupled in the horizontal direction x-x', and here, the first exterior panel 10*a* located on one side in the horizontal direction x-x', among the plurality of exterior panels, and the second exterior panel 10*b* located horizontally on the second side of the first exterior panel 10*a* may be coupled with each other in the horizontal direction.

Here, the first side protrusion 15 formed on the first side of the first exterior panel 10*a* may be inserted into and coupled to the second side depression 17 formed on the second side of the second exterior panel 10*b*.

Here, the first side protrusion 15 of the first exterior panel 10*a* and the second side depression 17 of the second exterior panel 10*b* may be spaced apart from each other in the horizontal direction x-x' due to the first side gasket 360 of the first exterior panel 10*a* as shown in FIG. 33.

Here, the first side end of the front steel plate 500 provided at the first exterior panel 10*a* and the second side end of the front steel plate 500 provided at the second exterior panel 10*b* may be spaced apart from each other, and the first side end of the rear steel plate 600 provided at the first exterior panel 10*a* and the second side end of the rear steel plate 600 provided at the second exterior panel 10*b* may be spaced apart from each other.

Here, a third interval D3 between the first side end of the front steel plate 500 provided at the first exterior panel 10*a* and the second side end of the front steel plate 500 provided at the second exterior panel 10*b* and a fourth interval D4 between the first side end of the rear steel plate 600 provided at the first exterior panel 10*a* and the second side end of the rear steel plate 600 provided at the second exterior panel 10*b* may be equal to each other.

Thus, in the assembly structure of the building exterior panel according to the present disclosure, although the first exterior panel 10*a* and the second exterior panel 10*b* are spaced apart from each other in the horizontal direction x-x', an introduction of cold air in the rear direction z' where the building outer wall is located from the front outside of the plurality of exterior panels may be effectively blocked by the first side gasket 360 provided at the first side protrusion 15 of the first exterior panel 10*a*.

In addition, the exterior panel according to the present disclosure is not provided with gaskets on both sides thereof in the horizontal direction x-x' and the first side gasket 360 is provided on only one of both sides, and thus, the gasket may not interfere with the assembly construction process when the plurality of exterior panels are assembled in the horizontal direction x-x'.

That is, when assembling a plurality of exterior panels, the exterior panels may be moved in a horizontal direction x-x' and coupled as shown in FIG. 33, and here, if gaskets are provided on both sides of the first side protrusion 15 and the second side protrusion 17, the gaskets may be caught by each other to cause a difficulty in construction. In the present disclosure, however, the gasket is provided only on the first side protrusion 15 among the first side protrusion 15 and the second side depression 17, facilitating construction.

In addition, in the first embodiment of the present disclosure, a case where the side gasket is provided on the first side protrusion 15 is described as an example, but the gasket may also be provided on the second side depression 17, rather than on the first side protrusion 15.

As described above, in the first embodiment, the upper protrusion 11 is provided on the exterior panel, the lower depression 13 is provided under the exterior panel, the first side protrusion 15 is provided on the first side, and the second side depression 17 is provided on the second side.

However, the present disclosure is not limited thereto, and in order to facilitate coupling with windows and doors arranged on an outer wall of a building, the shape of some of the four frames may be modified.

For example, for coupling with a window, the first side protrusion 15 may be omitted in the first side of the exterior panel and the first side may be formed to be flat overall, or the second side depression 17 may be omitted in the second side of the exterior panel and the second side may be formed to be flat overall.

Accordingly, the exterior panel may be more easily coupled to a window frame of a window.

Hereinafter, an example in which the first side protrusion 15 is omitted or the second side depression 17 is omitted in each of the first and second sides of the exterior panel will be described.

FIGS. 34 to 35 are views illustrating a first modification of the first embodiment of the building exterior panel according to the present disclosure.

Here, FIG. 34 is a view illustrating an building exterior panel according to the first modification in which the first side protrusion 15 is omitted, and FIG. 35-(*a*) and FIG. 35-(*b*) a plan view and a cross-sectional view illustrating a modification of the first side frame 300' used in the first side of the exterior panel without the first side protrusion 15.

As shown in FIG. 34, the building exterior panel according to the first modification may be the same as the first embodiment, except that the first side protrusion 15 is omitted. That is, the upper protrusion 11, the lower depression 13, and the second side depression 17 of the building exterior panel according to the first modification may be the same as those of the first embodiment.

However, as the first side protrusion 15 is omitted, a planar shape of the first side of an upper frame 100' forming the upper protrusion 11 and a planar shape of the first side of the lower frame 200 forming the lower depression 13 may be different from the first embodiment.

That is, the planar shape of the first side of the upper frame 100' does not protrude in the horizontal direction x-x', and, except for a portion forming the upper drain 110, a first side end line may be formed as a straight line. Also, in the lower frame 200, a planar shape of the first side does not protrude in the horizontal direction x-x' and a first side end line may be formed as a straight line.

In addition, a position of the first side end of a front steel plate 500' and a position of the first side end of a rear steel plate 600' may be the same.

In addition, in a modified first side frame 300' used in the first side of the exterior panel in which the first side protrusion 15 is omitted, as compared to the first side frame 300 of the first embodiment, a third portion is omitted and a first portion and a second portion of the first side frame 300' may be located on the same vertical direction y-y' line and the first side gasket 360 groove and the first side gasket 360 may be omitted.

Accordingly, the first side frame 300' modified according to the first modification of the present disclosure may be integrally formed by including a first side frame body 320', a first side drain 340, and a first side first support portion 370.

In addition, at least one inner depression 390 may be further integrally provided on the inner side of the first side frame body 320'.

Here, the first side frame body 320' may adjoin the first side end of the front steel plate 500 and the first side end of the rear steel plate 600, have a width in the thickness direction z-z' of the exterior panel, and extend from the upper side to the lower side in the vertical direction y-y'.

In addition, a first side drain 340 extending in the vertical direction y-y' may be provided at a portion engaged with the end of the upper drain 110 of the outer surface of the first side frame body 320'.

In addition, the first side drain 340, the first side first and second support portions 370 and 380, and the inner depression 390 of the first side frame 300 modified according to the second embodiment may be formed to be the same as those described above in the first embodiment.

In addition, a planar shape of the first side frame 300 modified according to the first modification shown in FIG. 35-(*a*) may also be the same as that of the first embodiment.

FIGS. 36 and 37 are views illustrating a second modification of the first embodiment of the building exterior panel according to the present disclosure.

Here, FIG. 36 is a view illustrating an building exterior panel according to the second modification in which the second side depression 17 is omitted, and FIG. 37-(*a*) and FIG. 37-(*b*) are a plan view and a cross-sectional view illustrating a modification of the second frame used in the second side of the exterior panel in which the second side depression 17 is omitted.

As shown in FIG. 36, the building exterior panel according to the second modification may be the same as the first embodiment, except that the second side depression 17 is omitted. That is, the upper protrusion 11, the lower depression 13, and the second side depression 17 may be maintained as in the first embodiment.

However, as the second side depression 17 is omitted, a planar shape of the second side of an upper frame 100" forming the upper protrusion 11 and a planar shape of the second side of the lower frame (not shown) forming the lower depression 13 may be different from the first embodiment.

That is, the planar shape of the second side of the upper frame 100" is not depressed in the horizontal direction x-x', and, except for a portion forming the upper drain 110, a second side end line may be formed as a straight line. Also, in the lower frame (not shown), a planar shape of the second side is not depressed in the horizontal direction x-x' and a second side end line may be formed as a straight line.

In addition, a position of the second side end of a front steel plate 500" and a position of the second side end of a rear steel plate 600" may be the same.

In addition, in a modified second side frame 400 used in the second side of the exterior panel in which the second side depression 17 is omitted, a third portion is omitted and a first portion 410 and a second portion 420 of the second side frame 400 may be located on the same vertical direction y-y' line, as compared to the first side frame 300 of the first embodiment.

Accordingly, the second side frame 400 modified according to the second modification of the present disclosure may be integrally formed by including a second side frame body 420', a second side drain 440, and a second side first support portion 450.

In addition, at least one inner depression 470 may be further integrally provided on the inner side of the second side frame body 420'.

Here, the second side frame body 420' may adjoin the second side end of the front steel plate 500" and the second side end of the rear steel plate 600", have a width in the thickness direction z-z' of the exterior panel, and extend from the upper side to the lower side in the vertical direction y-y'.

In addition, a second side drain 440 extending in the vertical direction y-y' may be provided at a portion engaged with the end of the upper drain 110 of the outer surface of the second side frame body 420'.

In addition, the second side drain 440, the second side first and second support portions 450 and 460, and the inner depression 470 of the second side frame 400 modified according to the second modification may be formed to be the same as those described above in the first embodiment.

In addition, a planar shape of the second side frame 400 modified according to the second modification shown in FIG. 37-(*a*) may also be the same as that of the first embodiment.

In the building exterior panel according to the first and second modifications of the present disclosure, the first side protrusion 15 is omitted or the second side depression 17 is omitted, so that coupling with a window may be facilitated and is tight.

In the first embodiment of the present disclosure described above, a case where the drains are provided in the upper frame 100 and the first and second side frames is described as an example, but the drain 110 provided in the upper fame may be omitted to reduce manufacturing cost of the panel.

Hereinafter, a case where a drain is omitted in a building exterior panel will be described as an example.

FIGS. 38 to 43 are diagrams illustrating a second embodiment of an building exterior panel according to the present disclosure.

FIG. 38 shows a vertical side of a building exterior panel according to a second embodiment of the present disclosure, and FIG. 39 shows a horizontal upper side of a building exterior panel in the second embodiment of the present disclosure.

In addition, FIG. 40 is a cross-sectional view of the upper frame 100 according to the second embodiment of the present disclosure, FIG. 41 is a cross-sectional view of the lower frame 200 according to the second embodiment of the present disclosure, FIG. 42 is a cross-sectional view of the first side frame 300 according to the second embodiment of the present disclosure, and FIG. 43 is a cross-sectional view of a second side frame 400 according to the second embodiment of the present disclosure.

As illustrated in FIGS. 38 and 39, unlike the first embodiment described above, in the building exterior panel according to the second embodiment of the present disclosure, a drain is not provided on the upper side of the exterior panel and the portion where the drain was provided on the upper side may be configured to be flat. Meanwhile, the first and second side drains 340 and 440 may be provided on the first and second sides of the exterior panel as in the first embodiment.

Accordingly, as illustrated in FIG. 40, the drain is omitted in the upper frame 100, and the upper body surface 101, on which the drain was provided in the first embodiment, may become flat.

Accordingly, the upper frame 100 may be formed by including the upper body surface 101, the upper gasket groove 120, the upper gasket 130, the first upper support portion 140, and the second upper support portion 150 without the upper drain, and one protrusion 160 may be provided on the inner side of the upper frame 100.

In addition, the insulation member 700 as described above may be provided at the rear end of the upper body surface 101 and the outer surface of the upper support portion 150 in the upper frame 100, thereby eliminating a problem that dew condensation occurs at a portion where the upper end of the rear steel plate 600 and the upper frame 100 are coupled.

In addition, the description of each of the other components of the upper frame 100 according to the second embodiment of the present disclosure is the same as those described in the first embodiment, and thus will be omitted.

In addition, as shown in FIG. 41, a configuration of the lower frame 200 according to the second embodiment of the present disclosure may be the same as that of the lower frame 200 according to the first embodiment, except that only one inner protrusion 290 is provided on the inner surface of the lower frame 200.

Accordingly, the lower frame 200 may include the first to fifth lower frame portions 210, 220, 230, 240, and 250, the lower gasket groove 260, the lower gasket 270, the first lower support portion 281, and at least one inner protrusion 290.

A detailed description of the lower frame 200 according to the second embodiment of the present disclosure is replaced with the description of the lower frame 200 described in the first embodiment.

In addition, in the lower frame 200 of the second embodiment of the present disclosure, the insulation member 700 may be located on the outer surfaces of the fourth and fifth lower frames 200, and a lower end of the rear steel plate 600 may be in close contact with the outer surfaces of the fourth and fifth lower frames 240 and 250 provided with the insulation member 700 so as to be coupled.

Accordingly, dew condensation may be prevented from occurring at the coupling portion of the lower end of the rear steel plate 600 and the lower frame 200.

In addition, as illustrated in FIG. 42, in the first side frame 300 according to the second embodiment of the present disclosure, the first side drain 340 may be maintained as in the first embodiment.

Accordingly, the first side frame 300 may include the first side drain 340 and the first portion 310, the second portion 320, the first side extending portion 330, the first side gasket groove 350, the first side gasket 360, the first side first support portion 370, and the first side second support portion 380 of the first side frame 300 and may be integrally formed through a method such as extrusion molding, and the inner surface of the first side frame 300 may be provided integrally with one inner depression 390.

The other components of the first side frame 300 according to the second embodiment of the present disclosure is are same as those described in the first embodiment, and thus a description thereof will be omitted.

In addition, as shown in FIG. 43, in the second side frame 400 according to the second embodiment of the present disclosure, the second side drain 440 may be maintained as in the first embodiment.

Accordingly, the second side frame 400 may include the second side drain 440 and the first portion 410 and the second portion 420, the second side extending portion 430, the second side first support portion 450, and the second side second support portion 460 of the second side frame 400 and may be integrally formed through a method such as extrusion molding, and one inner depression 470 may be integrally provided on the inner surface of the second side frame 400.

In addition, the other components of the second side frame 400 according to the second embodiment of the present disclosure are the same as those described above in the first embodiment, and thus a description thereof will be omitted.

In the first and second embodiments of the building exterior panel according to the present disclosure, a case where the gasket is provided at the first side extending portion 330 provided in the first side frame 300 and the second side extending portion provided in the second side frame 400 is formed to be flat has been described, but conversely, a gasket may be provided at the second side extending portion 430 and the first side extending portion 330 may be formed to be flat.

In addition, when the gasket is provided at the first side extending portion 330, a plurality of irregularities may be provided at the second side extending portion 430.

This will be described in more detail as follows.

FIGS. 44 and 45 are views illustrating a modification of the second side frame 400 in the first and second embodiments of the building exterior panel according to the present disclosure.

As illustrated in FIG. 44-(*a*) and FIG. 45, a plurality of irregularities 430P may be formed on the outer surface of the second side extending portion 430 of the second side frame 400 which is a portion extending in the horizontal direction x-x' to form the second side depression 17 in the second side frame 400.

The plurality of irregularities 430P may be formed such that protrusions and depressions are repeated in the horizontal direction x-x' and the protrusions and depressions forming the plurality of irregularities may extend in the vertical direction.

Here, as shown in FIG. 44-(*b*), the second side extending portion 430 is a portion where the first side gaskets 360 of the first side frames 300 of the building exterior panels adjacent to each other adjoin when two building exterior panels are constructed on the entire surface of a building truss 30.

Accordingly, when a plurality of irregularities 430P are formed on the outer surface of the second side extending portion 430, thermal bridges that may occur through the sides between the two building exterior panels constructed in contact with each other may be prevented tightly.

Here, as shown in FIG. 44-(*a*), a plurality of irregularities 430P on the outer surface of the second side extending portion 430 may be formed alternately with protrusions and depressions in the horizontal direction x-x' and each of the protrusions and the depressions may have a curved surface, or as shown in FIG. 45, the protrusions and depressions may have a square shape which is an angled shape.

As descried above, in the first and second embodiments of the building exterior panel according to the present disclosure, a case where the gasket groove and the gasket are provided in the upper frame and the lower frame, respectively, has been described as an example. However, in order to save a manufacturing cost for the upper frame and the lower frame, the gasket groove and the gasket may be omitted in the upper frame and the lower frame. This will be described in more detail as follows.

FIGS. 46 and 47 are diagrams illustrating a modification of an upper frame and a lower frame in a building exterior panel according to the present disclosure.

In FIGS. 46 and 47, descriptions of the same parts as those of the first and second embodiments are omitted, and different parts are mainly described.

FIG. 46 is a cross-sectional view according to a modification of the upper frame 100 and FIG. 47 is a cross-sectional view according to a modification of the lower frame.

As shown in FIG. 46, the modification of the upper frame 100 may include the upper body surface 101, the first upper support portion 140, the second support portion 150, and the insulation member 700, without the upper gasket groove 120 and the upper gasket 130, and the inner surface of the upper frame 100 may be provided with one protrusion 160.

In addition, the upper frame 100 according to the modification may include at least one cushioning member 100P on the upper body surface 101. FIG. 46 shows an example in which two cushioning members 100P are provided.

The cushioning member 100P may be formed of the same material as the insulation member 700 described above. Therefore, the cushioning member 100P may include an adhesive portion adhered to the upper body surface 101 and a cushioning portion integrally formed on the adhesive portion. The cushioning portion may be formed of a PVC foam material.

The cushioning members 100P may be elongated in the horizontal direction, and may be spaced apart from each other in the thickness direction z-z' on the upper body surface 101.

Here, the two cushioning members 100P arranged to be elongated in the horizontal direction may form a drain omitted in the upper frame 100. That is, a space between the two cushioning members 100P may function as a drain.

Accordingly, the two cushioning members 100P spaced apart from each other in the thickness direction may be located such that the first side drain 340 formed on the first side of the exterior panel and second side drain 440 formed on the second side of the exterior panel adjoin the space between the two cushioning members 100P vertically.

That is, the first side end of the region located between the two cushioning members 100P and elongated in the horizontal direction may adjoin the first side drain 340, and the second side end may adjoin the side drain 440.

Accordingly, even if the upper frame 100 does not have a separate drain, the upper frame 100 may have the cushioning members 100P to provide the same function as a drain, thus reducing a manufacturing cost for the upper frame 100.

In addition, as shown in FIG. 47, the lower frame 200 according to the modification may include the first to fifth lower frame portions 210, 220, 230, 240, and 250, the first lower support portion 281, at least one inner protrusion 290, and the insulation member 700, without the lower gasket groove 260 and the lower gasket 270.

In this way, since the lower gasket groove 260 and the lower gasket 270 are omitted, the manufacturing cost for the lower frame 200 may be further reduced.

The embodiments of the present disclosure have been described in detail, but the scope of the present disclosure is not limited thereto and various variants and modifications by a person skilled in the art using a basic concept of the present disclosure defined in claims also belong to the scope of the present disclosure.

The invention claimed is:

1. A building exterior panel, comprising:

a front steel plate;

a rear steel plate spaced apart from the front steel plate in a rear direction of the front steel plate;

an upper frame having a width in a thickness direction from the front steel plate toward the rear steel plate and disposed between an upper end of the front steel plate and an upper end of the rear steel plate so as to be coupled;

a first side frame having a width in the thickness direction and disposed at an end of a first side among both ends of each of the front steel plate and the rear steel plate in a horizontal direction so as to be coupled;

a second side frame having a width in the thickness direction and disposed at an end of a second side among the both ends of each of the front steel plate and the rear steel plate in the horizontal direction so as to be coupled; and a lower frame having a width in the thickness direction and disposed between a lower end of the front steel plate and a lower end of the rear steel plate so as to be coupled, wherein the rear steel plate comprises:

a rear body formed to be large in a vertical direction and a horizontal direction;

a rear upper step bent and extending in a front direction in which the front steel plate is located from an upper end of the rear body;

a rear protrusion bent and extending in the upper direction from the rear upper step;

a rear upper frame cover bent and extending in the front direction from an end of the rear protrusion and covering a portion of an upper outer surface adjacent to the rear side of the upper frame; and a rear lower frame cover bent and extending in the front direction from a lower end of the rear body and covering a portion of a lower outer surface adjacent to the rear side of the lower frame, and wherein the insulation member is located between the rear upper frame cover and the upper frame and between the rear lower frame cover and the lower frame.

2. The building exterior panel of claim 1, wherein the front steel plate comprises:

a front body formed to be large in the vertical direction and the horizontal direction;

a front upper step bent and extending in the thickness direction in which the rear steel plate is located from an upper end of the front body;

a front protrusion bent and extending in the upper direction from an end of the front upper step;

a front upper frame cover bent and extending in the rear direction from an end of the front protrusion and covering a portion of an upper outer surface of the front side of the upper frame; and a front lower frame cover bent and extending in the rear direction from a lower end of the front body and covering a portion of a lower outer surface of the front side of the lower frame, wherein an extension width of the front protrusion in the upper direction is larger than an extension width of the rear protrusion in the upper direction.

3. The building exterior panel of claim 2, wherein the first side frame includes a first side extending portion extending to protrude in the horizontal direction from a first side end of the front steel plate, wherein the first side extending portion is located closer to the rear side with respect to the front protrusion, and the second side frame includes a second side extending portion extending to be depressed in the horizontal direction from a second side end of the front steel plate, wherein the second side extending portion is located closer to the rear side with respect to the front protrusion.

4. The building exterior panel of claim 3, wherein one of the first side extending portion of the first side frame and the second side extending portion of the second side frame includes a gasket groove and further includes a side gasket inserted into and fixed to the gasket groove.

5. The building exterior panel of claim 3, wherein the other of the first side extending portion of the first side frame and the second side extending portion of the second side frame further includes a plurality of irregularities with grooves elongated in the vertical direction or is flat without a plurality of irregularities.

* * * * *